US007134654B2

(12) United States Patent
Yamada et al.

(10) Patent No.: US 7,134,654 B2
(45) Date of Patent: Nov. 14, 2006

(54) SHEET FINISHER AND IMAGE FORMING SYSTEM USING THE SAME

(75) Inventors: Kenji Yamada, Tokyo (JP); Nobuyoshi Suzuki, Tokyo (JP); Masahiro Tamura, Kanagawa (JP); Hiromoto Saitoh, Kanagawa (JP); Shuuya Nagasako, Tokyo (JP); Hiroki Okada, Kanagawa (JP); Junichi Iida, Kanagawa (JP); Akihito Andoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/140,969

(22) Filed: Jun. 1, 2005

(65) Prior Publication Data

US 2005/0218579 A1 Oct. 6, 2005

Related U.S. Application Data

(62) Division of application No. 10/253,652, filed on Sep. 25, 2002, now Pat. No. 6,957,810.

(30) Foreign Application Priority Data

Sep. 25, 2001 (JP) ..... 2001-290600
Nov. 16, 2001 (JP) ..... 2001-352031
Jul. 1, 2002 (JP) ..... 2002-192536

(51) Int. Cl.
*B65H 43/00* (2006.01)

(52) U.S. Cl. ..... 270/58.08; 271/302; 271/303

(58) Field of Classification Search ..... 270/58.08, 270/58.11; 271/301, 302, 303; 399/407, 399/410

See application file for complete search history.

(56) References Cited

U.S. PATENT DOCUMENTS 4,318,542 A 3/1982 Altmann et al.

(Continued)

FOREIGN PATENT DOCUMENTS

DE 20 33 341 3/1971

(Continued)

OTHER PUBLICATIONS

Patent Abstracts of Japan, JP 63-043165, Feb. 24, 1988.

(Continued)

*Primary Examiner*—Khoi H. Tran
(74) *Attorney, Agent, or Firm*—Oblon, Spivak, McClelland, Maier & Neustadt, P.C.

(57) ABSTRACT

A sheet finisher for executing preselected processing with a sheet conveyed thereto of the present invention includes a first processing tray configured to temporarily store the sheet and deliver it. A first and a second path are positioned downstream of the first processing tray in a direction of sheet conveyance and configured to convey a first and a second sheet stack, respectively. The first path conveys the first sheet stack upward over the downstream portion of the first processing tray while the second path conveys it downward over the same. A switching device selects either one of the first and second paths. The sheet finisher of the present invention is low cost and highly productive and space saving.

32 Claims, 53 Drawing Sheets

U.S. PATENT DOCUMENTS

| | | | | |
|---|---|---|---|---|
| 4,858,909 | A * | 8/1989 | Stemmle | 271/184 |
| 5,020,784 | A | 6/1991 | Asami et al. | |
| 5,108,081 | A | 4/1992 | Russel et al. | |
| 5,201,517 | A * | 4/1993 | Stemmle | 271/291 |
| 5,263,703 | A * | 11/1993 | Derrick | 271/186 |
| 5,746,424 | A | 5/1998 | Rutten et al. | |
| 5,944,645 | A | 8/1999 | Kobayashi | |
| 6,022,011 | A | 2/2000 | Hirose | |
| 6,076,817 | A | 6/2000 | Kobayashi et al. | |
| 6,354,059 | B1 | 3/2002 | Yoshie et al. | |
| 6,568,669 | B1 | 5/2003 | Hosaka | |

FOREIGN PATENT DOCUMENTS

| | | |
|---|---|---|
| EP | 0 754 643 | 1/1997 |
| EP | 0 768 262 | 4/1997 |
| EP | 768262 | 4/1997 |
| EP | 1 074 397 | 2/2001 |
| JP | 7-187479 | 7/1995 |
| JP | 9-183558 | 7/1997 |
| JP | 10-59610 | 3/1998 |
| JP | 10-181990 | 7/1998 |
| JP | 10-218475 | 8/1998 |
| JP | 11-286368 | 10/1999 |
| JP | 2000-63031 | 2/2000 |
| JP | 2000-72320 | 3/2000 |
| JP | 2000-072320 | 3/2000 |
| JP | 2000-86067 | 3/2000 |
| JP | 2000-118860 | 4/2000 |
| JP | 2000-118861 | 4/2000 |
| JP | 2000-143081 | 5/2000 |
| JP | 2000-153947 | 6/2000 |
| JP | 2002-68577 | 3/2002 |

OTHER PUBLICATIONS

Patent Abstracts of Japan, JP 3-293255, Dec. 24, 1991.
Patent Abstracts of Japan, JP 9-208104, Aug. 12, 1997.

* cited by examiner

CENTER STAPLE & FOLD MODE

SHEET FINISHER AND IMAGE FORMING SYSTEM USING THE SAME

CROSS-REFERENCE TO RELATED APPLICATIONS

The present application is a Divisional of U.S. application Ser. No. 10/253,652 filed on Sep. 25, 2002, now U.S. Pat. No. 6,957,810, and in turn claims priority to JP 2001-290600 filed on Sep. 25, 2001, JP 2001-352031 filed on Nov. 16, 2001, and JP 2002-192536 filed on Jul. 1, 2002, the entire contents of each of which are hereby incorporated herein by reference.

BACKGROUND OF THE INVENTION

1. Field of the Invention

The present invention relates to a sheet finisher mounted on or operatively connected to a copier, printer or similar image forming apparatus for sorting, stacking, stapling, punching, positioning, folding or otherwise finishing a sheet or sheets carrying images thereon, and an image forming system consisting of the sheet finisher and an image forming apparatus.

2. Description of the Background Art

Today, a sheet finisher for the above application is extensively used and located downstream of an image forming apparatus for finishing sheets, or recording media, in various ways. An advanced finisher recently proposed has multiple functions including a center stapling function and a folding function in addition to an edge stapling function. Japanese Patent Laid-Open Publication No. 2001-19269, for example, discloses a sheet finisher including a roller pair configured to fold a sheet stack at the center while conveying the sheet stack via its nip.

Japanese Patent Laid-Open Publication Nos. 7-48062 and 2000-153947, for example, each disclose a sheet finisher in which edge stapling and center stapling are effected independently of each other with a sheet path being switched at the inlet of the finisher. Although this type of sheet finisher can be easily constructed into a unit and can adapt to a less-option configuration, it is not desirable in the cost aspect because its functions overlap each other. Further, in a center staple mode, the sheet finisher performs folding of a sheet stack at the same position as positioning and stapling, so that a sheet stack of the next job cannot be brought to the center stapling position until the folding of the previous job completes. This prevents productivity from being enhanced.

In light of the above, Japanese Patent Laid-Open Publication Nos. 2000-11886 and 7-187479, for example, each teach a sheet finisher including a staple tray or processing tray inclined such that its downstream side in the direction of sheet feed is higher in level than the upstream side. A sheet stack is positioned and stapled on such a staple tray in either one of an edge staple mode and a center staple mode and then switched back to be conveyed to another station, which is assigned to folding. More specifically, the stapled sheet stack is conveyed in a direction opposite to a direction in which a sheet stack stapled at its edge is to be discharged. The folding station arranged independently of the stapling station enhances productivity and minimizes an increase in cost ascribable to overlapping mechanisms. However, a fold tray located at the folding station must be configured long enough to enhance productivity. As a result, the staple tray positioned above the fold tray and the fold tray are contiguous with each other in a "<" configuration, making the sheet finisher bulky. This cannot meet the increasing demand for apace saving.

For size reduction, Japanese Patent Laid-Open is Publication No. 2000-63031, for example, proposes a sheet finisher constructed to fold a sheet stack extending over two processing trays. This construction, however, cannot enhance productivity.

Japanese Patent Laid-Open Publication Nos. 11-286368 and 2000-86067 each propose a sheet finisher in which a fold roller is positioned slightly above the intermediate portion of a fold tray so as to directly fold a sheet stack and then drive it out of the finisher, thereby implementing the shared use of a processing tray and a short conveyance path. Such a sheet finisher, however, not only fails to enhance productivity, as stated earlier, but also is large size because the fold roller is positioned above the inclined tray.

Of course, a sheet finisher with a single function, i.e., a center stapling function, as disclosed in Japanese Patent Laid-Open Publication No. 9-183558, cannot meet the needs on today's market.

Generally, in a staple mode available with a sheet finisher, it is a common practice to position consecutive sheets on a position tray, staple the resulting sheet stack with stapling means, and then convey the stapled sheet stack to a tray located at the most downstream portion of the sheet finisher. In a center staple mode, a sheet stack stapled at the center is conveyed to a folding section and then conveyed to the above tray. This type of sheet finisher includes a plurality of paths each being assigned to a particular mode and path switching means for selecting one of the paths matching with a mode selected.

When the sheet finisher with the folding function stated above conveys a sheet stack to a folding station, the sheet stack is apt to become loose if conveyed at high speed although the speed may allow a stapled sheet stack to be surely conveyed. The loose sheet stack cannot be stapled in a neat configuration. However, if the conveying speed is lowered, then the next sheet stack (job) cannot be received. This lowers CPM and therefore requires the productivity of the image forming apparatus to be lowered. That is, how high the operation speed of the image forming apparatus may be, the productivity of the image forming apparatus is limited by the ability of the sheet finisher.

Assume that the path switching means is operated when a job for outputting a desired number of sets (copies) of copies of documents or outputting a plurality of booklets is to be executed. For example, assume that in a center staple mode the path switching means selects a path for conveying a sheet stack downward from a staple tray instead of a path for conveying it upward from the staple tray. Then, the path switching means catches a sheet entering the staple tray and causes it to jam the path or to crease or otherwise deform. Further, if the path switching means is so positioned as to select the downward path when a sheet stack jams the path at a branch portion, it is difficult for the operator to remove the jamming sheet stack.

Moreover, in the case where a sheet stack includes a cover or a slip sheet different in kind and size from the other sheets, a roller or a projection included in the path switching means is likely to catch the sheet stack and damage it. More specifically, the size of a sheet varies when it is passed through a fixing section in accordance with the degree of moisture absorption.

Technologies relating to the present invention are also disclosed in, e.g., Japanese Patent Laid-Open Publication Nos. 10-59610, 10-181990, 10-218475, 2000-72320, 2000-118860, 2000-143081 and 2000-68577.

SUMMARY OF THE INVENTION

It is an object of the present invention to provide a sheet finisher that is low cost and highly productive and space-saving, and an image forming system using the same.

It is another object of the present invention to provide a sheet finisher capable of obviating sheet jams, creases and scratches during operation and facilitating jam processing in the case of a sheet jam, and an image forming system using the same.

A sheet finisher for executing preselected processing with a sheet conveyed thereto of the present invention includes a first processing tray configured to temporarily store the sheet and deliver it. A first and a second path are positioned downstream of the first processing tray in a direction of sheet conveyance and configured to convey a first and a second sheet stack, respectively. The first path conveys the first sheet stack upward over the downstream portion of the first processing tray while the second path conveys it downward over the same. A switching device selects either one of the first and second paths.

An image forming system including the above sheet finisher and an image forming apparatus is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
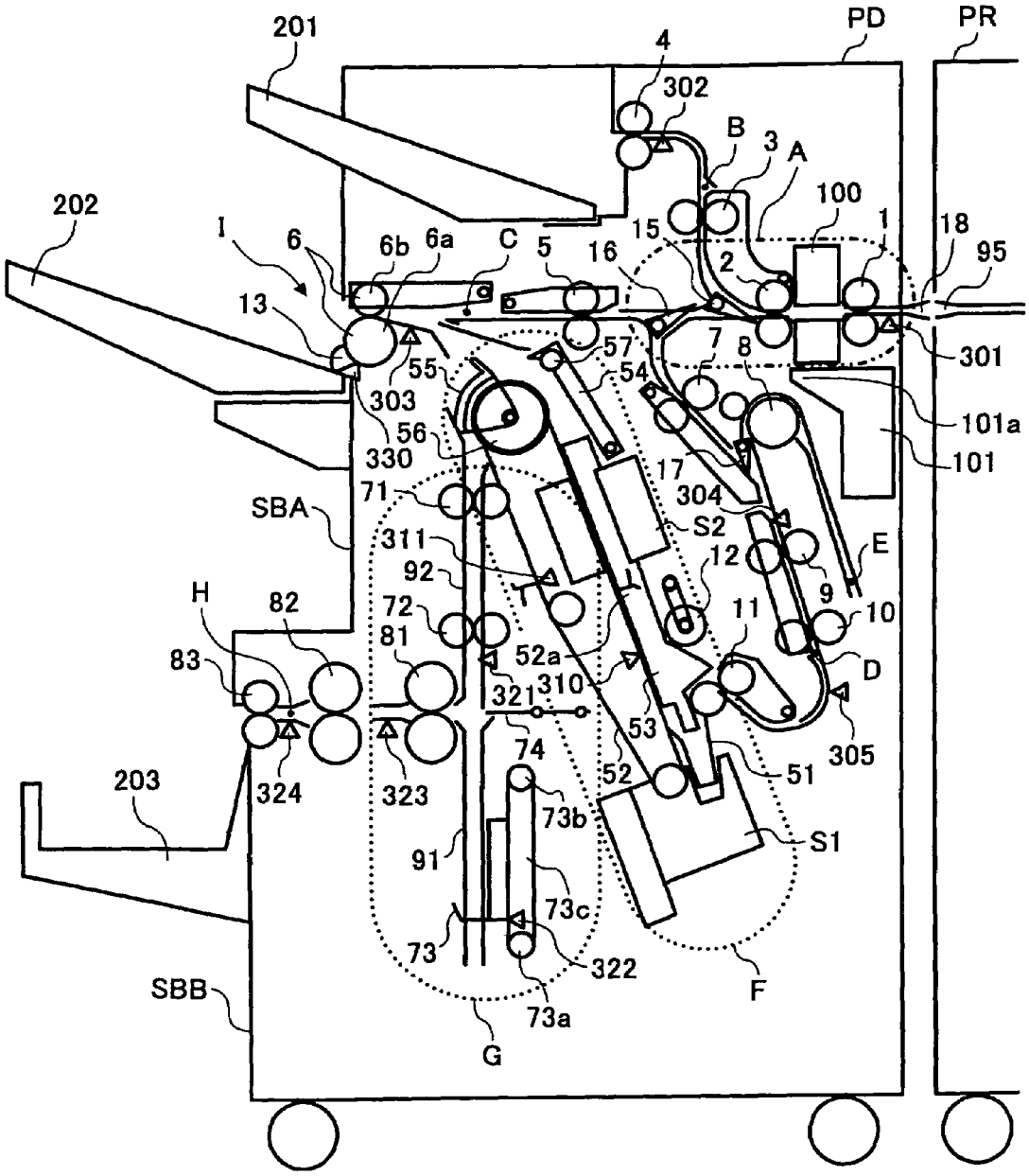
FIG. 1 is a view showing an image forming system including a sheet finisher embodying the present invention and an image forming apparatus.

Referring to FIG. 1 of the drawings, an image forming system embodying the present invention is shown and made up of an image forming apparatus PR and a sheet finisher PD operatively connected to one side of the image forming apparatus PR. A sheet or recording medium driven out of the image forming apparatus PR via an outlet 95 is introduced in the sheet finisher PD via an inlet 18. In the sheet finisher PD, a path A extends from the inlet 18 and includes finishing means for finishing a single sheet. In the illustrative embodiment, this finishing means is implemented as a punch unit or punching means 100. Path selectors 15 and 16 steer the sheet coming in through the path A to any one of a path B terminating at an upper tray 201, a path C terminating at a shift tray 202, and a processing tray F. The processing tray F is used to position, staple or otherwise process a sheet or sheets and, in this sense, will sometimes referred to as a staple tray hereinafter.

Sheets sequentially brought to the staple tray F via the paths A and D are positioned one by one, stapled or otherwise processed, and then steered by a guide plate 54 and a movable guide 55 to either one of the path C and another processing tray G. The processing tray G folds or otherwise processes the sheets and, in this sense, will sometimes be referred to as a fold tray hereinafter. The sheets folded by the fold tray G are guided to a lower tray 203 via a path H. The path D includes a path selector 17 constantly biased to a position shown in FIG. 1 by a light-load spring not shown. An arrangement is made such that after the trailing edge of a sheet has moved away from the path selector 17, among a prestack roller 8, rollers 9 and 10 and a staple outlet roller 11, at least the prestack roller 8 and roller 9 are rotated in the reverse direction to convey the trailing edge of the sheet to a prestacking portion E and cause the sheet to stay there. In this case, the sheet can be conveyed together with the next sheet superposed thereon. Such an operation may be repeated to convey two or more sheets together.

On the path A merging into the paths B, C and D, there are sequentially arranged an inlet sensor 301 responsive to a sheet coming into the finisher PD, an inlet roller pair 1, the punch unit 100 a waste hopper 101, roller pair 2, and the path selectors 15 and 16. Springs, not shown, constantly bias the path selectors 15 and 16 to the positions shown in FIG. 1. When solenoids, not shown, are energized, the path selectors 15 and 16 rotate upward and downward, respectively, to thereby steer the sheet to desired one of the paths B, C and D.

More specifically, to guide a sheet to the path B, the path selector 15 is held in the position shown in FIG. 1 while the solenoid assigned thereto is deenergized. To guide a sheet to the path C, the solenoids are energized to rotate the path selectors 15 and 16 upward and downward, respectively; Further, to guide a sheet to the path D, the path selector 16 is held in the position shown in FIG. 1 while the solenoid assigned thereto is turned off; at the same time, the solenoid assigned to the path selector 15 is turned on to rotate it upward.

In the illustrative embodiment, the finisher PD is capable of selectively effecting punching (punch unit 100), jogging and edge stapling (jogger fence 53 and edge stapler S1), sorting (shift tray 202) or folding (fold plate 74 and fold rollers 81 and 82), as desired.

The image forming apparatus PR uses a conventional electrophotographic process that forms a latent image on the charged surface of a photoconductive drum or similar image carrier with a light beam in accordance with image data, develops the latent image with toner, transfers the resulting toner image to a sheet or recording medium, and fixes the toner image on the sheet. Such a process is well known in the art and will not be described in detail. Of course, the illustrative embodiment is similarly applicable to any other image forming apparatus, e.g., an ink jet printer.

A shift tray outlet section I is located at the most downstream position of the sheet finisher PD and includes a shift outlet roller pair 6, a return roller 13, a sheet surface sensor 330, and the shift tray 202. The shift tray outlet section I additionally includes a shifting mechanism J shown in FIG. 2 and a shift tray elevating mechanism K shown in FIG. 3.

Figure 2:
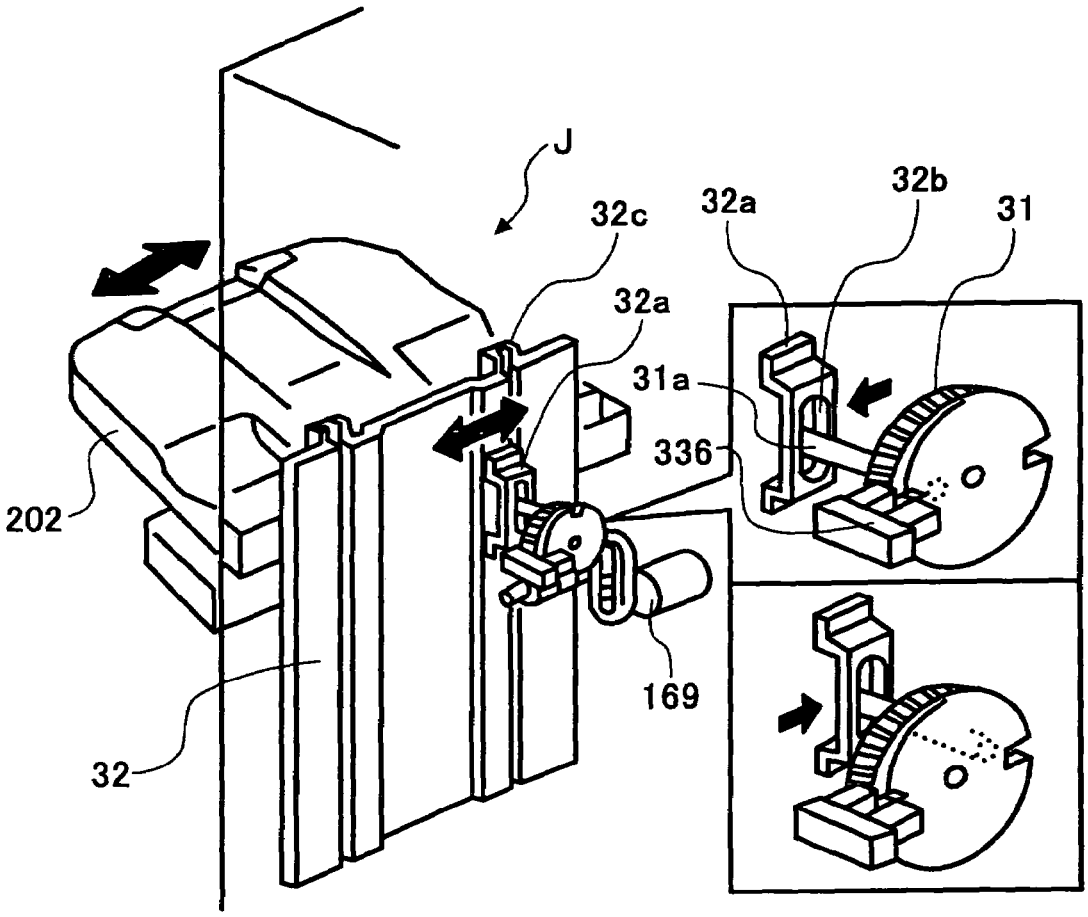
FIG. 2 is a fragmentary, enlarged isometric view showing a shifting mechanism included in the sheet finisher.
Figure 3:
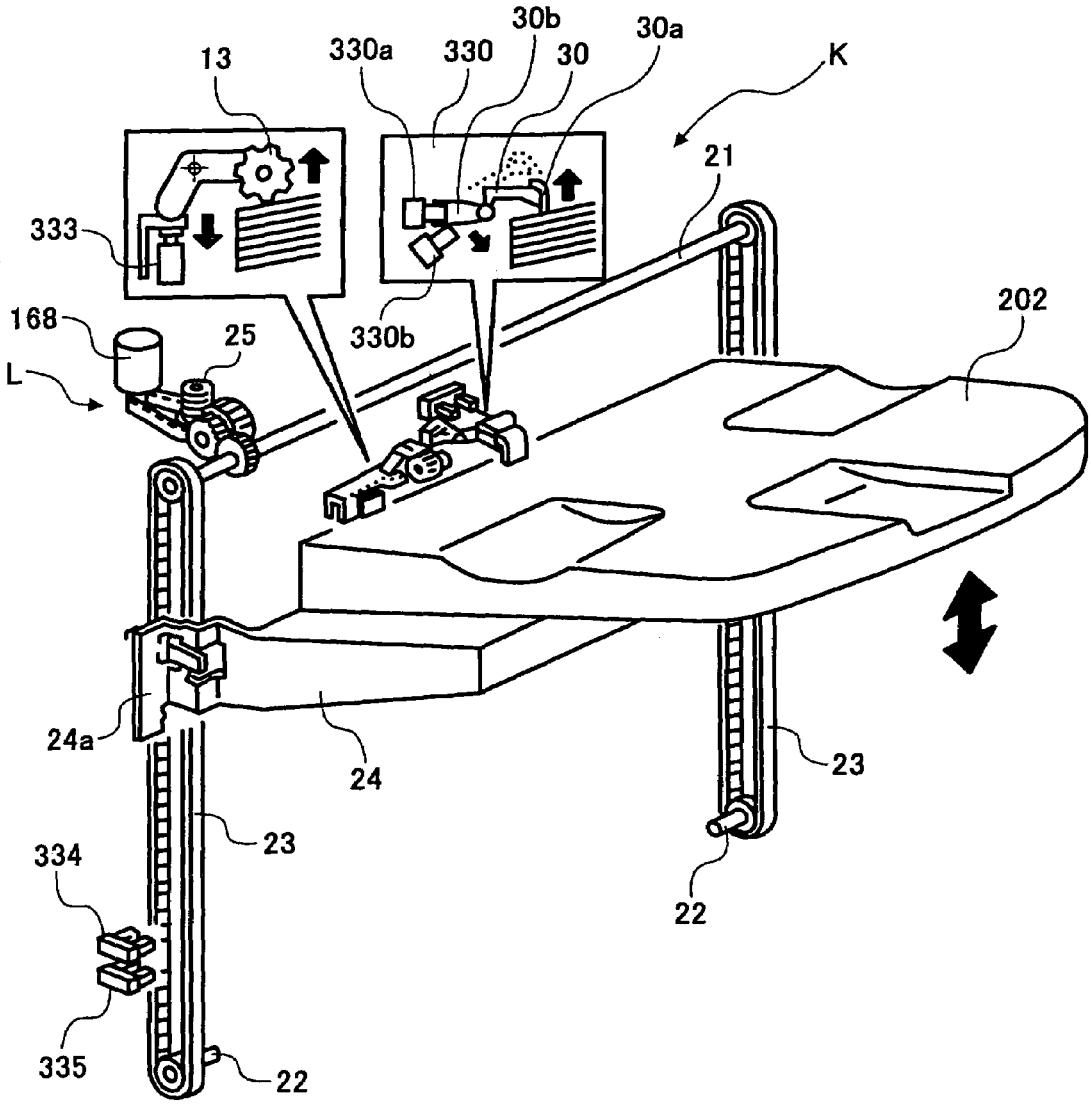
FIG. 3 is a fragmentary, enlarged isometric view showing a shift tray elevating mechanism included in the sheet finisher.

As shown in FIGS. 1 and 3, the return roller 13 contacts a sheet driven out by the shift outlet roller pair 6 and causes the trailing edge of the sheet to abut against an end fence 32 shown in FIG. 2 for thereby positioning it. The return roller 13 is formed of sponge and caused to rotate by the shift outlet roller 6. A limit switch 333 is positioned in the vicinity of the return roller 13 such that when the shift tray 202 is lifted and raises the return roller 13, the limit switch 333 turns on, causing a tray elevation motor 168 to stop rotating. This prevents the shift tray 202 from overrunning. As shown in FIG. 1, the sheet surface sensor 330 senses the surface of a sheet or that of a sheet stack driven out to the shift tray 202.

As shown in FIG. 3 specifically, the sheet surface sensor 330 is made up of a lever 30, a sensor 330*a* relating to stapling, and a sensor 330*b* relating to non-stapling 330*b*. The lever 30 is angularly movable about its shaft portion and made up of a contact end 30*a* contacting the top of the trailing edge of a sheet on the shift tray 202 and a sectorial interrupter 30*b*. The upper sensor 330*a* and lower sensor 330*b* are mainly used for staple discharge control and shift discharge control, respectively.

More specifically, in the illustrative embodiment, the sensors 330*a* and 330*b* each turn on when interrupted by the interrupter 30*b* of the lever 30. Therefore, when the shift tray 202 is lifted with the contact end 30*a* of the lever 30 moving upward, the sensor 330*a* turns off. As the shift tray 202 is further lifted, the sensor 330*b* turns off. When the outputs of the sensors 330*a* and 330*b* indicate that sheets are stacked on the shift tray 202 to a preselected height, the tray elevation motor 168 is driven to lower the shift tray 202 by a preselected amount. The top of the sheet stack on the shift tray 202 is therefore maintained at a substantially constant height.

The shift tray elevating mechanism K will be described in detail with reference to FIG. 3. As shown, the mechanism K includes a drive unit L for moving the shift tray 202 upward or downward via a drive shaft 21. Timing belts 23 are passed over the drive shaft 22 and a driven shaft 22 under tension via timing pulleys. A side plate 24 supports the shift tray 202 and is affixed to the timing belts 23. In this configuration, the entire unit including the shift tray 202 is supported by the timing belts 23 in such a manner as to be movable up and down.

The drive unit L includes a worm gear 25 in addition to the tray elevation motor 168, which is a reversible drive source. Torque output from the tray elevation motor 168 is transmitted to the last gear of a gear train mounted on the drive shaft 21 to thereby move the shift tray 202 upward or downward. The worm gear 25 included in the driveline allows the shift tray 202 to be held at a preselected position and therefore prevents it from dropping by accident.

An interrupter 24*a* is formed integrally with the side plate 24 of the shift tray 202. A full sensor 334 responsive to the full condition of the shift tray 202 and a lower limit sensor 335 responsive to the lower limit position of the shift tray 202 are positioned below the interrupter 24*a*. The full sensor 334 and lower limit sensor 335, which are implemented by photosensors, each turn off when interrupted by the interrupter 24*a*. In FIG. 3, the shift outlet roller 6 is not shown.

As shown in FIG. 2, the shifting mechanism J includes a shift motor 169 and a cam 31. When the shift motor or drive source 169 causes the cam 31 to rotate, the cam 31 causes the shift tray 202 to move back and forth in a direction perpendicular to a direction of sheet discharge. A pin 31*a* is studded on the shift cam 31 at a position spaced from the axis of the shift cam 31 by a preselected distance. The tip of the pin 31*a* is movably received in an elongate slot 32*b* formed in an engaging member 32*a*, which is affixed to the back of the end fence 32 not facing the shift tray 202. The engaging member 32*a* moves back and forth in a direction perpendicular to the direction of sheet discharge in accordance with the angular position of the pin 31*a*, entraining the shift tray 202 in the same direction. The shift tray 202 stops at a front position and a rear position in the direction perpendicular to the sheet surface of FIG. 1 (corresponding to the positions of the shift cam 31 shown in FIG. 2). A shift sensor 336 is responsive to a notch formed in the shift cam 31. To stop the shift tray at the above two positions, the shift motor 169 is selectively energized or deenergized on the basis of the output of the shift sensor 336.

Guide channels 32*c* are formed in the front surface of the end fence 32. The rear edge portions of the shift tray 202 are movably received in the guide channels 32*c*. The shift tray 202 is therefore movable up and down and movable back and forth in the direction perpendicular to the direction of sheet discharged, as needed. The end fence 32 guides the trailing edges of sheets stacked on the shift tray 202 for thereby aligning them.

Figure 4:
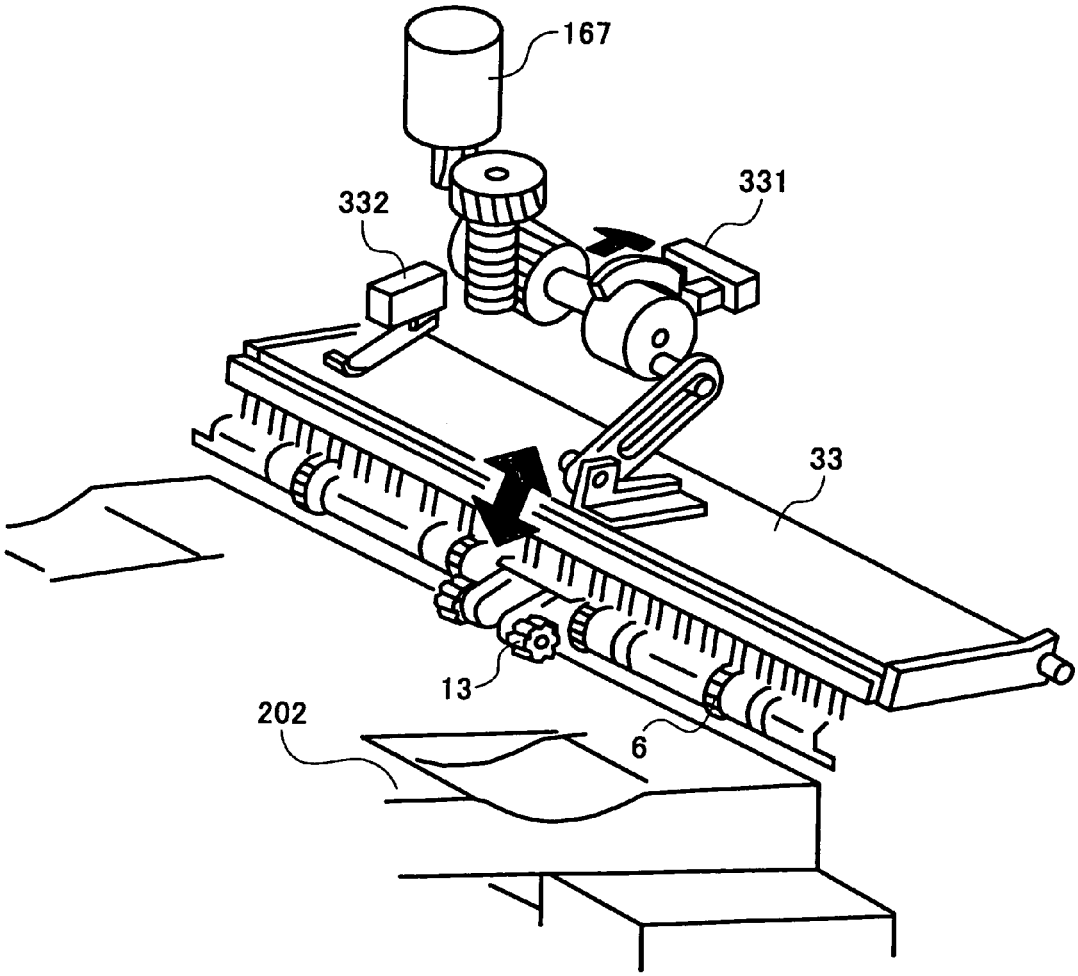
FIG. 4 is an isometric view showing part of the sheet finisher configured to discharge sheets to the shift tray.

FIG. 4 shows a specific configuration of the arrangement for discharging a sheet to the shift tray 202. As shown in FIGS. 1 and 4, the shift roller pair 6 has a drive roller 6*a* and a driven roller 6*b*. A guide plate 33 is supported at its upstream side in the direction of sheet discharge and angularly movable in the up-and-down direction. The driven roller 6*b* is supported by the guide plate 33 and contacts the drive roller 6*a* due to its own weight or by being biased, nipping a sheet between it and the drive roller 6*a*. When a stapled sheet stack is to be driven out to the shift tray 202, the guide plate 33 is lifted and then lowered at a preselected timing, which is determined on the basis of the output of a guide plate sensor 331. A guide plate motor 167 drives the guide plate 33 in such a manner in accordance with the ON/OFF state of a limit switch 332.

Figure 5:
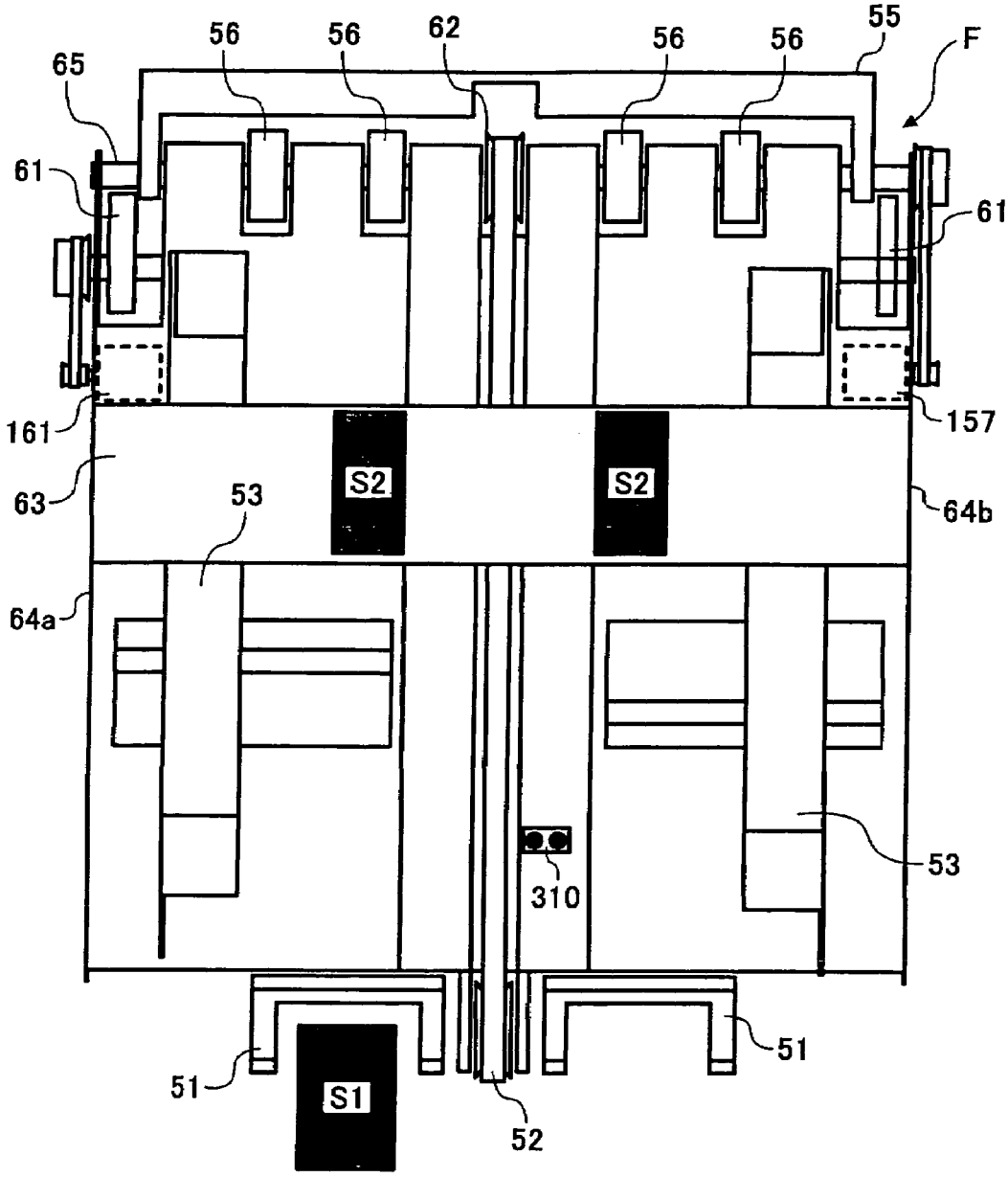
FIG. 5 is a plan view showing a staple tray included in the finisher, as seen in a direction perpendicular to a sheet conveying surface.
Figure 6:
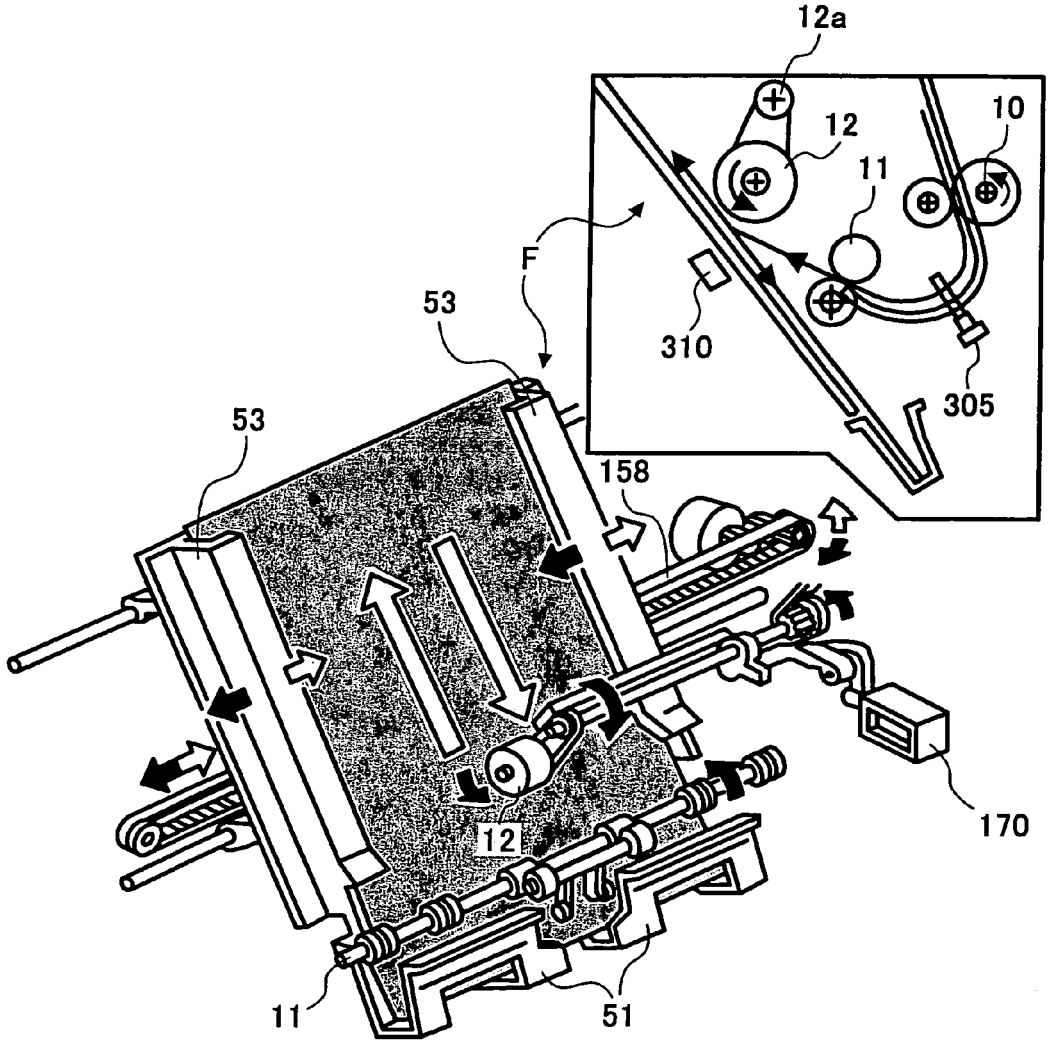
FIG. 6 is an isometric view showing the staple tray and a mechanism for driving it.
Figure 7:
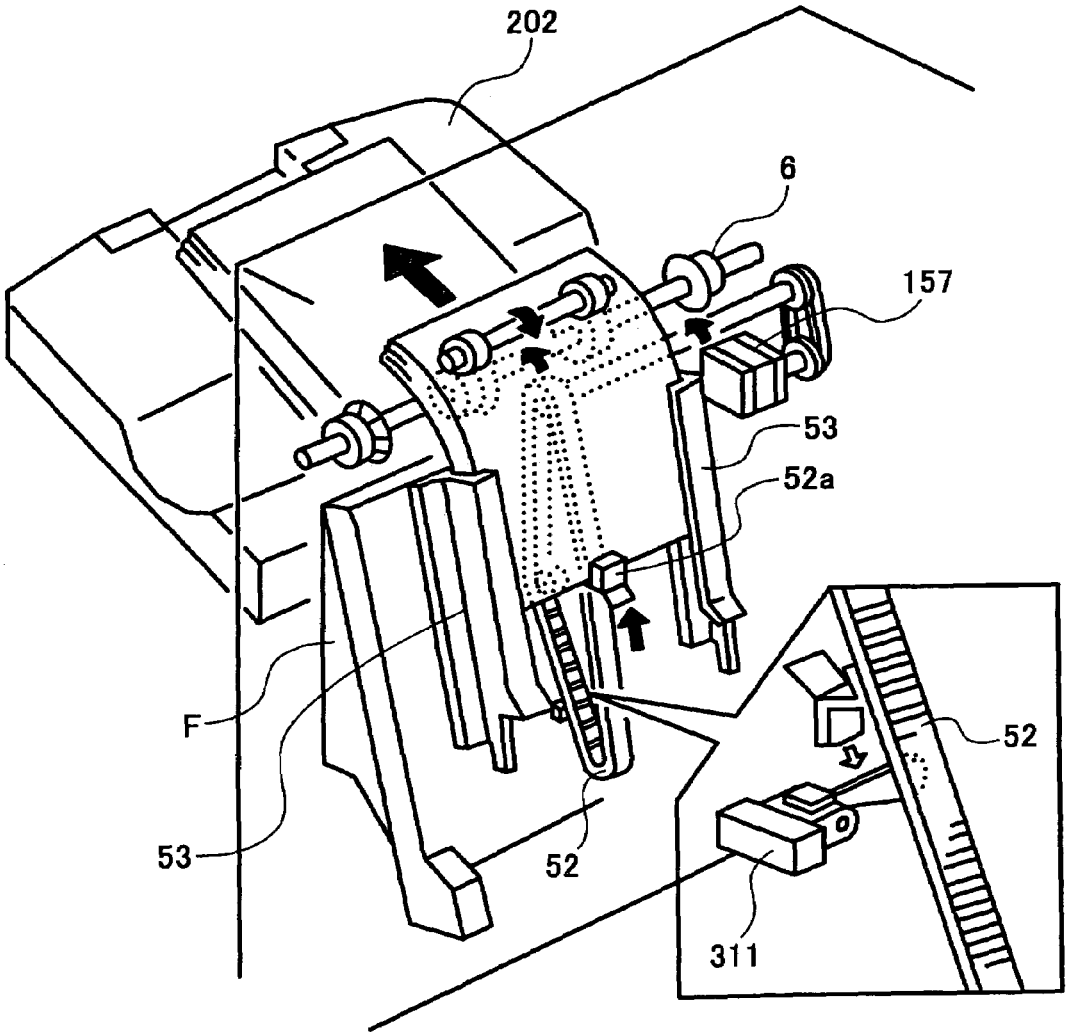
FIG. 7 is an isometric view showing a mechanism included in the sheet finisher for discharging a sheet stack;.

FIG. 5 shows the staple tray F as seen in a direction perpendicular to the sheet conveyance plane. FIG. 6 shows a drive mechanism assigned to the staple tray F while FIG. 7 shows a sheet stack discharging mechanism. As shown in FIG. 6, sheets sequentially conveyed by the staple outlet roller pair 11 to the staple tray F are sequentially stacked on the staple tray F. At this instant, a knock roller 12 knocks every sheet for positioning it in the vertical direction (direction of sheet conveyance) while jogger fences 53 position the sheet in the horizontal direction perpendicular to the sheet conveyance (sometimes referred to as a direction of sheet width). Between consecutive jobs, i.e., during an interval between the last sheet of a sheet stack and the first sheet of the next sheet stack, a controller 350 (see FIG. 17) outputs a staple signal for causing an edge stapler S1 to perform a stapling operation. A discharge belt 52 with a hook 52*a* immediately conveys the stapled sheet stack to the shift outlet roller pair 6, so that the shift outlet roller pair 6 conveys the sheet stack to the shift tray 202 held at a receiving position.

As shown in FIG. 7, a belt HP (Home Position) sensor 311 senses the hook 52*a* of the discharge belt 52 brought to its home position. More specifically, two hooks 52*a* and 52*a*' are positioned on the discharge belt 52 face-to-face at spaced locations in the circumferential direction and alternately convey sheet stacks stapled on the staple tray F one after another. The discharge belt 52 may be moved in the reverse direction such that one hook 52*a* held in a stand-by position and the back of the other hook 52*a*' position the leading edge of the sheet stack stored in the staple tray F in the direction of sheet conveyance, as needed. The hook 52*a* therefore plays the role of positioning means at the same time.

As shown in FIG. 5, a discharge motor 157 causes the discharge belt 52 to move via a discharge shaft 65. The discharge belt 52 and a drive pulley 62 therefor are positioned at the center of the discharge shaft 65 in the direction of sheet width. Discharge rollers 56 are mounted on the discharge shaft 65 in a symmetrical arrangement. The discharge rollers 56 rotate at a higher peripheral speed than the discharge belt 52.

More specifically, torque output from the discharge motor 157 is transferred to the discharge belt 52 via a timing belt and the timing pulley 62. The timing pulley (drive pulley) 62 and discharge rollers 56 are mounted on the same shaft, i.e., the discharge shaft 65. An arrangement may be made such that when the relation in speed between the discharge rollers 56 and the discharge belt 52 should be varied, the discharge rollers 56 are freely rotatable on the discharge shaft 65 and driven by part of the output torque of the discharge motor 157. This kind of scheme allows a desired reduction ratio to be set up.

The surface of the discharge roller 56 is formed of rubber or similar high-friction material. The discharge roller 56 nips a sheet stack between it and a press roller or driven roller 57 due to the weight of the driven roller 57 or a bias, thereby conveying the sheet stack.

A processing mechanism will be described hereinafter. As shown in FIG. 6, a solenoid 170 causes the knock roller 12 to move about a fulcrum 12*a* in a pendulum fashion, so that the knock roller 12 intermittently acts on sheets sequentially driven to the staple tray F and causes their trailing edges to abut against rear fences 51. The knock roller 12 rotates counterclockwise about its axis. A jogger motor 158 drives the jogger fences 53 via a timing belt and causes them to move back and forth in the direction of sheet width.

Figure 8:
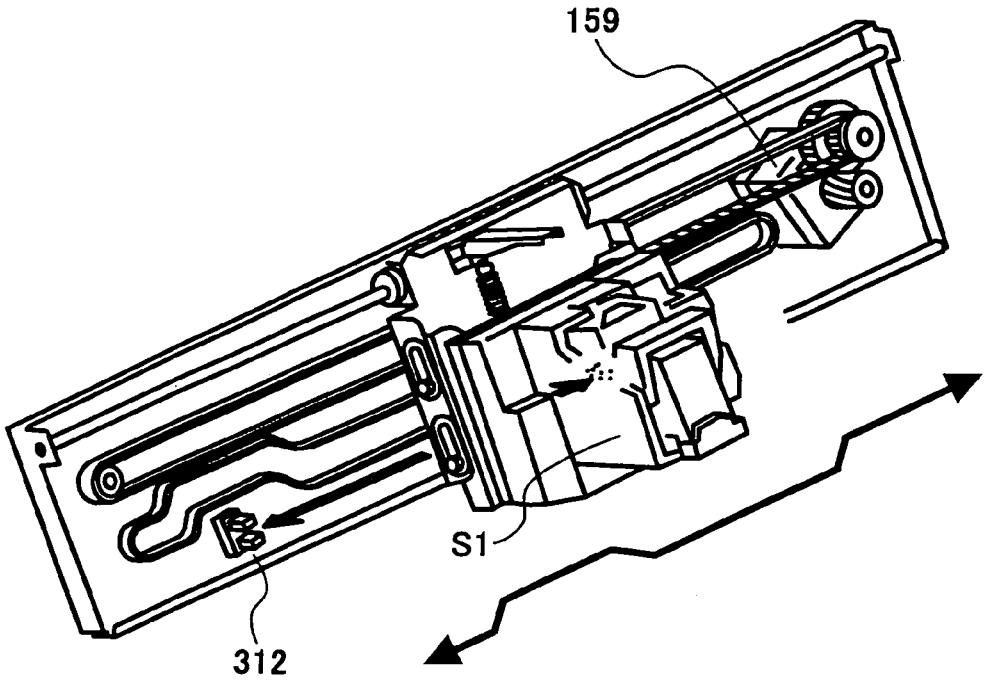
FIG. 8 is an isometric view showing an edge stapler included in the sheet finisher together with a mechanism for moving it.

As shown in FIG. 8, a mechanism for moving the edge stapler S1 includes a reversible, stapler motor 159 for driving the edge stapler S via a timing belt. The edge stapler S is movable in the direction of sheet width in order to staple a sheet stack at a desired edge position. A stapler HP sensor 312 is positioned at one end of the movable range of the edge stapler S1 in order to sense the stapler S brought to its home position. The stapling position in the direction of sheet width is controlled in terms of the displacement of the edge stapler S1 from the home position.

Figure 9:
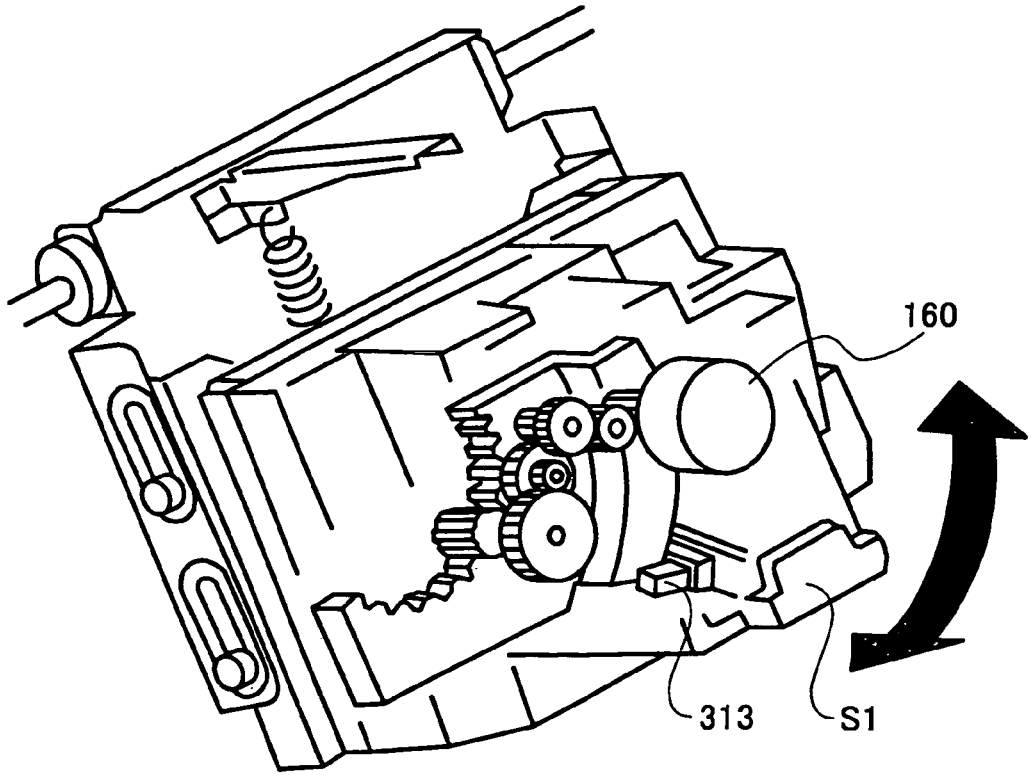
FIG. 9 is an isometric view showing a mechanism for rotating the edge stapler.

As shown in FIG. 9, the edge stapler S1 is capable of selectively driving a staple into a sheet stack in parallel to or obliquely relative to the edge of the sheet stack. Further, at the home position, only the stapling mechanism portion of the edge stapler S1 is rotatable by a preselected angle for the replacement of staples. For this purpose, an oblique motor 160 causes the above mechanism of the edge stapler S1 to rotate until a sensor 313 senses the mechanism reached a preselected replacement position. After oblique stapling or the replacement of staples, the oblique motor 160 causes the stapling mechanism portion to return to its original angular position.

As shown in FIGS. 1 and 5, a pair of center staplers S2 are affixed to a stay 63 and are located at a position where the distance between the rear fences 51 and their stapling positions is equal to or greater than one-half of the length of the maximum sheet size, as measured in the direction of conveyance, that can be stapled. The center staplers S2 are symmetrical to each other with respect to the center in the direction of sheet width. The center staplers S2 themselves are conventional and will not be described specifically. Briefly, after a sheet stack has been fully positioned by the jogger fences 53, rear fences 51 and knock roller 5 the discharge belt 52 lifts the trailing edge of the sheet stack with its hook 52 to a position where the center of the sheet stack in the direction of sheet conveyance coincides with the stapling positions of the center staplers S2. The center staplers S2 are then driven to staple the sheet stack. The stapled sheet stack is conveyed to the fold tray G and folded at the center, as will be described in detail later.

There are also shown in FIG. 5 a front side wall 64*a*, a rear side wall 64*b*, and a sensor responsive to the presence/absence of a sheet stack on the staple tray F.

Figure 15:
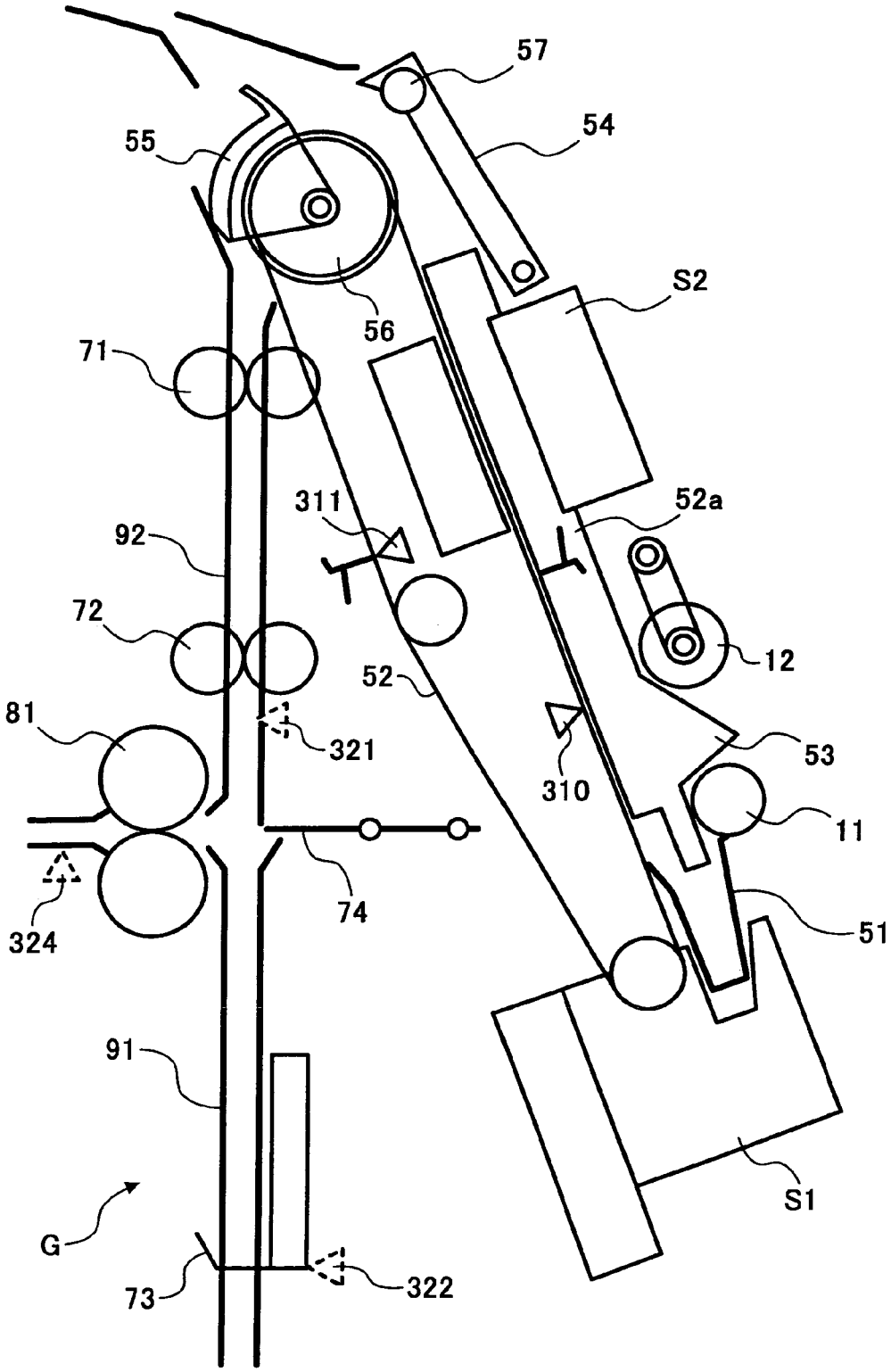
FIG. 15 shows the staple tray and fold tray in detail.

Reference will be made to FIG. 15 as well as to FIG. 1 for describing a mechanism for steering a sheet stack. To allow the sheet stack stapled by the center staplers S2 to be folded at the center on the fold tray G, sheet stack steering means is located at the most downstream side of the staple tray F in the direction of sheet conveyance in order to steer the stapled sheet stack toward the fold tray G.

Figure 10:
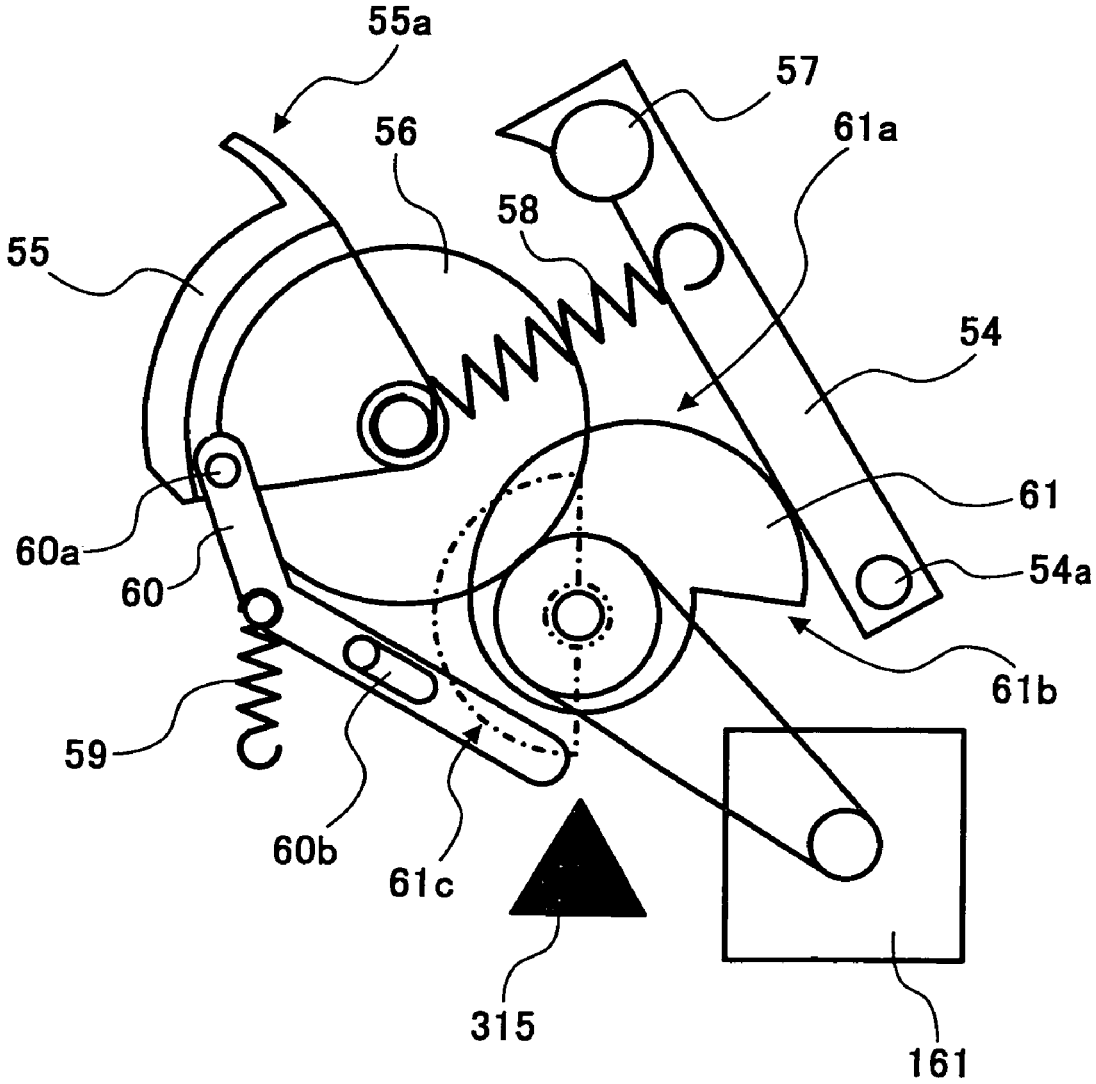
FIGS. 10 through 12 are views demonstrating the consecutive operating conditions of a sheet stack steering mechanism included in the sheet finisher.
Figure 11:
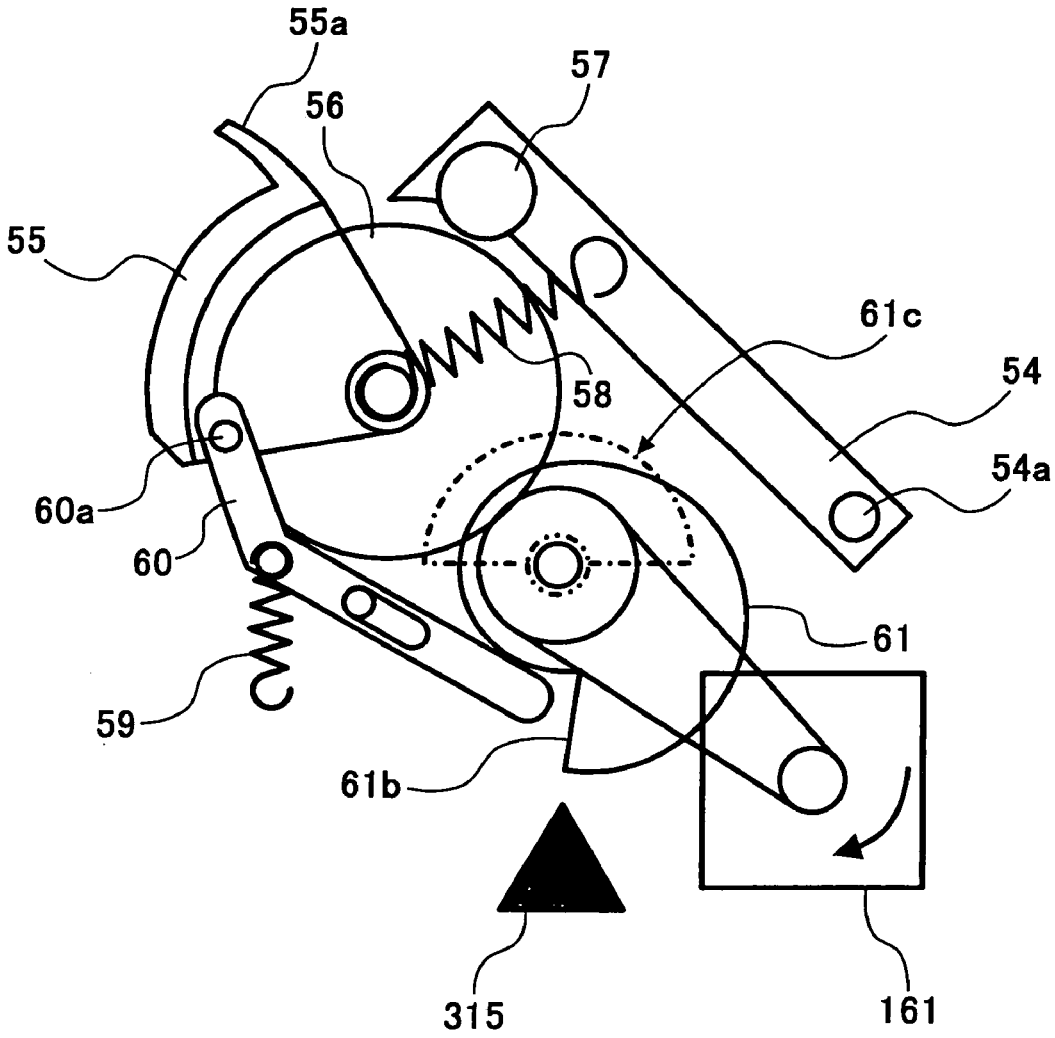
Figure 12:
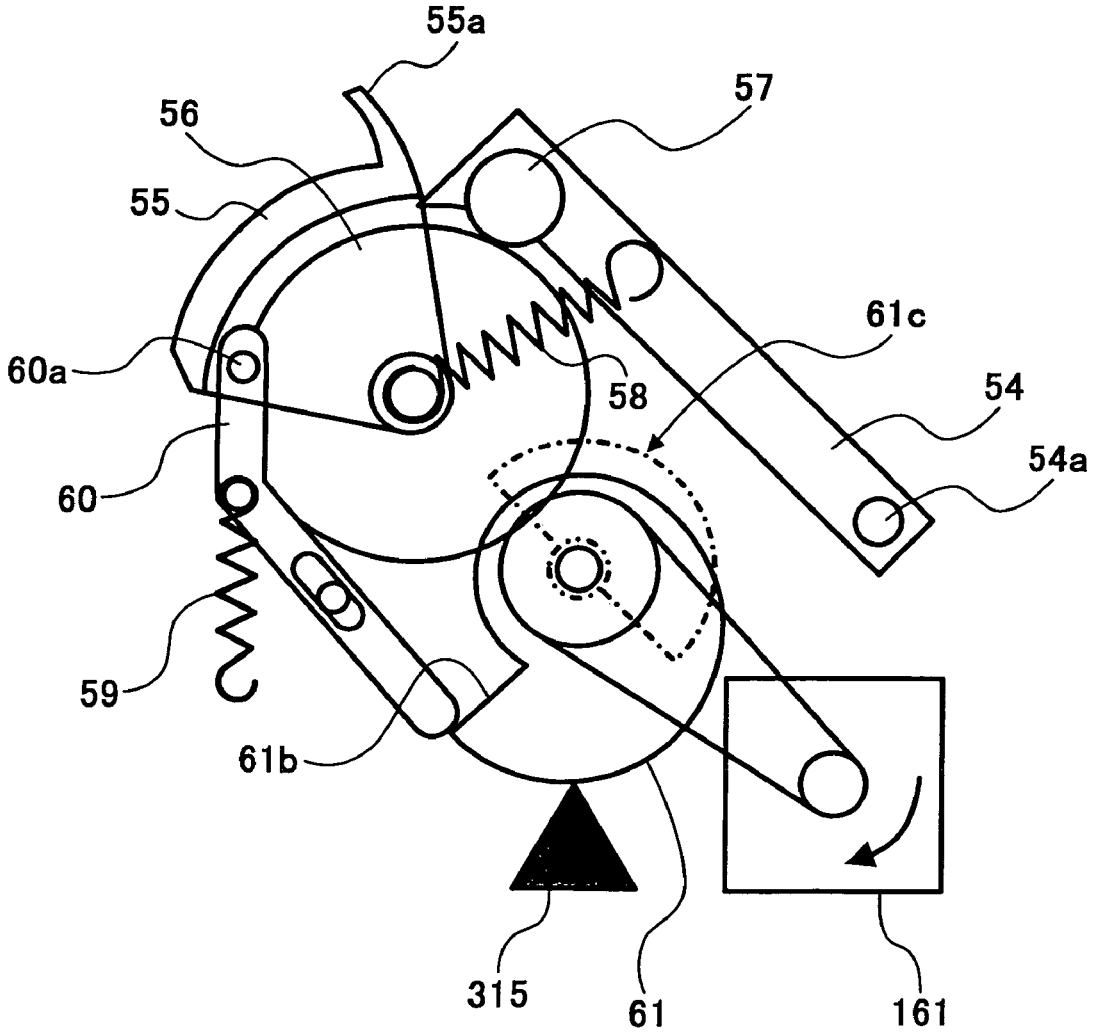

As shown in FIG. 15, the steering mechanism includes the guide plate 54 and movable guide 55 mentioned earlier. As shown in FIGS. 10 through 12, the guide plate 54 is angularly movable about a fulcrum 54*a* in the up-and-down direction and supports the press roller 57, which is freely rotatable, on its downstream end. A spring 58 constantly biases the guide plate 54 toward the discharge roller 56. The guide plate 54 is held in contact with the cam surface 61*a* of a cam 61, which is driven by a steer motor 161.

The movable guide 55 is angularly movably mounted on the shaft of the discharge roller 56. A link arm 60 is connected to one end of the movable guide 55 remote form the guide plate 54 at a joint 60*a*. A pin studded on the front side wall 64*a*, FIG. 5, is movably received in an elongate slot 60*b* formed in the link arm 60, limiting the movable range of the movable guide 55. A spring 59 holds the link arm 60 in the position shown in FIG. 10. When 6 the steer motor 161 causes the cam 61 to rotate to a position where its cam surface 61*b* presses the link arm 60, the movable guide 55 connected to the link arm 60 angularly moves upward along the surface of the discharge roller 56. A guide HP sensor 315 senses the home position of the cam 61 on sensing the interrupter portion 61*c* of the cam 61. Therefore, the stop position of the cam 61 is controlled on the basis of the number of drive pulses input to the steer motor 161 counted from the home position of the cam 61, as will be described later in detail.

FIG. 10 shows a positional relation to hold between the guide plate 54 and the movable guide 55 when the cam 61 is held at its home position. As shown, the guide surface 55*a* of the movable guide 55 is curved and spaced from the surface of the discharge roller 56 by a preselected distance. While part of the guide plate 55 downstream of the press roller 57 in the direction of sheet conveyance is curved complementarily to the surface of the discharge roller 56, the other part upstream of the same is flat in order to guide a sheet stack toward the shift outlet roller 6. In this condition, the mechanism is ready to convey a sheet stack to the path C. More specifically, the movable guide 55 is sufficiently retracted from the route along which a sheet stack is to be conveyed from the staple tray F to the path C. Also, the guide plate 54 is sufficiently retracted from the surface of the discharge roller 56. The guide plate 54 and movable guide 55 therefore open the above route sufficiently wide; the opening width is generally dependent on the stapling ability of the edge stapler S1 and usually corresponds to the thickness of fifty ordinary sheets or less.

When the leading edge of a sheet stack steered by the guide plate 54 contacts the guide surface 55*a* of the movable guide 55, the guide surface 55*a* causes the leading edge to make a hairpin turn with a small diameter R. When the cam 61 is in the home position, the movable guide 55 abuts against a plate, not shown, and biased by the spring 59 in the counterclockwise direction.

FIG. 11 shows a condition wherein the guide plate 54 is moved about the fulcrum 54*a* counterclockwise (downward) by the cam 61 with the press roller 57 pressing the discharge roller 57. As shown, when the cam 61 rotates clockwise, it causes the guide plate 54 to move from the opening position to the pressing position along the cam surface 61*a* of the cam 61. As the cam 61 further rotates clockwise, its cam surface 61*b* raises the link arm 60 and thereby causes the movable guide 55 to move.

FIG. 12 shows a condition wherein the cam 61 has further rotated from the above position to move the movable guide 55 clockwise (upward). In this condition, the guide plate 54 and movable guide 55 form the route extending from the staple tray F toward the fold tray G. FIG. 5 shows the same relation as seen in the direction of depth.

In the condition shown in FIG. 10, a sheet stack positioned and stapled on the staple tray F can be delivered to the shift tray 202 while, in the condition shown in FIG. 12, the sheet stack can be delivered to the fold tray G. The guide surface 55*a* of the movable guide 55 can block the space in which the guide 55 is movable, allowing a sheet stack to be smoothly delivered to the fold tray G. In this manner, the guide plate and movable plate 55 are sequentially moved in this order while overlapping each other, forming a smooth path for conveyance.

In the condition shown in FIG. 12, the guide plate 54 contacts the discharge roller 56 obliquely relative to the direction of sheet conveyance, compared to the condition shown in FIG. 10. The guide plate 54 therefore guides the leading edge of the sheet stack toward the press roller 57 while restricting it in a wedge fashion. Although a sheet stack to be delivered to the fold tray G has been stapled at the center with the leading edge remaining free, such a sheet stack is restricted, as stated above, and pressed by the press roller 57 and then introduced in the gap between the movable guide 55 and discharge roller 66. The leading edge of the sheet stack can therefore enter the above gap without becoming loose. The movable guide 55 steers, or turns, the sheet stack toward the fold tray G. It follows that the angle of conveyance can be freely selected in terms of the angle θ of the movable guide 55, i.e., the circumferential length of the movable guide 55. However, the maximum angle of conveyance is limited to 180° in relation to the other mechanisms.

Although the path selectors 15 and 16 shown in FIG. 1 are capable of switching the conveyance path, they do not exert a conveying force themselves. Therefore, when the selector 15 or 16 steers a stack of several sheets or several ten sheets by a large angle, the sheet stack is apt to jam the path due to a difference in friction between the outer surface and the inner surface.

While in the illustrative embodiment the guide plate 54 and movable guide 55 share a single drive motor, each of them may be driven by a respective drive motor, so that the timing of movement and stop position can be controlled in accordance with the sheet size and the number of sheets stapled together.

The fold tray G will be described specifically with reference to FIGS. 13 and 14. As shown, the fold tray G includes a fold plate 74 for folding a sheet stack at the center. The fold plate 74 is formed with elongate slots 74*a* each being movably received in one of pins 64*c* studded on each of the front and rear side walls 64*a* and 64*b*. A pin 74*b* studded on the fold plate 74 is movably received in an elongate slot 76*b* formed in a link arm 76. The link arm 76 is angularly movable about a fulcrum 76*a*, causing the fold plate 74 to move in the right-and-left direction as viewed in FIGS. 13 and 14. More specifically, a pin 75*b* studded on a fold plate cam 75 is movably received in an elongate slot 76*c* formed in the link arm 76. In this condition, the link arm 76 angularly moves in accordance with the rotation of the fold plate cam 75, causing the fold plate 74 to move back and forth perpendicularly to a lower guide plate 91 and an upper guide plate 92 (see FIG. 15).

Figure 13:
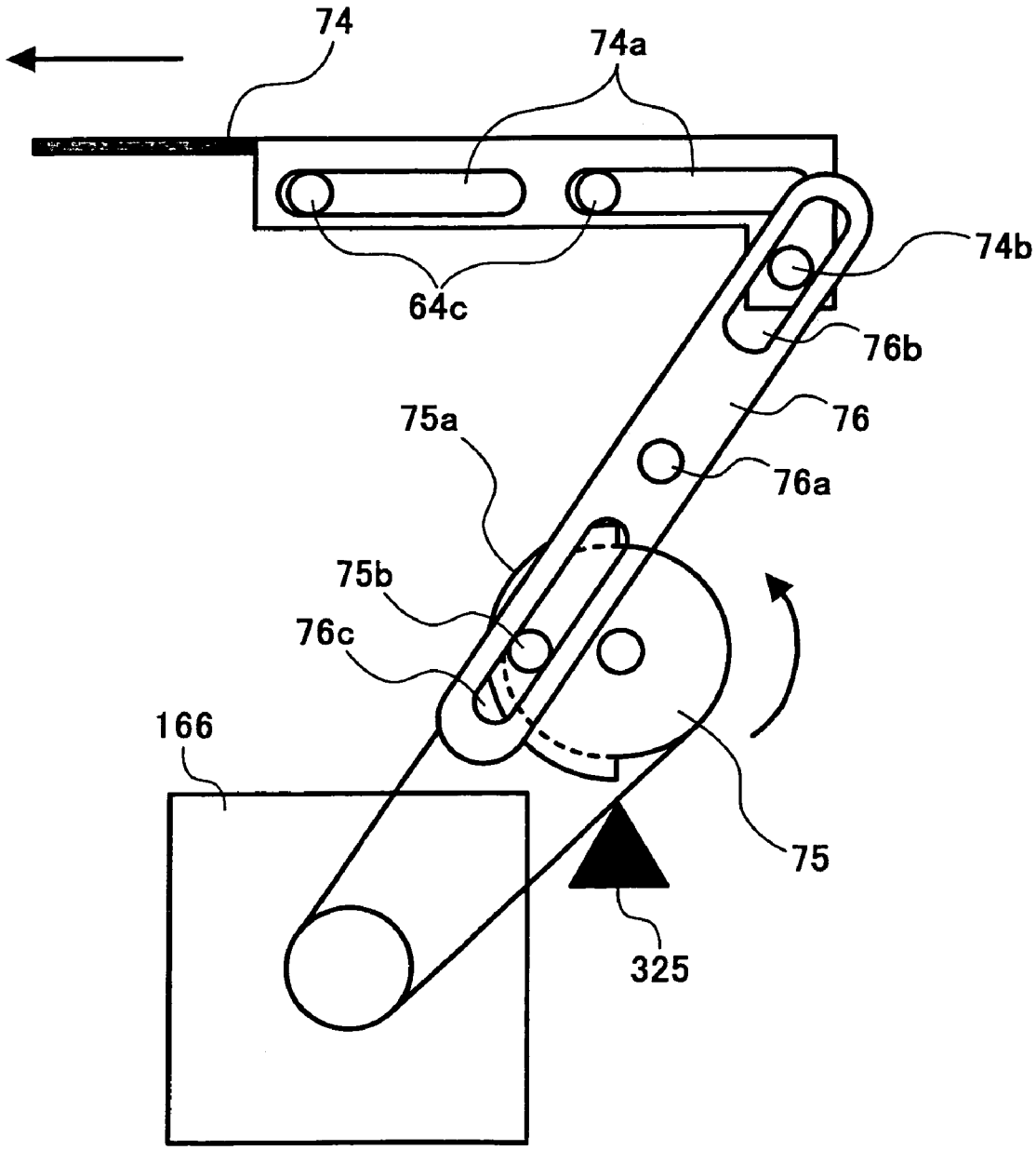
FIGS. 13 and 14 are views demonstrating the consecutive operating conditions of a fold plate included in the sheet finisher.
Figure 14:
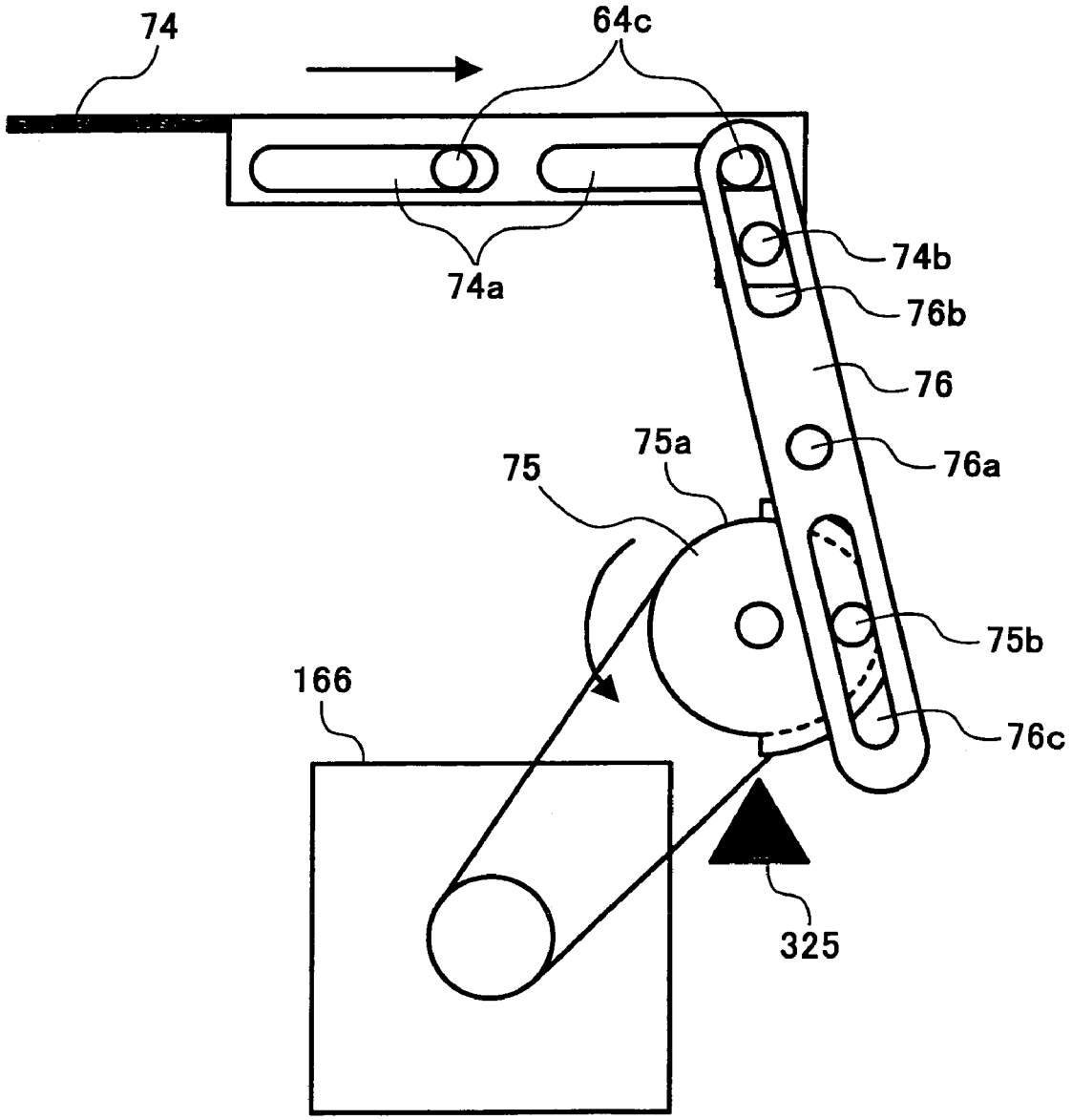

A fold plate motor 166 causes the fold plate cam 75 to rotate in a direction indicated by an arrow in FIG. 13. The stop position of the fold plate cam 75 is determined on the basis of the output of a fold plate HP sensor 325 responsive to the opposite ends of a semicircular interrupter portion 75*a* included in the cam 75.

FIG. 13 shows the fold plate 74 in the home position where the fold plate 74 is fully retracted from the sheet stack storing range of the fold tray G. When the fold plate cam 75 is rotated in the direction indicated by the arrow, the fold plate 74 is moved in the direction indicated by an arrow and enters the sheet stack storing range of the fold tray G. FIG. 14 shows a position where the fold plate 74 pushes the center of a sheet stack on the fold tray G into the nip between a pair of fold rollers 81. When the fold plate cam 75 is rotated in a direction indicated by an arrow in FIG. 14, the fold plate 74 moves in a direction indicated by an arrow out of the sheet stack storing range.

While the illustrative embodiment is assumed to fold a sheet stack at the center, it is capable of folding even a single sheet at the center. In such a case, because a single sheet does not have to be stapled at the center, it is fed to the fold tray G as soon as it is driven out, folded by the fold plate 74 and fold roller pair 81, and then delivered to the lower tray 203, FIG. 1.

Figure 16:
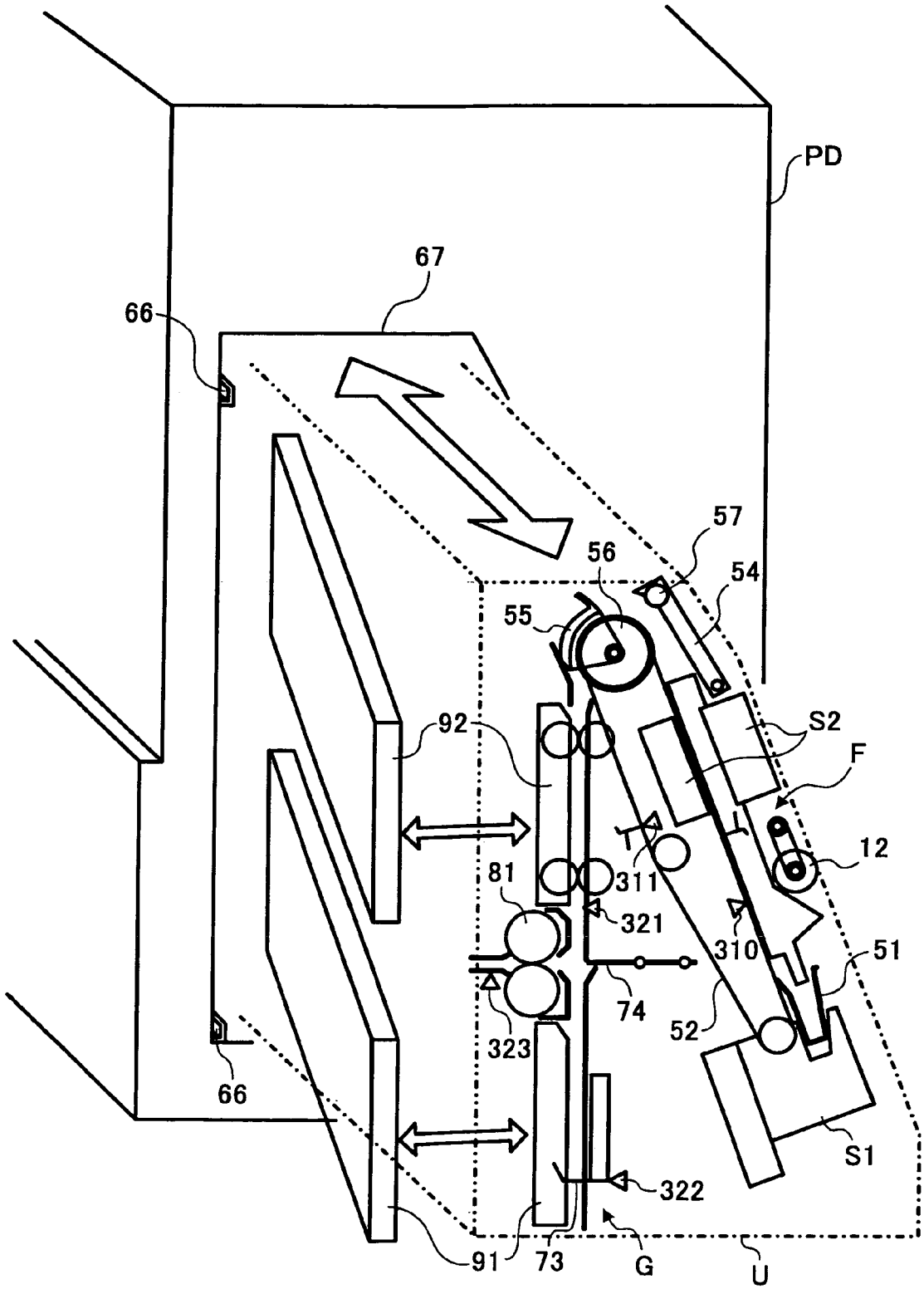
FIG. 16 shows a mechanism supporting the staple tray and fold tray constructed into a unit.

FIG. 16 shows a specific arrangement supporting the staple tray F and processing tray G, FIG. 15, such that they can be pulled out together to facilitate jam processing, maintenance or replacement. As shown, the fold tray G extends perpendicularly from a bent portion, which is the arc of the discharge roller 56, while the staple tray F obliquely extends from the bent portion with an acute angle. While FIG. 16 shows only the end face of the staple tray F and that of the fold tray G, the trays F and G are accommodated in the direction of depth at least in the width of the tray F shown in FIG. 5.

The angle of the staple tray F should preferably be as small as possible in order to reduce the projection area in the vertical direction and therefore the area to be occupied by the sheet finisher PD. However, in the illustrative embodiment, the fold plate 74, link arm 76, fold plate cam 75 and fold plate motor 166 constituting the folding mechanism of FIGS. 13 and 14 are arranged in the space between the fold tray G (guide plates 91 and 92) and the staple tray F. More specifically, the folding mechanism is interposed between the edge stapler S1 and the center staplers S2. The angle of the staple tray F relative to the fold tray G is selected such that none of the structural parts of the folding mechanisms interferes with any one of the structural parts of the staple tray F. The folding mechanism is positioned below the staple tray F so inclined. This arrangement allows the staple tray F, fold tray C and folding means to be arranged within the minimum vertical projection area.

To fold a sheet stack at the center, the center of the sheet stack should be coincident with a folding position assigned to the fold plate 74, as will be described specifically later. For this purpose, in the illustrative embodiment, a movable rear fence 73 is included in the lower guide plate 91 such that the trailing edge of a folded sheet stack (leading edge when the sheet stack is to be conveyed) rests on the fence 73. The movable rear fence 73 is movable upward or downward to bring the center of the sheet stack resting thereon to the folding position.

As shown in FIG. 1, the movable rear fence 73 is affixed to a drive belt 73*c* passed over a drive pulley 73*a* and a driven pulley 73*b* and caused to move upward or downward by a rear fence motor not shown. Such a mechanism for moving the movable rear fence 73, like the folding mechanism, is arranged in the space between the staple tray F and the fold tray G so as not to increase the vertical projection area.

As shown in FIG. 16, a unit U including the staple tray F and fold tray G, which have the relation stated above, is supported by a pair of guide rails 66 extending inward from an opening 67 formed in the finisher PD and can be pulled out of the finisher PD along the guide rails 66. The guide plates 91 and 92 are hinged to the rear end of the unit U with their front ends being openable away from each other. A magnet, for example., may used to lock the openable ends of the guide plates 91 and 92.

The unit U having the above configuration can be pulled out in the event of a jam and allows a jamming sheet to be easily removed. More specifically, when a jam occurs at the fold tray G side, the operator should only pull out the unit U halfway and can rapidly deal with the jam while watching the guide plates 91 and 92 opened away from each other. After the jam processing, when the operator pushes the unit U into the finisher PD, the guide plates 91 and 92 are automatically closed by the edges of the opening 67 and locked by the magnet. This obviates an occurrence that the operator fails to close the guide plates 91 and 92 and makes the next step impracticable.

While the guide rails 66 are positioned at the fold tray G side of the opening 67, they may, of course, be located at any other position, e.g., a position above the guide plates 91 and 92.

In the illustrative embodiment, the staple tray F is inclined by a large angle in relation to the fold tray G and folding mechanism, i.e., positioned obliquely at as small an angle as possible relative to the fold tray G, as stated earlier. In this arrangement, the fold tray G is positioned below the staple tray F, so that the space above the staple tray F is questionable in the aspect of efficient use of space. In light of this, in the illustrative embodiment, the path D and prestacking portion E are positioned in parallel to the staple tray F while a waste receiver 101*a* included in the waste unit 101 is held in an inclined position in the space available in the upper right portion, as seen in FIG. 1. This promotes the efficient use of the limited space available in the finisher PD.

In the above configuration, if the sheet size is large, then a sheet stored in the prestacking portion E waits for the next sheet with its trailing edge in the direction of sheet conveyance protruding from the portion E. At this instant, because the sheet prestacking portion E is positioned in the upper right portion of the finisher PD, a sufficient space is available below the portion E and prevents the sheet from jamming the path.

Further, the folding mechanism of the fold tray G is located between the edge stapler S1 and the center staplers S2, so that a sufficient space is available below the fold plate 74 even when the sheet size is large. Therefore, a sufficient space is guaranteed below the leading edge of a sheet despite that the sheet is conveyed vertically along the guide plates 91 and 92.

Figure 17:
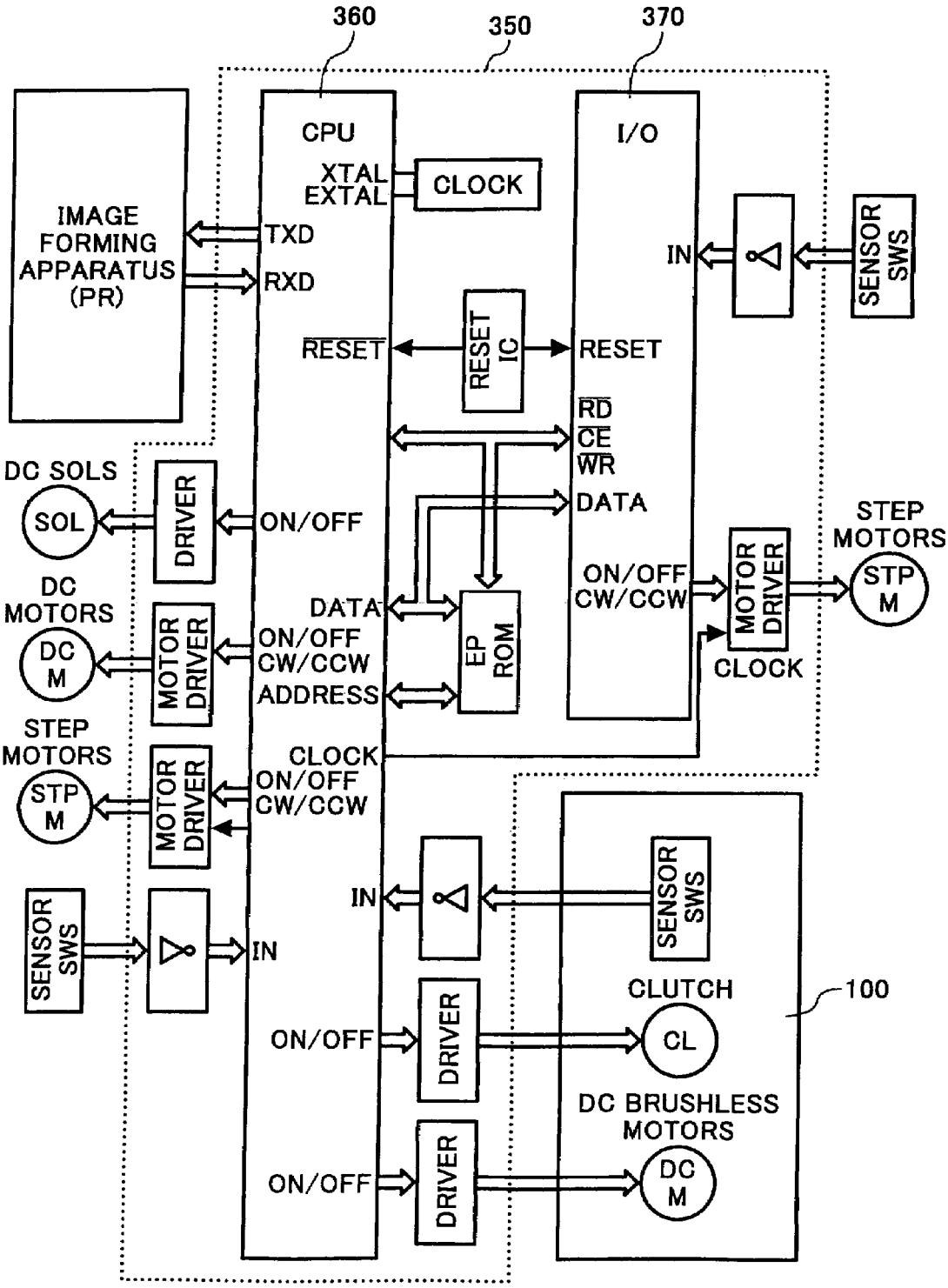
FIG. 17 is a schematic block diagram showing a control system included in the image forming system, particularly control circuitry assigned to the sheet finisher.

Reference will be made to FIG. 17 for describing a control system included in the illustrative embodiment. As shown, the control system includes a control unit 350 implemented as a microcomputer including a CPU (Central Processing Unit) 360 and an I/O (Input/Output) interface 370. The outputs of various switches arranged on a control panel, not shown, mounted on the image forming apparatus PR are input to the control unit 350 via the I/O interface 370. Also input to the control unit 350 via the I/O interface 370 are the output of the inlet sensor 301, the output of an upper outlet sensor 302, the output of a shift outlet sensor 303, the output of a prestack sensor 304, the output of a staple discharge sensor 305, the output of a sheet sensor 310, the output of the belt HP sensor 311, the output of the staple HP sensor 312, the output of the stapler oblique HP sensor 313, the output of a jogger fence HP sensor 314, the output of the guide home position sensor 315, the output of a stack arrival sensor 321, the output of a movable rear fence HP sensor 322, the output of a fold position pass sensor 323, the output of a lower outlet sensor 324, the output of a fold plate HP sensor 325, the output of sheet surface sensors 330, 330*a* and 330*b*, and the output of the guide plate sensor 331.

The CPU 360 controls, based on the above various inputs, the tray motor 168 assigned to the shift tray 202, the guide plate motor 167 assigned to the guide plate, the shift motor 169 assigned to the shift tray 202, a knock roller motor, not shown, assigned to the knock roller 12, various solenoids including the knock solenoid (SOL) 170, motors for driving the conveyor rollers, outlet motors for driving the outlet rollers, the discharge motor 157 assigned to the belt 52, the stapler motor 159 assigned to the edge stapler S1, the jogger motor. 158 assigned to the jogger fences 53, the steer motor 161 assigned to the guide plate 54 and movable guide 55, a motor, not shown, assigned to rollers for conveying a sheet stack, a rear fence motor assigned to the movable rear fence 73, and a fold roller motor, not shown, assigned to the fold roller 81. The pulse signals of a staple conveyance motor, not shown, assigned to the staple discharge rollers are input to the CPU 360 and counted thereby. The CPU 360 controls the knock SOL 170 and jogger motor 158 in accordance with the number of pulse signals counted.

Further, the CPU 360 causes the punch unit 100 to operate by controlling a clutch or a motor. The CPU 360 controls the finisher FD in accordance with a program stored in a ROM (Read Only Memory), not shown, by using a RAM (Random Access. Memory) as a work area.

Specific operations to be executed by the CPU 360 in various modes available with the illustrative embodiment will be described hereinafter.

Figure 18:
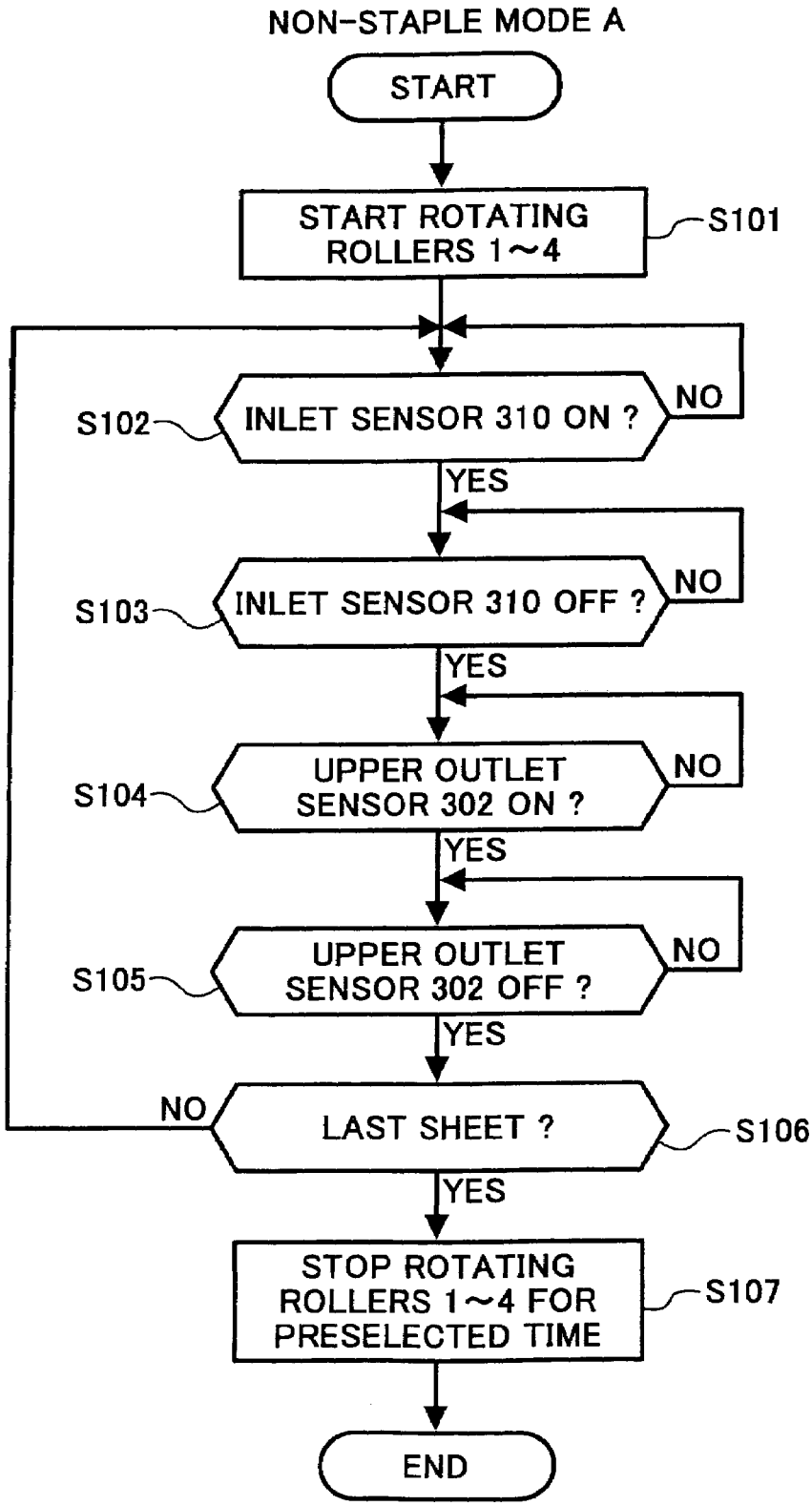
FIG. 18 is a flowchart demonstrating a non-staple mode A available with the sheet finisher.

First, in a non-staple mode A, a sheet is conveyed via the paths A and B to the upper tray 201 without being stapled. To implement this mode, the path selector 15 is moved clockwise, as viewed in FIG. 1, to unblock the path B. The operation of the CPU 360 in the non-staple mode will be described with reference to FIG. 18.

As shown, before a sheet driven out of the image forming apparatus PR enters the finisher PD, CPU 360 causes the inlet roller pair 1 and conveyor roller pair 2 on the path A to start rotating (step S101). The CPU 360 then checks the ON/OFF state of the inlet sensor 301 (steps S102 and S103) and the ON/OFF state of the upper outlet sensor 302 (steps S014 and S105) for thereby confirming the passage of sheets. When a preselected period of time elapses since the passage of the last sheet (YES, step S106), the CPU 360 causes the above rollers to stop rotating (step S107). In this manner, all the sheets handed over from the image forming apparatus PR to the finisher PD are sequentially stacked on the upper tray 201 without being stapled. If desired, the punch unit 100, which intervenes between the inlet roller pair 1 and conveyor roller pair 2, may punch the consecutive sheets.

Figure 19A:
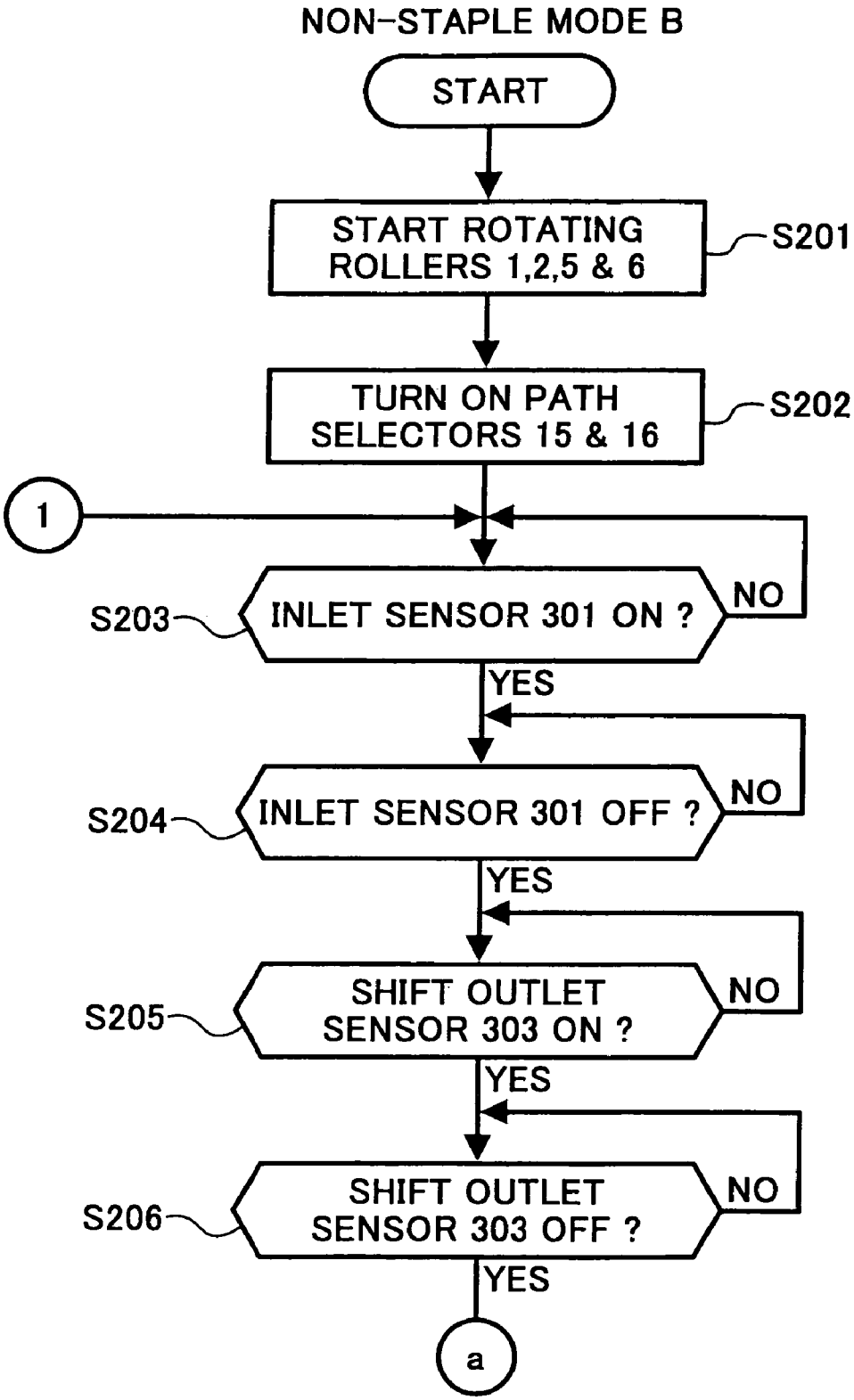
FIGS. 19A and 19B are flowcharts demonstrating a non-staple mode B available with the sheet finisher.
Figure 19B:
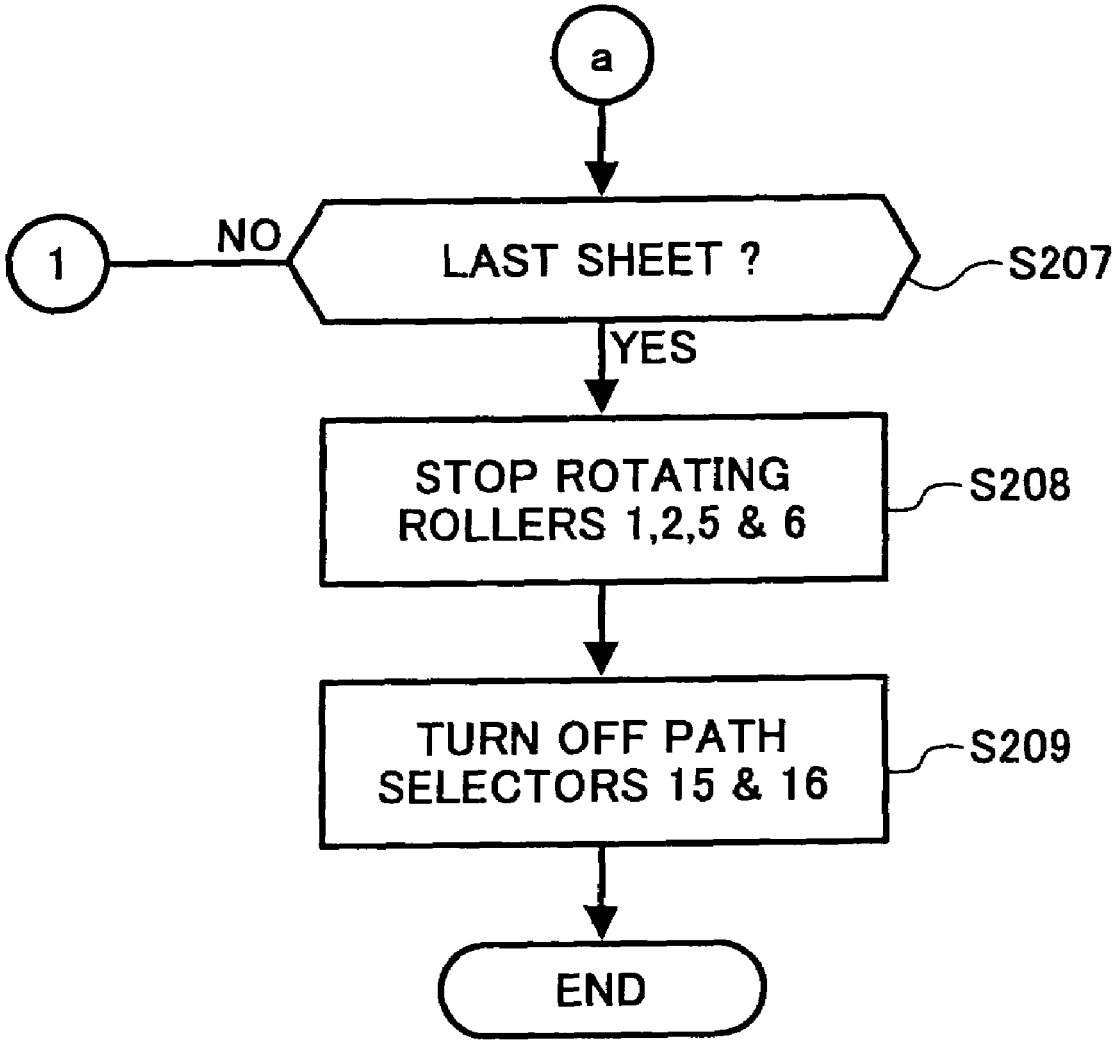

In a non-staple mode B, the sheets are routed through the paths A and C to the shift tray 202. In this mode, the path selectors 15 and 16 are respectively moved counterclockwise and clockwise, unblocking the path C. The non-staple mode B will be described with reference to FIGS. 19A and 19B.

As shown, before a sheet driven out of the image forming apparatus PR enters the finisher PD, CPU 360 causes the inlet roller pair 1 and conveyor roller pair 2 on the path A and the conveyor roller pair 5 and shift outlet roller pair 6 on the path C to start rotating (step S201). The CPU 360 then energizes the solenoids assigned to the path selectors 15 and 16 (step S202) to thereby move the path selectors 15 and 16 counterclockwise and clockwise, respectively. Subsequently, the CPU 360 checks the ON/OFF state of the inlet sensor 301 (steps S203 and S204) and the ON/OFF state of the shift outlet sensor 303 (steps S205 and S206) to thereby confirm the passage of the sheets.

On the elapse of a preselected period of time since the passage of the last sheet (YES, step S207), the CPU 360 causes the various rollers mentioned above to stop 16 rotating (S208) and deenergizes the solenoids (steps S209). In this manner, all the sheets entered the finisher PD are sequentially stacked on the shift tray 202 without being stapled. Again, the punch unit 100 intervening between the inlet roller pair 1 and conveyor roller pair 2 may punch the consecutive sheets, if desired.

Figure 20A:
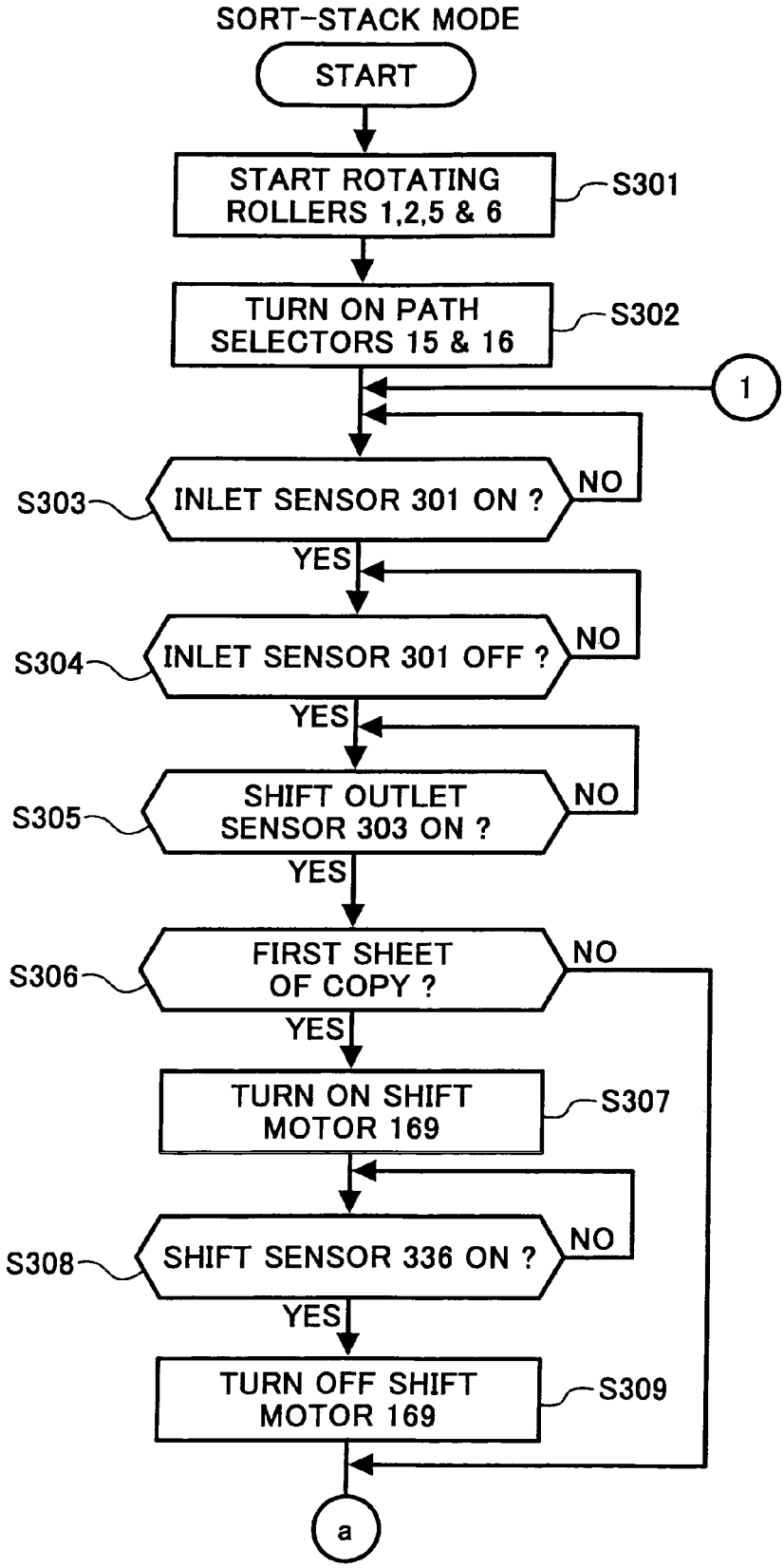
FIGS. 20A and 20B are flowcharts demonstrating a sort/stack mode available with the sheet finisher.
Figure 20B:
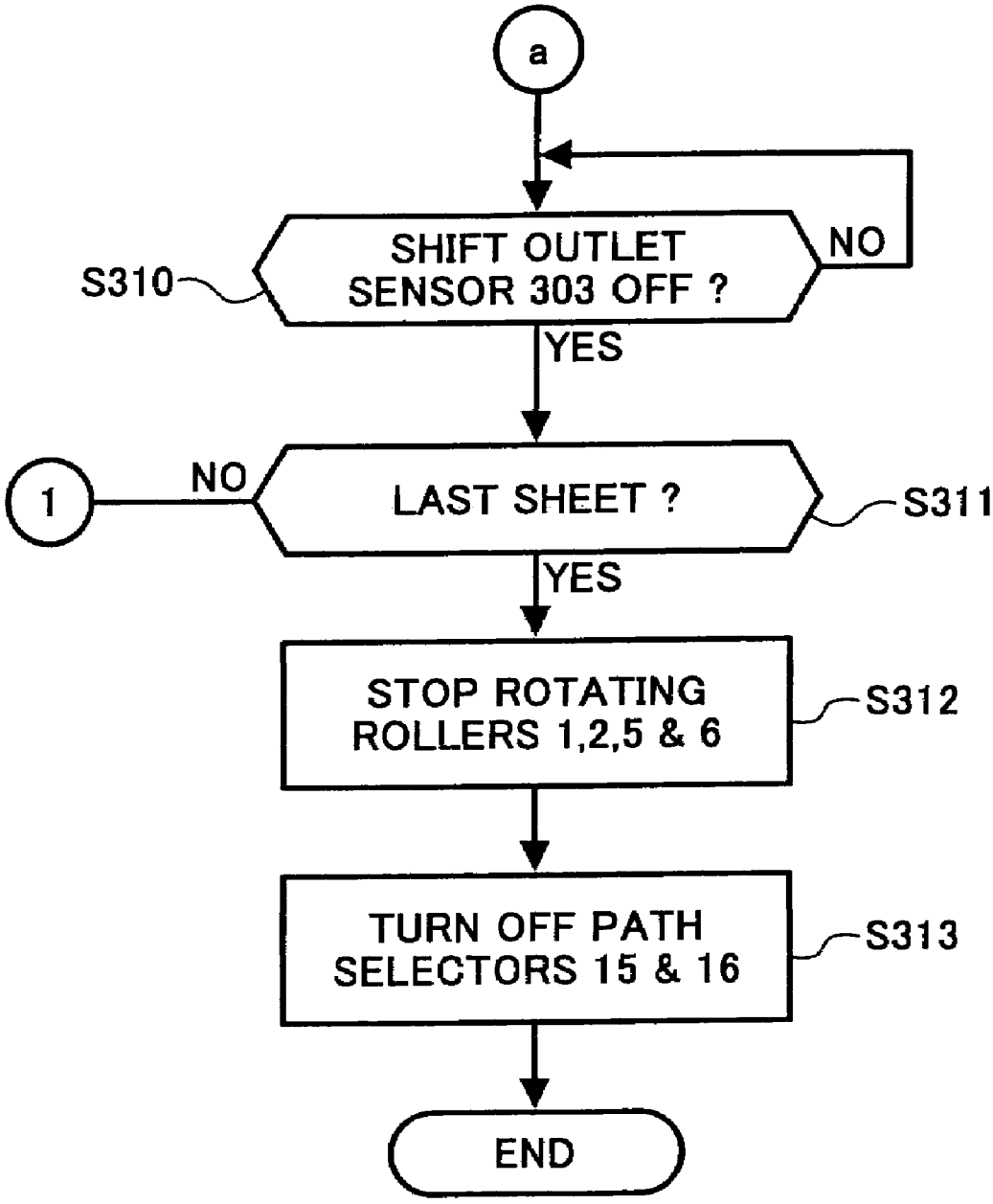

In a sort/stack mode, the sheets are also sequentially delivered from the path A to the shift tray 202 via the path C. A difference is that the shift tray 202 is shifted perpendicularly to the direction of sheet discharge copy by copy in order to sort the sheets. The path selectors 15 and 16 are respectively rotated counterclockwise and clockwise as in the non-staple mode B, thereby unblocking the path C. The sort/stack mode will be described with reference to FIGS. 20A and 20B.

As shown, before a sheet driven out of the image forming apparatus PR enters the finisher PD, CPU 360 causes the inlet roller pair 1 and conveyor roller pair 2 on the path A and the conveyor roller pair 5 and shift outlet roller pair 6 on the path C to start rotating (step S301). The CPU 360 then energizes the solenoids assigned to the path selectors 15 and 16 (step S302) to thereby move the path selectors 15 and 16 counterclockwise and clockwiser respectively. Subsequently, the CPU 360 checks the ON/OFF state of the inlet sensor 301 (steps S303 and S304) and the ON/OFF state of the shift outlet sensor 303 (step S305)

If the sheet passed the shift outlet sensor 303 is the first sheet of a copy (YES, step S306), then the CPU 360 turns on the shift motor 169 (step S307) to thereby move the shift tray 202 perpendicularly to the direction of sheet conveyance until the shift sensor 336 senses the tray 202 (steps S309 and S309). When the sheet moves away from the shift outlet sensor 303 (YES, step S310), the CPU 360 determines whether or not the sheet is the last sheet (step S311). If the answer of the step S311 is NO, meaning that the sheet is not the last sheet of a copy, and if the copy is not a single sheet, then the procedure returns to the step S303. If the copy is a single sheet, then the CPU 360 executes a step S312.

If the answer of the step S306 is NO, meaning that the sheet passed the shift outlet sensor 303 is not the first sheet of a copy, then the CPU 360 discharges the sheet(step S310) because the shift tray 202 has already been shifted. The CPU 360 then determines whether or not the discharged sheet is the last sheet (step S311). If the answer of the step S311 is NO, then the CPU 360 repeats the step S303 and successive steps with the next sheet. If the answer of the step S311 is YES, then the CPU 360 causes, on the elapse of a preselected period of time, the inlet roller pair 1, conveyor roller pairs 2 and 5 and shift outlet roller pair 6 to stop rotating (step S312) and deenergizes the solenoids assigned to the path selectors 15 and 16 (step S313). In this manner, all the sheets sequentially entered the finisher PD are sorted and stacked on the shift tray 202 without being stapled. In this mode, too, the punch unit 100 may punch the consecutive sheets, if desired.

Figure 21A:
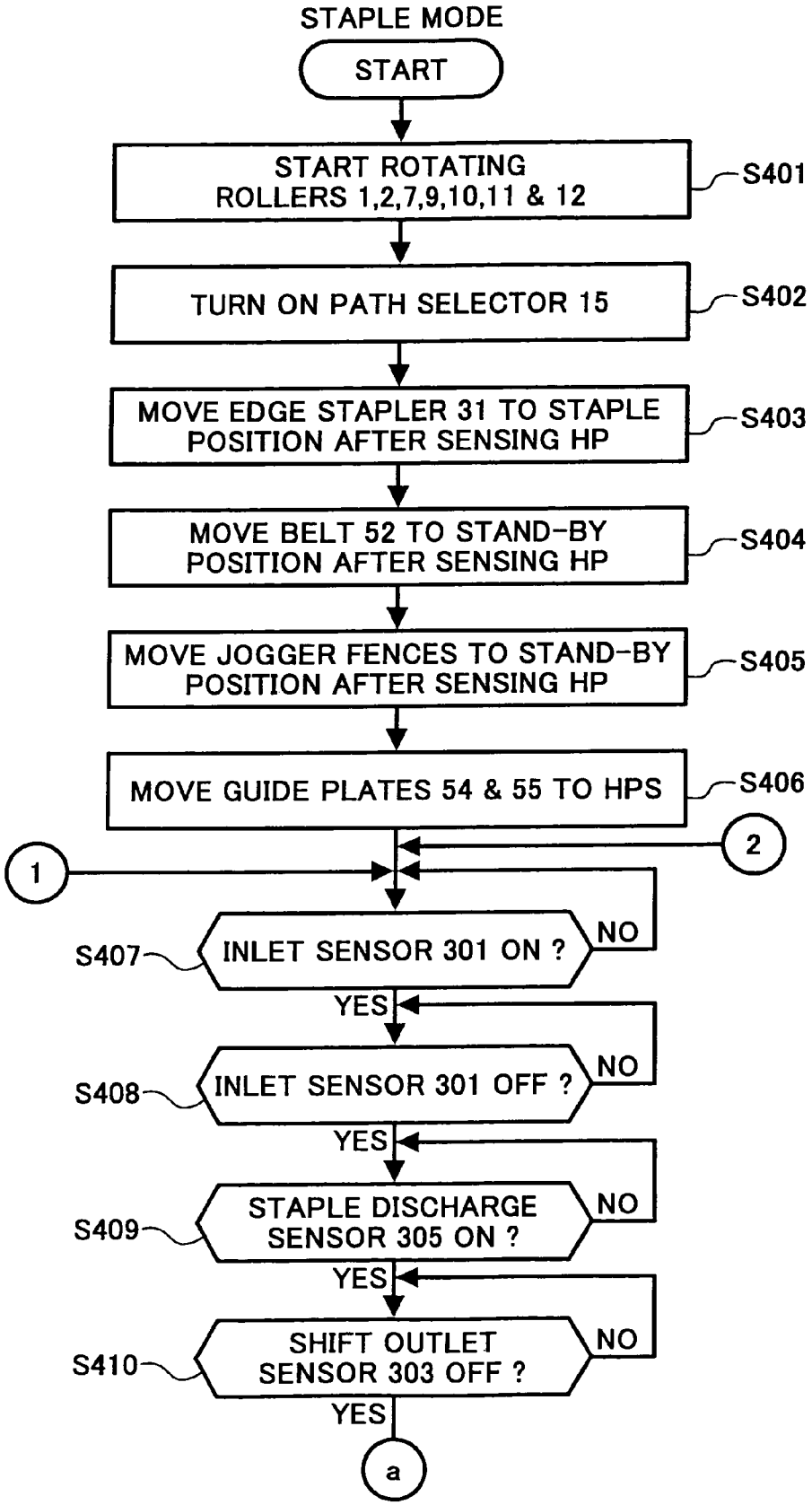
FIGS. 21A through 21C are flowcharts demonstrating a staple mode available with the sheet finisher.
Figure 21B:
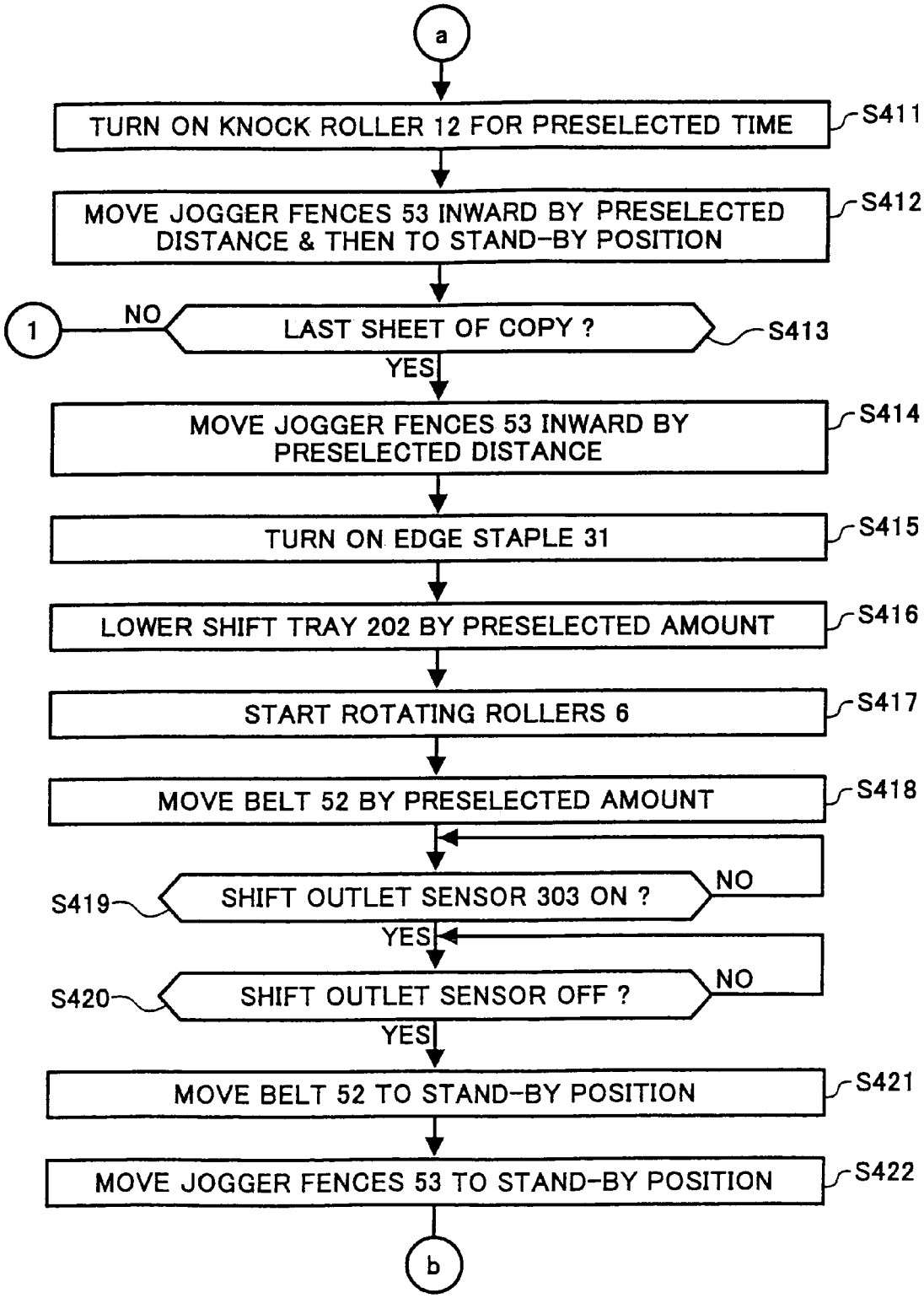
Figure 21C:
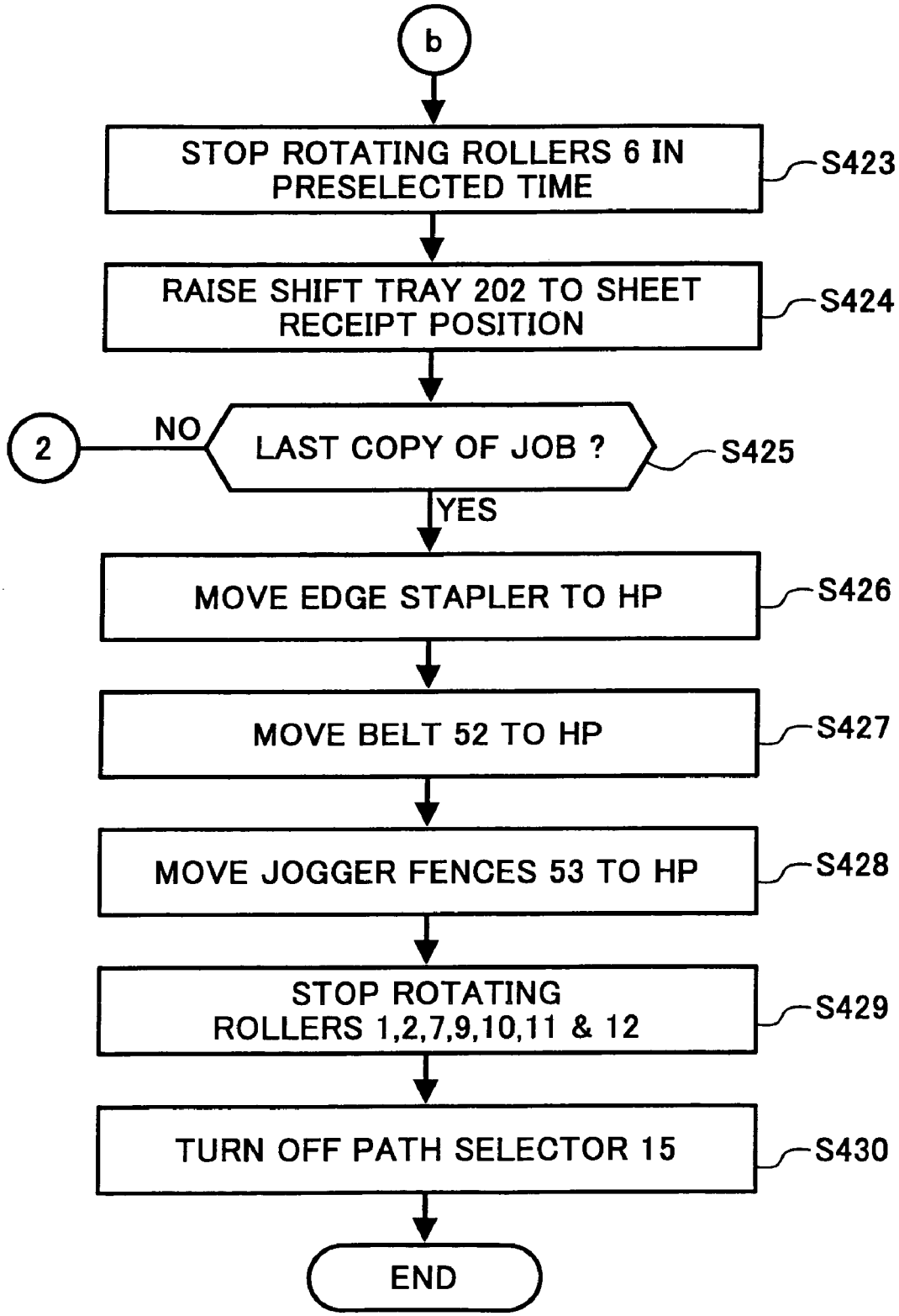

In a staple mode, the sheets are conveyed from the path A to the staple tray F via the path D, positioned and stapled on the staple tray F, and then discharged t the shift tray 202 via the path C. In this mode, the path selectors 15 and 16 both are rotated counterclockwise to unblock the route extending from the path A to the path D. The staple mode will be described with reference to FIGS. 21A through 21C.

As shown, before a sheet driven out of the image forming apparatus PR enters the finisher PD, CPU 360 causes the inlet roller pair 1 and conveyor roller pair 2 on the path A and the conveyor roller pairs 7, 9 and 10 and staple outlet roller 11 on the path D and knock roller 12 to start rotating (step S401). The CPU 360 then energizes the solenoid assigned to the path selector 15 (step S402) to thereby cause the path selector 15 to rotate counterclockwise.

After the stapler HP sensor 312 has sensed the edge stapler S1 at the home position, the CPU 360 drives the stapler motor 159 to move the edge stapler S1 to a preselected stapling position (step S403). Also, after the belt HP sensor 311 has sensed the belt 52 at the home position, the CPU 360 drives the discharge motor 157 to bring the belt 52 to a stand-by position (step S404). Further, after the jogger fence motor HP sensor has sensed the jogger fences 53 at the home position, the CPU 360 moves the jogger fences 53 to a stand-by position (step S405). In addition, the CPU 360 causes the guide plate 54 and movable guide 55 to move to their home positions (step S406).

If the inlet sensor 301 has turned on (YES, step S407) and then turned off (YES, step S408), if the staple discharge sensor 305 has turned on (YES, step S409) and if the shift outlet sensor 303 has tuned on (YES, step S410), then the CPU 360 determines that a sheet is present on the staple tray F. In this case, the CPU 360 energizes the knock solenoid 170 for a preselected period of time to cause the knock roller 12 to contact the sheet and force it against the rear fences 51, thereby positioning the rear edge of the sheet (step S411). Subsequently, the CPU 360 drives the jogger motor 158 to move each jogger fence 53 inward by a preselected distance for thereby positioning the sheet in the direction of width perpendicular to the direction of sheet conveyance and then returns the jogger fence 53 to the stand-by position (step S412). The CPU 360 repeats the step S407 and successive steps with every sheet. When the last sheet of a copy arrives at the staple tray F (YES, step S413), the CPU 360 moves the jogger fences 53 inward to a position where they prevent the edges of the sheets from being dislocated (step S414). In this condition, the CPU 360 turns on the stapler S1 and causes it to staple the edge of the sheet stack (step S415).

On the other hand, the CPU 360 lowers the shift tray 202 by a preselected amount (step S416) in order to produce a space for receiving the stapled sheet stack. The CPU 360 then drives the shift discharge roller pair 6 via the shift discharge motor (step S417) and drives the belt 52 by a preselected amount via the discharge motor 157 (step S418), so that the stapled sheet stack is raised toward the path C. As a result, the stapled sheet stack is driven out to the shift tray 202 via the shift outlet roller pair 6. After the shift outlet sensor 303 has turned on (step S419) and then turned off (step S420), meaning that the sheet stack has moved away from the sensor 303, the CPU 360 moves the belt 52 and jogger fences 53 to their stand-by positions (steps S421 and S422), causes the shift outlet roller pair 6 to stop rotating on the elapse of a preselected period of time (step S423), and raises the shift tray 202 to a sheet receiving position (step S424). The rise of the shift tray 202 is controlled in accordance with the output of the sheet surface sensor 330 responsive to the top of the sheet stack positioned on the shift tray 202.

After the last copy or set of sheets has been driven out to the shift tray 202, the CPU 360 returns the edge stapler S1, belt 52 and jogger fences 53 to their home positions (steps S426, S427 and S428) and causes the inlet roller pair 1, conveyor roller pairs 2, 7, 9 and 10, staple discharge roller pair 11 and knock roller 12 to stop rotating (step S429). Further, the CPU 360 deenergizes the solenoid assigned to the path selector 15 (step S430. Consequently, all the structural parts are returned to their initial positions. In this case, too, the punch unit 100 may punch the consecutive sheets before stapling.

The operation of the staple tray F in the staple mode will be described more specifically hereinafter. As shown in FIG. 6, when the staple mode is selected, the jogger fences 53 each are moved from the home position to a stand-by position 7 mm short of one end of the width of sheets to be stacked on the staple tray F (step S405). When a sheet being conveyed by the staple discharge roller pair 11 passes the staple discharge sensor 305 (step S409), the jogger fence 53 is moved inward from the stand-by position by 5 mm.

The staple discharge sensor 305 senses the trailing edge of the sheet and sends its output to the CPU 360. In response, the CPU 360 starts counting drive pulses input to the staple motor, not shown, driving the staple discharge roller pair 11.

On counting a preselected number of pulses, the CPU 360 energizes the knock solenoid 170 (step S412). The knock solenoid 170 causes the knock roller 12 to contact the sheet and force it downward when energized, so that the sheet is positioned by the rear fences 51. Every time a sheet to be stacked on the staple tray F1 passes the inlet sensor 301 or the staple discharge sensor 305, the output of the sensor 301 or 305 is sent to the CPU 360, causing the CPU 360 to count the sheet.

On the elapse of a preselected period of time since the knock solenoid 170 has been turned off, the CPU 360 causes the jogger motor 158 to move each jogger fence 53 further inward by 2.6 mm and then stop it, thereby positioning the sheet in the direction of width. Subsequently, the CPU 360 moves the jogger fence 53 outward by 7.6 mm to the stand-by position and then waits for the next sheet (step S412). The CPU 360 repeats such a procedure up to the last page (step S413). The CPU 360 again causes the jogger fences 53 to move inward by 7 mm and then stop, thereby causing the jogger fences 53 to retain the opposite edges of the sheet stack to be stapled. Subsequently, on the elapse of a preselected period of time, the CPU 360 drives the edge stapler S1 via the staple motor for thereby stapling the sheet stack (step S415). If two or more stapling positions are designated, then the CPU 360 moves, after stapling at one position, the edge stapler S1 to another designated position along the rear edge of the sheet stack via the stapler motor 159. At this position, the edge stapler S1 again staples the sheet stack. This is repeated when three or more stapling positions are designated.

After the stapling operation, the CPU 360 drives the belt 52 via the discharge motor 157 (step S418). At the same time, the CPU 360 drives the outlet motor to cause the shift outlet roller pair 6 to start rotating in order to receive the stapled sheet stack lifted by the hook 52*a* (step S417). At this instant, the CPU 360 controls the jogger fences 53 in a different manner in accordance with the sheet size and the number of sheets stapled together. For example, when the number of sheets stapled together or the sheet size is smaller than a preselected value, then the CPU 360 causes the jogger fences 53 to constantly retain the opposite edges of the sheet stack until the hook 52*a* fully lifts the rear edge of the sheet stack. When a preselected number of pulses are output since the turn-on of the sheet sensor 310 or the belt HP sensor 311, the CPU 360 causes the jogger fences 53 to retract by 2 mm and release the sheet stack. The preselected number of pulses corresponds to an interval between the time when the hook 52*a* contacts the trailing edge of the sheet stack and the time when it moves away from the upper ends of the jogger fences 53.

On the other hand, when the number of sheets stapled together or the sheet size is larger than the preselected value, the CPU 360 causes the jogger fences 53 to retract by 2 mm beforehand. In any case, as soon as the stapled sheet stack moves away from the jogger fences 53, the CPU. 360 moves the jogger fences 53 further outward by 5 mm to the stand-by positions (step S422) for thereby preparing it for the next sheet. If desired, the restraint to act on the sheet stack may be controlled on the basis of the distance of each jogger fence from the sheet stack.

Figure 25:
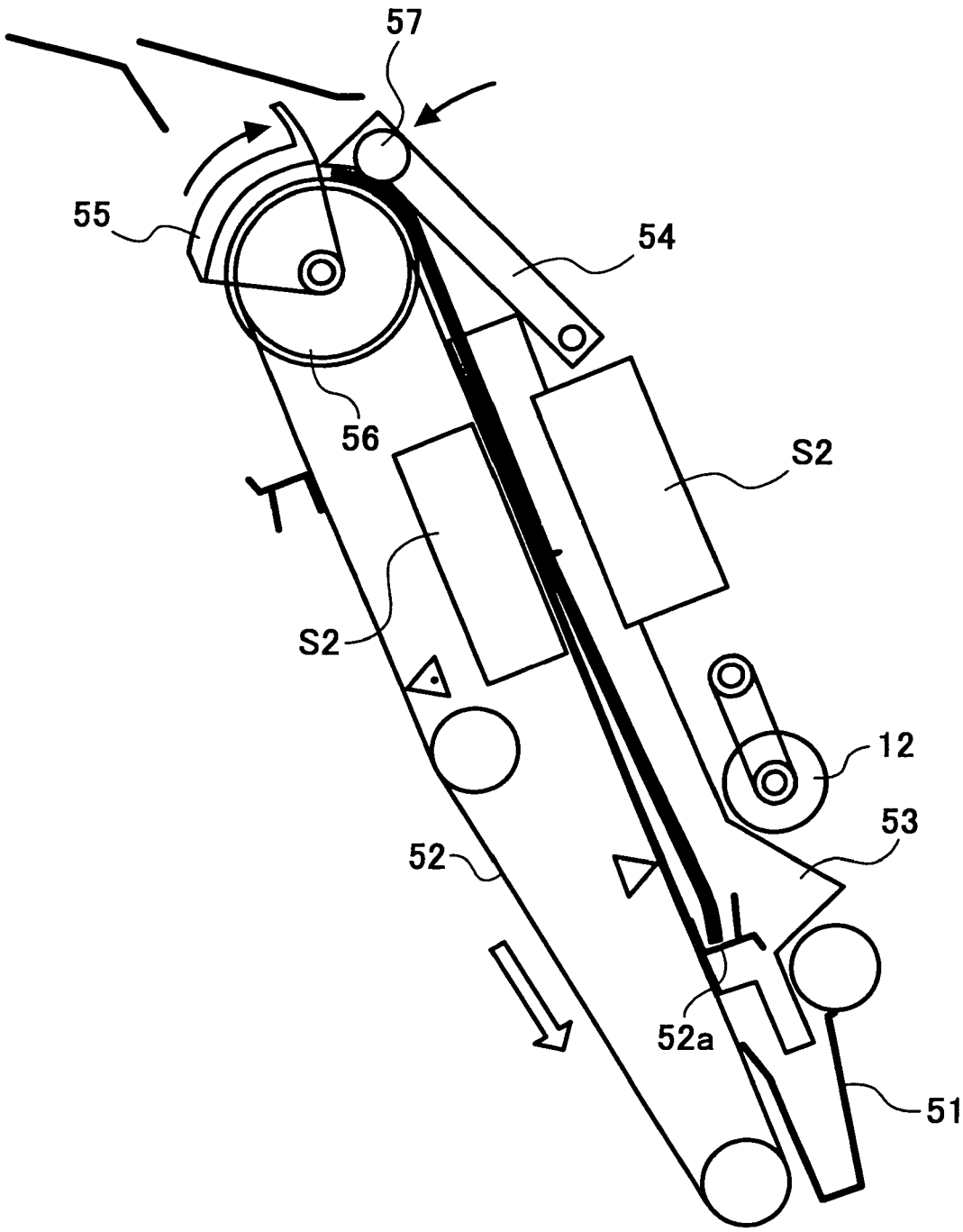
FIG. 25 shows the initial condition wherein the sheet stack steering mechanism steers a sheet stack stapled at the center on the staple tray in the center staple and fold mode.

In a center staple and bind mode, the sheets are sequentially conveyed from the path A to the staple tray F via the path D, positioned and stapled at the center on the tray F, folded on the fold tray G, and then driven out to the lower tray 203 via the path H. In this mode, the path selectors 15 and 16 both are rotated counterclockwise to unblock the route extending from the path A to the path D. Also, the guide plate 54 and movable guide plate 55 are closed, as shown in FIG. 25, guiding the stapled sheet stack to the fold tray G. The center staple and bind mode will be described with reference to FIGS. 22A through 22C.

As shown, before a sheet driven out of the image forming apparatus PR enters the finisher PD, CPU 360 causes the inlet roller pair 1 and conveyor roller pair 2 on the path A and the conveyor roller pairs 7, 9 and 10 and staple outlet roller 11 on the path D and knock roller 12 to start rotating (step S401). The CPU 360 then energizes the solenoid assigned to the path selector 15 (step S402) to thereby cause the path selector 15 to rotate counterclockwise.

Subsequently, after the belt HP sensor 311 has sensed the belt 52 at the home position, the CPU 360 drives to the discharge motor 157 to move the belt 52 to the stand-by position (step S503). Also, after the jogger fence HP sensor has sensed each jogger fence 53 at the home position, the CPU 360 moves the jogger fence 53 to the stand-by position (step S504). Further, the CPU 360 moves the guide plate 54 and movable guide 55 to their home positions (steps S505).

If the inlet sensor 301 has turned on (YES, step S506) and then turned off (YES, step S507), if the staple discharge sensor 305 has turned on (YES, step S508) and if the shift outlet sensor 303 has tuned on (YES, step S509), then the CPU 360 determines that a sheet is present on the staple tray F. In this case, the CPU 360 energizes the knock solenoid 170 for the preselected period of time to cause the knock roller 12 to contact the sheet and force it against the rear fences 51, thereby positioning the trailing edge of the sheet (step S510). Subsequently, the CPU 360 drives the jogger motor 158 to move each jogger fence 53 inward by the preselected distance for thereby positioning the sheet in the direction of width perpendicular to the direction of sheet conveyance and then returns the jogger fence 53 to the stand-by position (step S511). The CPU 360 repeats the step S407 and successive steps with every sheet. When the last sheet of a copy arrives at the staple tray F (YES, step S512), the CPU 360 moves the jogger fences 53 inward to the position where they prevent the edges of the sheets from being dislocated (step S513).

After the step S513, the CPU 360 turns on the discharge motor 157 to thereby move the belt 52 by a preselected amount (step S514), so that the belt 52 lifts the sheet stack to a stapling position assigned to the center staplers S2. Subsequently, the CPU 360 turns on the center staplers S2 at the intermediate portion of the sheet stack for thereby stapling the sheet stack at the center (step S515). The CPU 360 then moves the guides 54 and 55 by a preselected amount each in order to form a path directed toward the fold tray G (step S516) and causes the upper and lower roller pairs 71 and 72 of the fold tray G to start rotating (step S517). As soon as the movable rear fence 73 of the fold tray G is sensed at the home position, the CPU 360 moves the fence 73 to a stand-by position (step S518). The fold tray G is now ready to receive the stapled sheet stack.

After the step S518, the CPU 360 further moves the belt 52 by a preselected amount (step S519) and causes the discharge roller 56 and press roller 57 to nip the sheet stack and convey it to the fold tray G. When the leading edge of the stapled sheet stack is conveyed by a preselected distance past the stack arrival sensor 321 (step S520), the CPU 360 causes the upper and lower roller pairs 71 and 72 to stop rotating (step S521) and then releases the lower rollers 72 from each other. Subsequently, the CPU 360 causes the fold plate 74 start folding the sheet stack (step S523) and causes the fold roller pairs 61 and 82 and lower outlet roller pair 83 to start rotating (step S524). The CPU 360 then determines whether or not the folded sheet stack has moved away from the pass sensor 323 (steps S525 and S526). If the answer of the step S526 is YES, then the CPU 360 brings the lower rollers 72 into contact (step S527) and moves the guides 54 and 55 to their home positions (steps S528 and 5529).

In the above condition, the CPU 360 determines whether or not the trailing edge of the folded sheet stack has moved away from the lower outlet sensor 324 (steps S530 and S531). If the answer of the step S531 is YES, then the CPU 360 causes the fold roller pairs 81 and 82 and lower outlet roller pair 83 to further rotate for a preselected period of time and then stop (step S532) and then causes the belt 52 and jogger fences 53 to return to the stand-by positions (steps S533 and S534). Subsequently, the CPU 360 determines whether or not the above sheet stack is the last copy of a single job (step S535). If the answer of the step S535 is No, then the procedure returns to the step S506. If the answer of the step S535 is YES, the CPU 360 returns the belt 52 and jogger fences 53 to the home positions (steps S536 and S537). At the same time, the CPU 360 causes the staple discharge roller pair 11 and knock roller 12 to stop rotating (step S538) and turns off the solenoid assigned to the path selector 15 (step S539). As a result, all the structural parts are returned to their initial positions.

Figure 30:
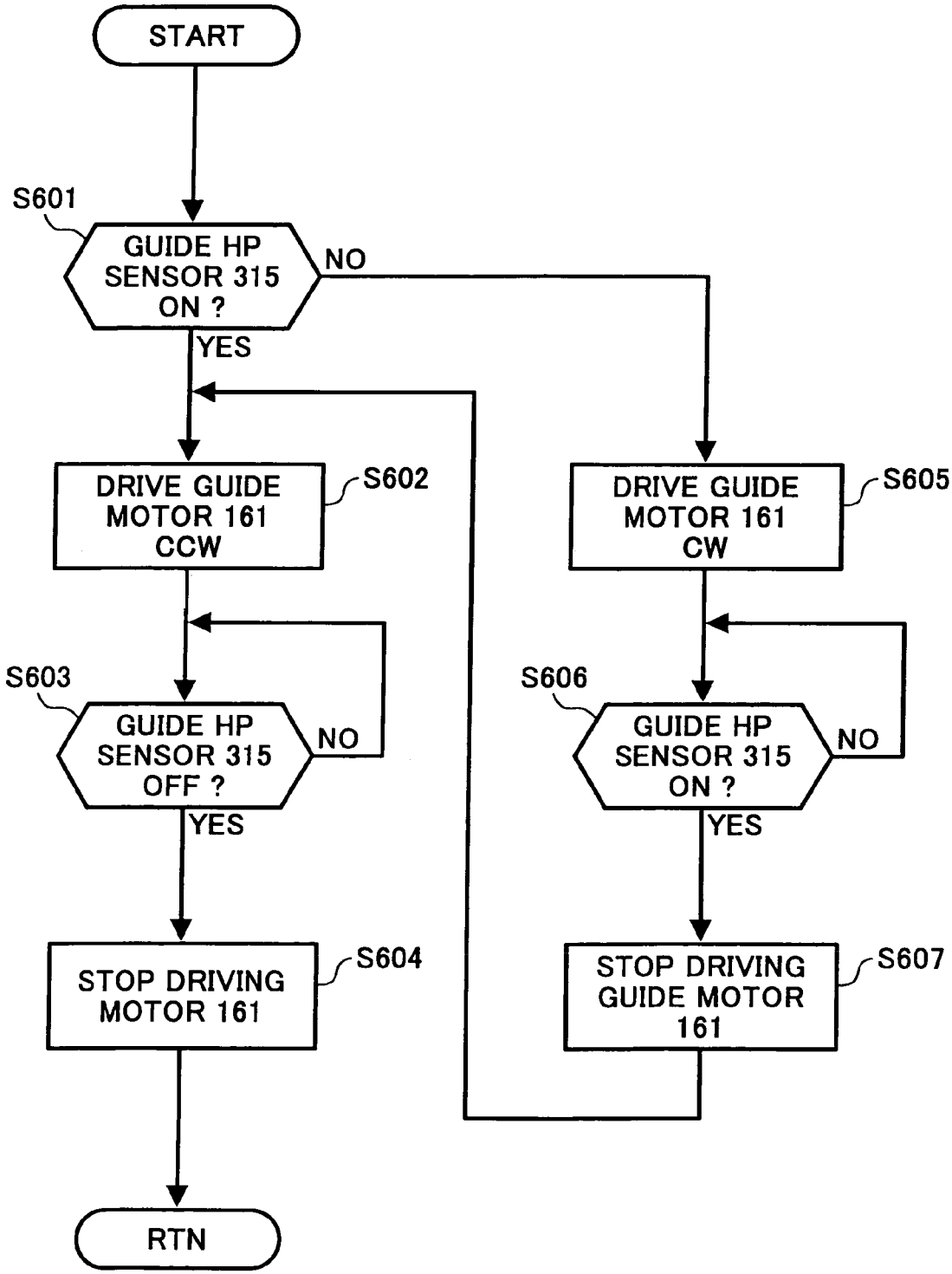
FIG. 30 is a flowchart demonstrating a procedure for initializing a guide plate and a movable guide included in the sheet stack steering mechanism.

Hereinafter will be described the sheet stack steering mechanism and control over the movement of the belt 52. FIG. 30 shows a procedure for initializing the guide made up of the guide plate 54 and movable guide 55. The configuration of the sheet stack steering mechanism and the operations of the guide plates 54 and 55 have been previously stated with reference to FIGS. 10 through 12. The CPU 360 executes control to be described with reference to FIG. 30.

As shown, the CPU 360 determines whether or not the guide HP sensor 315 responsive to the interrupter 61*c* of the cam 61 has turned on (step S601). If the answer of the step S601 is YES, then the CPU 360 rotates the steer motor 161 counterclockwise, as indicated by an arrow in FIG. 11 (step S602). When the guide HP sensor 315 turns off (YES, step S603), the CPU 360 stops driving the steer motor 616 (step S604). The resulting condition is shown in FIG. 10.

On the other hand, if the guide HP sensor 315 has turned off (YES, step S605), the CPU 360 drives the steer motor 161 clockwise (step S605). When the guide HP sensor 315 turns on (YES, step S606), the CPU 360 stops driving the steer motor 161 (step S607) and again drives it counterclockwise (step S602) until the guide HP sensor 315 turns off (steps S603 and S604). Consequently, the initial position of the cam 61, i.e., the initial positions of the guide plate 54 and movable guide 55 are set.

Figure 31A:
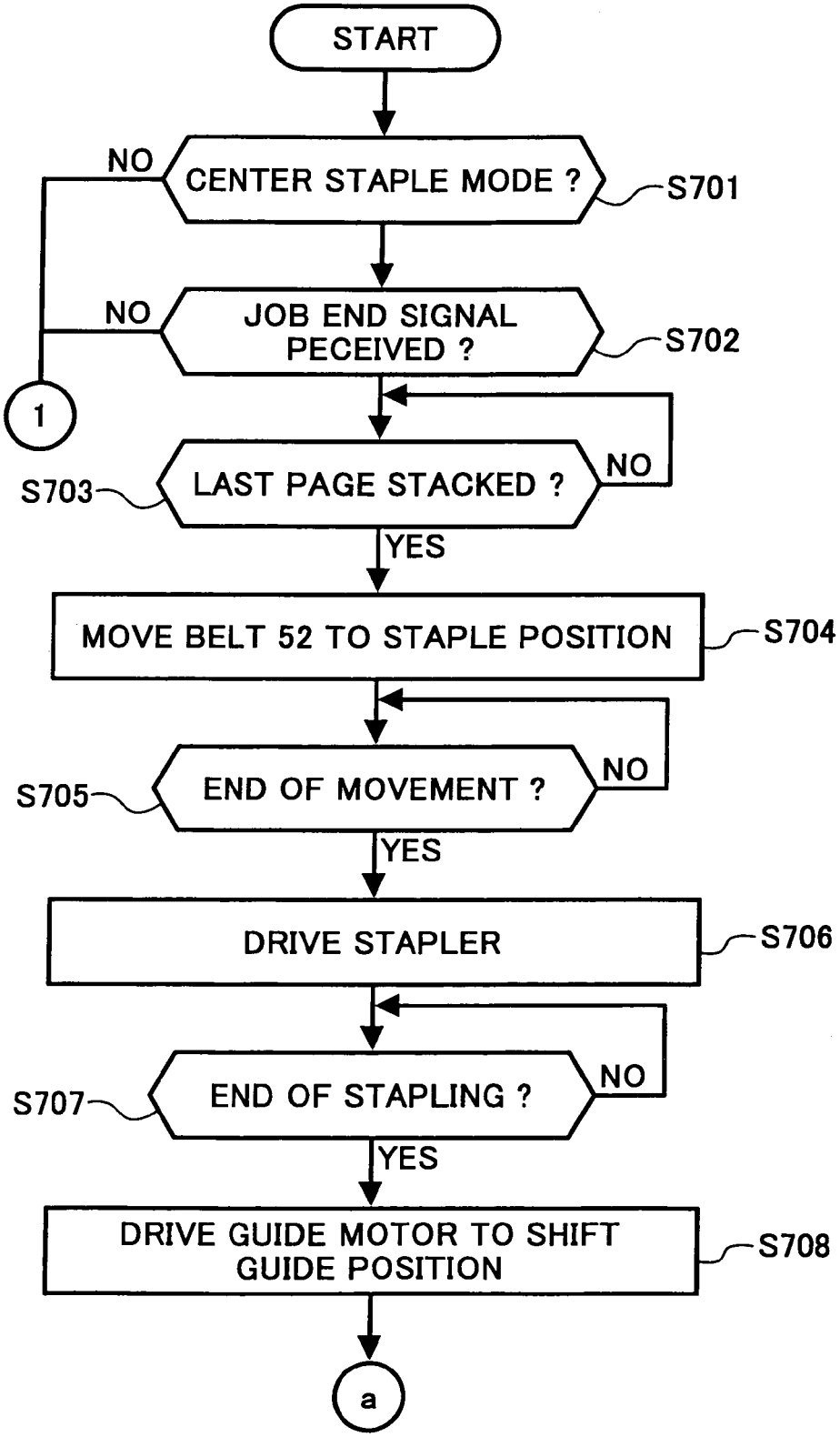
FIGS. 31A and 31B are flowcharts representative of a procedure for controlling conveyance by a belt included in the sheet stack steering mechanism and steering by the guide plate and movable guide.
Figure 31B:
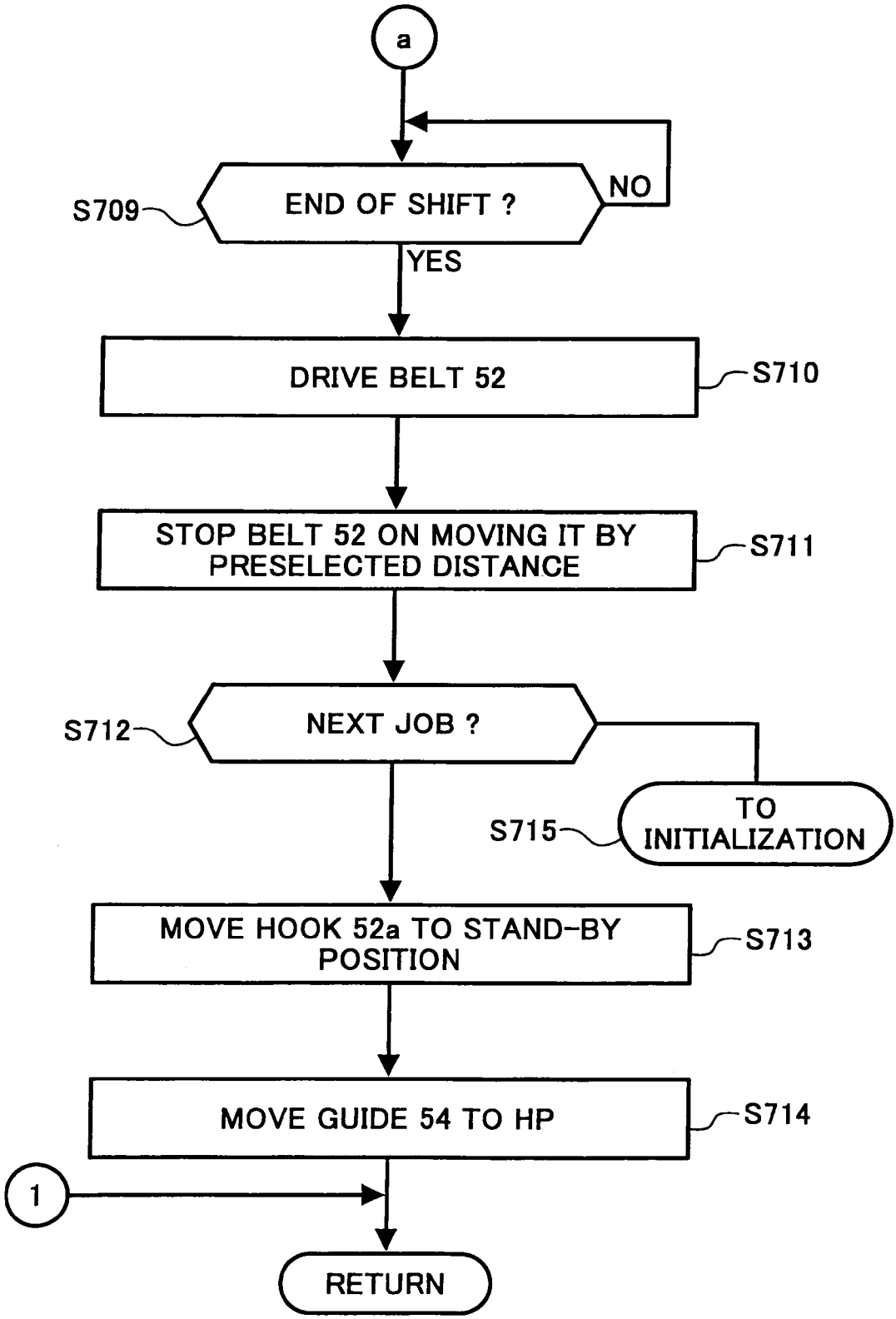

FIGS. 31A and 31B demonstrate control over the sheet stack steering mechanism and sheet stack conveyance, i.e., conveyance by the belt 52 and steering by the guides 54 and 55. As shown, if the center staple mode is selected (YES, step S701), then the CPU 360 determines whether or not it has received a job end signal from the image forming apparatus PR (step S702). If the answer of the step S702 is YES, then the CPU 360 determines whether or not the last sheet has been stacked on the staple tray F (step S703). If the answer of the step S703 is YES, then the CPU 360 causes the discharge motor 157 to move the belt 52 until the sheet reaches the center stapling position (step S704). As soon as the movement of the sheet stack ends (YES, step S705), the CPU 360 causes the center staplers S2 to staple the sheet stack (step S706). When the center stapling ends (YES, step 5707), the CPU 360 drives the steer motor 161 such that the cam 61 moves from the position shown in FIG. 10 to the position shown in FIG. 12, thereby moving the guides 54 and 55 to their steering positions (step S708).

As soon as the movement of the guides 54 and 55 completes (YES, step S709), the CPU 360 moves the belt 52 via the discharge motor 157 so as to discharge the sheet stack upward away from the center binding position (step S710). At this instant, the belt 52 once stops on moving a preselected distance matching with the sheet size (step S711). In this condition, the discharge roller 56 and press roller 57 and the upper and lower roller pairs 71 and 72 convey the sheet stack to the preselected folding position (step S712). Subsequently, the CPU 360 determines whether or not the next job to execute exists (step S712). If the answer of the step S712 is YES, then the CPU 360 moves the belt 52 to the stand-by position (see FIG. 26) for thereby preparing it for the next job (step S713). Subsequently, the CPU 360 returns the guides 54 and 55 to their initial positions, FIG. 10, to thereby unblock the path C (step S714). If the answer of the step S712 is NO, then the procedure returns to the initializing procedure shown in FIG. 30 (step S715).

Figure 23:
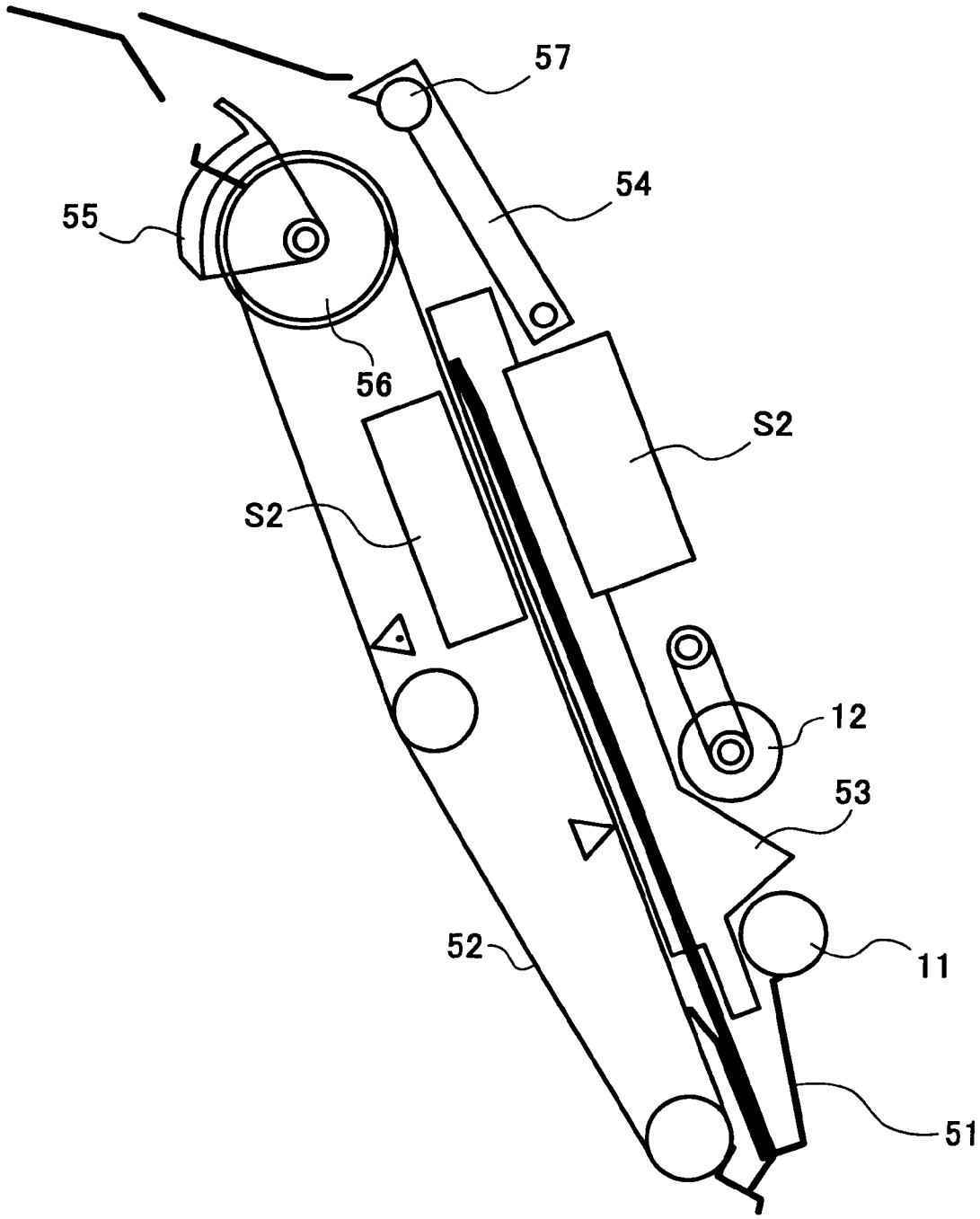
FIG. 23 shows how a sheet stack is positioned on the staple tray in the center staple and fold mode.
Figure 24:
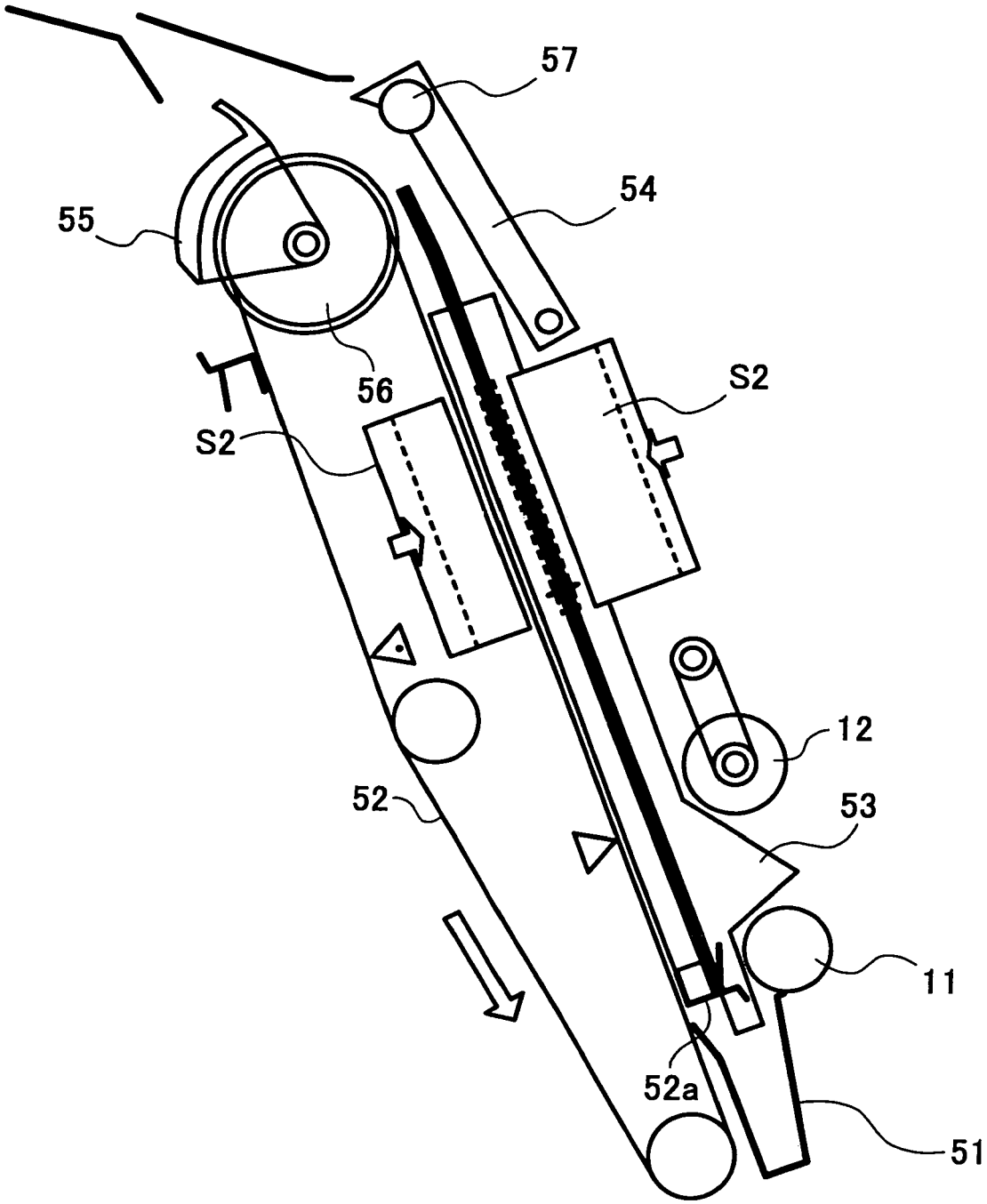
FIG. 24 shows how a sheet stack is stacked and stapled at the center on the staple tray in the center staple and fold mode.

The stapling operation and folding operation to be performed in the fold mode will be described in more detail hereinafter. A sheet is steered by the path selectors 15 and 16 to the path D and then conveyed by the roller pairs 7, 9 and 10 and staple discharge roller 11 to the staple tray F. The staple tray F operates in exactly the same manner as in the staple mode stated earlier before positioning and stapling (see FIG. 23) Subsequently, as shown in FIG. 24, the hook 52*a* conveys the sheet stack to the downstream side by a distance matching with the sheet size. After the center staplers S2 have stapled the center of the sheet stack, the sheet stack is conveyed by the hook 62*a* to the downstream side by a preselected distance matching with the sheet size and then brought to a stop. The distance of movement of the sheet stack is controlled on the basis of the drive pulses input to the discharge motor 157.

Figure 26:
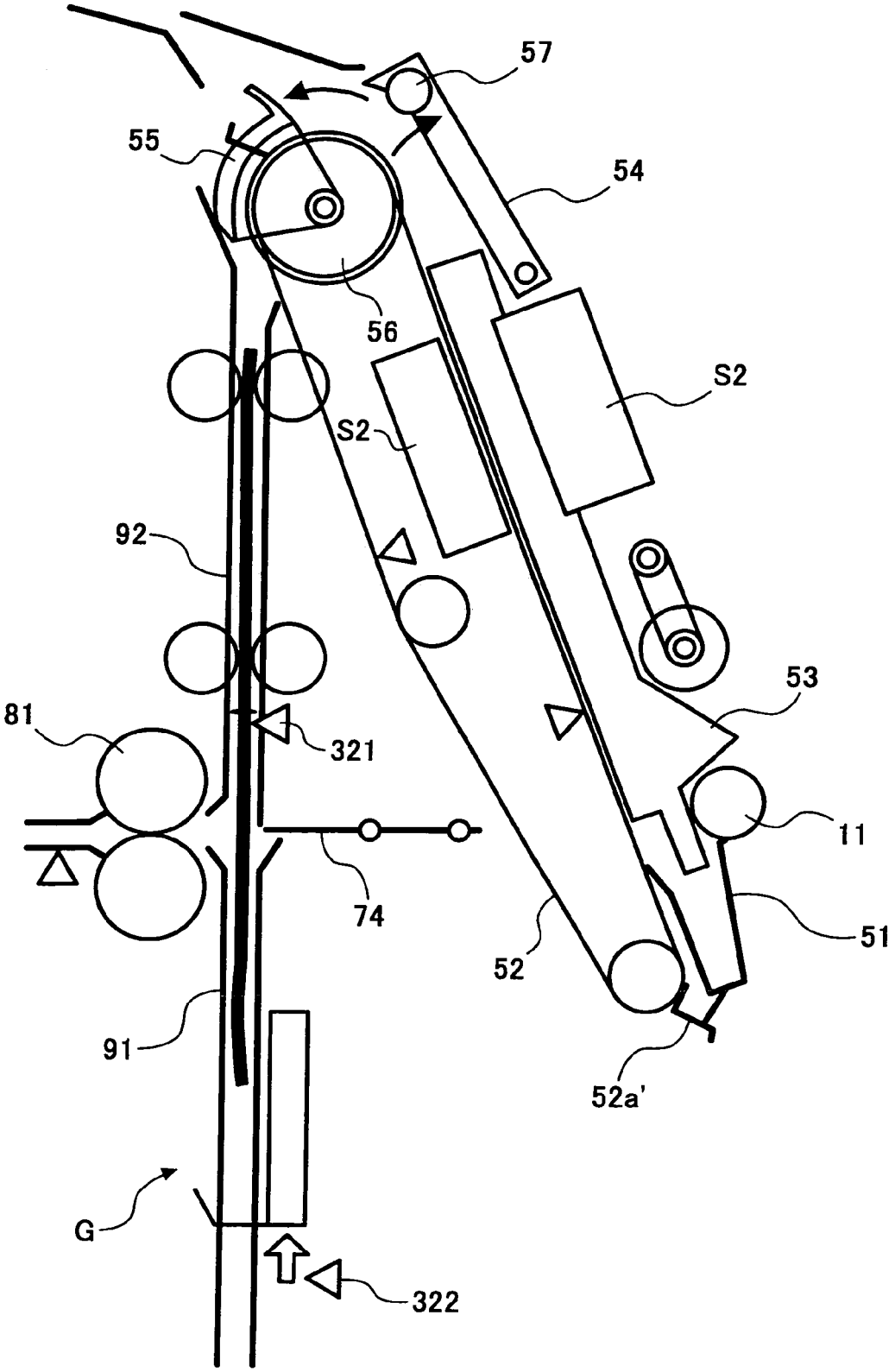
FIG. 26 shows a condition wherein the sheet stack steering mechanism has steered the sheet stack stapled in the center staple and fold mode toward a fold tray.

Subsequently, as shown in FIG. 25, the sheet stack is nipped by the discharge roller 56 and press roller 57 and then conveyed by the hook 52*a* and discharge roller 56 to the downstream side such that it passes through the path formed between the guides 54 and 55 and extending to the fold tray G. The discharge roller 56 is mounted on the drive shaft 65 associated with the belt 52 and therefore driven in synchronism with the belt 52. Subsequently, as shown in FIG. 26, the sheet stack is conveyed by the upper and lower roller pairs 71 and 72 to the movable rear fence 73, which is moved from its home position to a position matching with the sheet size beforehand and held in a stop for guiding the lower edge of the sheet stack. At this instant, as soon as the other hook 52' on the belt 52 arrives at a position close to the rear fence 51, the hook 52*a* is brought to a stop while the guides 54 and 55 are returned to the home positions to wait for the next sheet stack.

Figure 27:
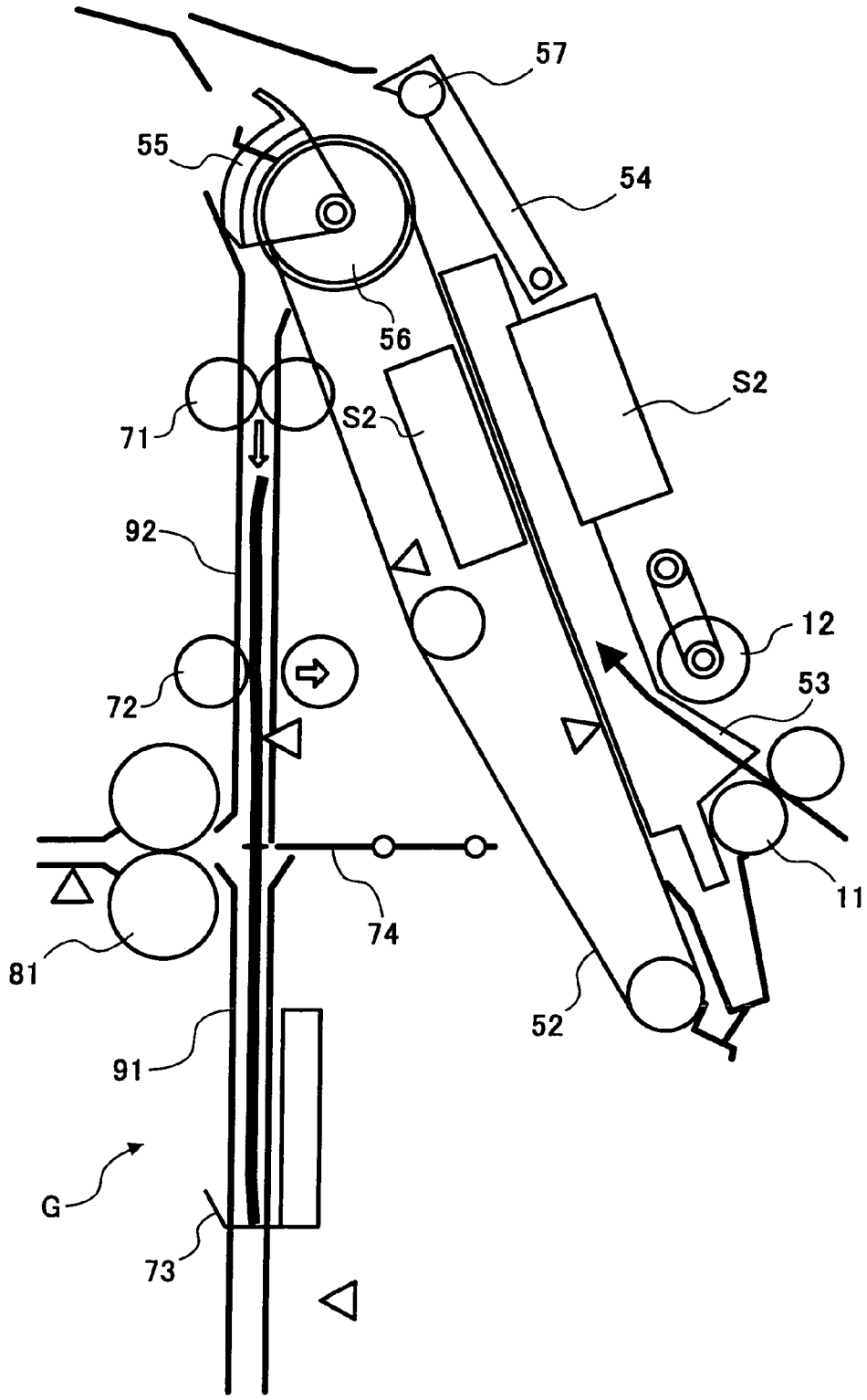
FIG. 27 shows a condition wherein the sheet stack is positioned at a fold position on the fold tray in the center staple and fold mode.
Figure 28:
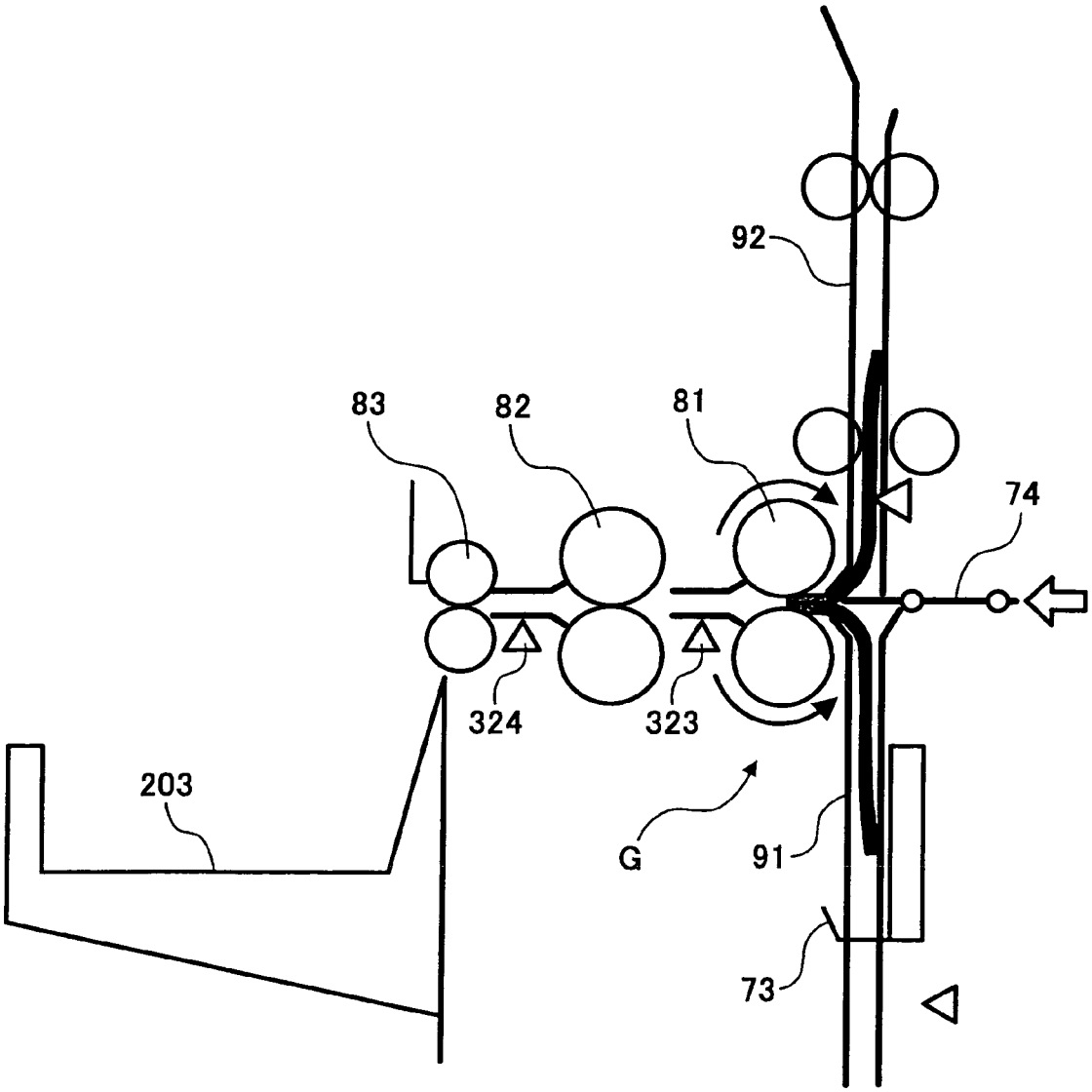
FIG. 28 shows a condition wherein a fold plate has started folding the sheet stack on the fold tray in the center staple and fold mode.

As shown in FIG. 27, the sheet stack abutted against the movable rear fence 73 is freed from the pressure of the lower roller pair 72. Subsequently, as shown in FIG. 28, the fold plate 74 pushes part of the sheet stack close to a staple toward the nip of the fold roller pair 81 substantially perpendicularly to the sheet stack. The fold roller pair 81, which is caused to rotate beforehand, conveys the sheet stack reached its nip while pressing it. As a result, the sheet stack is folded at its center.

Figure 29:
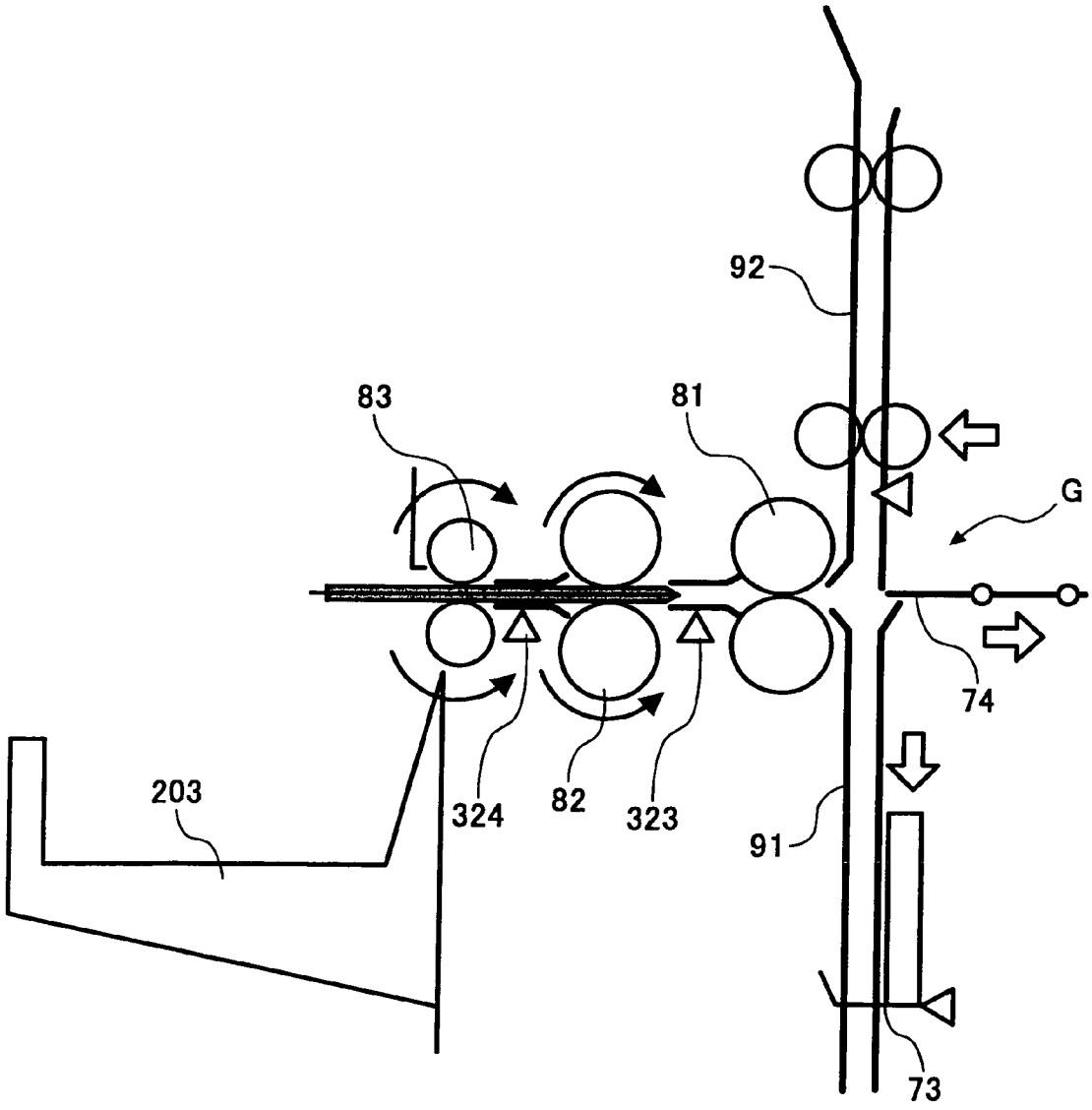
FIG. 29 shows a condition wherein fold roller pairs fold the sheet stack in the center staple and fold mode and then discharge it.

As shown in FIG. 29, the second fold roller pair 82 positioned on the path H makes the fold of the folded sheet stack more sharp. Thereafter, the lower outlet roller pair 83 conveys the sheet stack to the lower tray 203. When the trailing edge of the sheet stack is sensed by the pass sensor 323, the fold plate 74 and movable rear fence 73 are returned to their home positions. At the same time, the lower roller pair 72 is again brought into contact to prepare for the next sheet stacks If the next job is identical in sheet size and number of sheets with the above job, then the movable rear fence 73 may be held at the stand-by position.

As shown in FIGS. 28 and 29, the stapled sheet stack is folded by the fold plate 74 and first and second fold roller pairs 81 and 82. As shown in FIG. 1, the second fold roller pair 82 and lower outlet roller pair 83 are located at a position protruded sideways from the housing side wall SBA over the end fence 32 or the base portion of the shift tray 202. In addition, the outermost end of the lower tray 203 is located at the same position as the outermost end of the shift tray 202 in the vertical direction or closer to the finisher body than the above position, so that the vertical projection area of the lower tray 203 does not exceed the vertical projection area of the shift tray 202.

Further, the second fold roller pair 82 and lower outlet roller pair 83 are located at a position protruded sideways from the housing side wall SBA, so that a stapled sheet stack can be sufficiently folded in a plurality of steps. In this case, because the sheet size is halved due to folding, the size of the lower tray 203 should only be one-half of the maximum size of a folded sheet stack. This makes it needless for the lower tray 203 to protrude over the outermost end of the shift tray 202 and therefore readily guarantees a space for accommodating the fold roller pair 82 and lower outlet roller pair 83. This is why the lower housing wall part SBA below the lowermost position assigned to the shift tray 202 protrudes sideways from the housing side wall SBA. Consequently, the folding mechanism with the sufficient folding function can be arranged in the lower portion of the finisher PD without increasing the vertical projection area.

Moreover, the shift tray 202 can move over a broad range extending from a position just above the outlet for a folded sheet stack to a position just below the outlet adjoining the outlet roller pair 6. Therefore, the shift tray 202 and lower tray 203 can be loaded with a large number of sheets each.

As stated above, in the illustrative embodiment, the staple tray F is sharply inclined to minimize the angle between it and the fold tray G while the folding mechanist is arranged between the trays F and G. A sheet stack is positioned and stapled on the staple tray F at the edge or the center and then folded, when stapled at the center, by the folding section. The stapling operation and folding operation can be effected in parallel. The illustrative embodiment therefore solves all the problems with the conventional sheet finisher, i.e., limitations on function, low productivity and bulky construction and thereby realizes a space-saving, highly productive sheet finisher.

The edge stapler S1 and center staplers S2 are configured independently of each other, so that either one of them suitable for desired processing is always positioned in the vicinity of the location where the jogger fences 53 positions a sheet. This successfully reduces the overall processing time necessary for positioning and stapling and therefore enhances productivity. In addition, the belt 52 and hook 52*a* thereof can freely move a sheet stack to either one of the upstream side and downstream side, implementing delicate adjustment of the stapling position.

The center stapling on the staple tray F and folding are executed at independent stations, so that sheets to be dealt with by the next job can be positioned when folding, which consumes a relatively long period of time, is under way. This is expected to remarkably enhance productivity.

A conventional staple tray can be sufficiently guaranteed for the maximum sheet length, insuring high-quality stapling.

The turning portion with a small radius R implemented by the guides 54 and 55 and discharge roller 56 promotes smooth steering and conveyance of a sheet stack and therefore further saves space.

While a sheet stack is usually conveyed only by the hook 52*a*, a strong conveying force is necessary for conveying a sheet stack when the turning portion has a small radius R as in the illustrative embodiment. In light of this, in the illustrative embodiment, the discharge roller 56 in rotation plays the role of a guide and exerts a conveying force on a sheet stack. At this instant, resistance to conveyance is reduced because the guide is rotating in the direction of conveyance.

The guides 54 and 55 capable of selectively steering sheets toward the shift tray 202 or the fold tray G are positioned downstream of the staple tray F. Therefore, the illustrative embodiment can meet user's various needs, e.g., it can simply staple or fold sheets at the center and then discharge it. When it is desired to simply staple sheet at the center, the guides 54 and 55 are closed, as shown in FIG. 25, to unblock the path on the fold tray G side. In this condition, a single sheet is delivered from the staple tray F and then folded by the fold plate 74 and fold roller pairs 81 and 82. The sheet so folded is conveyed by the lower outlet roller pair 83 to the lower tray 203. Such a procedure may be repeated to stack sheets folded one by one on the lower tray 203.

An alternative embodiment of the illustrative embodiment will be described with reference to FIGS. 32 through 35. The illustrative embodiment is essentially similar in construction and operation to the previous embodiment except for the following.

As shown FIGS. 32 through 35, in the sheet stack steering mechanism of the illustrative embodiment, the movable guide 55 is mounted on the shaft of the discharge roller 56 together with a driven pulley 171*b* such that the guide 55 and driven pulley 171*b* are angularly movable together. A timing belt 171*c* is passed over the driven pulley 171*b* and a drive pulley 171*a* mounted on the output shaft of a movable guide motor 171. A movable guide HP sensor 337 senses the guide surface 55*b* of the movable guide 55 when the guide surface portion 55*b* is brought to its home position. The stop position of the movable guide 55 is controlled by using the home position as a reference on the basis of the drive pulses of the movable guide motor 171.

A guide plate HP sensor 315 senses the interrupter portion 61*c* of the cam 61 to thereby determine the home position of the cam 61. The stop position of the cam 61 is controlled by using the home position as a reference by counting the drive pulses of the steer motor 161. The amount of opening of the guide plate 54 is determined on the basis of the stop position of the cam 61, i.e., drive pulses input to the steer motor 161. The distance between the discharge roller 56 and the press roller 57 can be freely set in accordance with the amount of opening set. This control will be described more specifically later.

Figure 33:
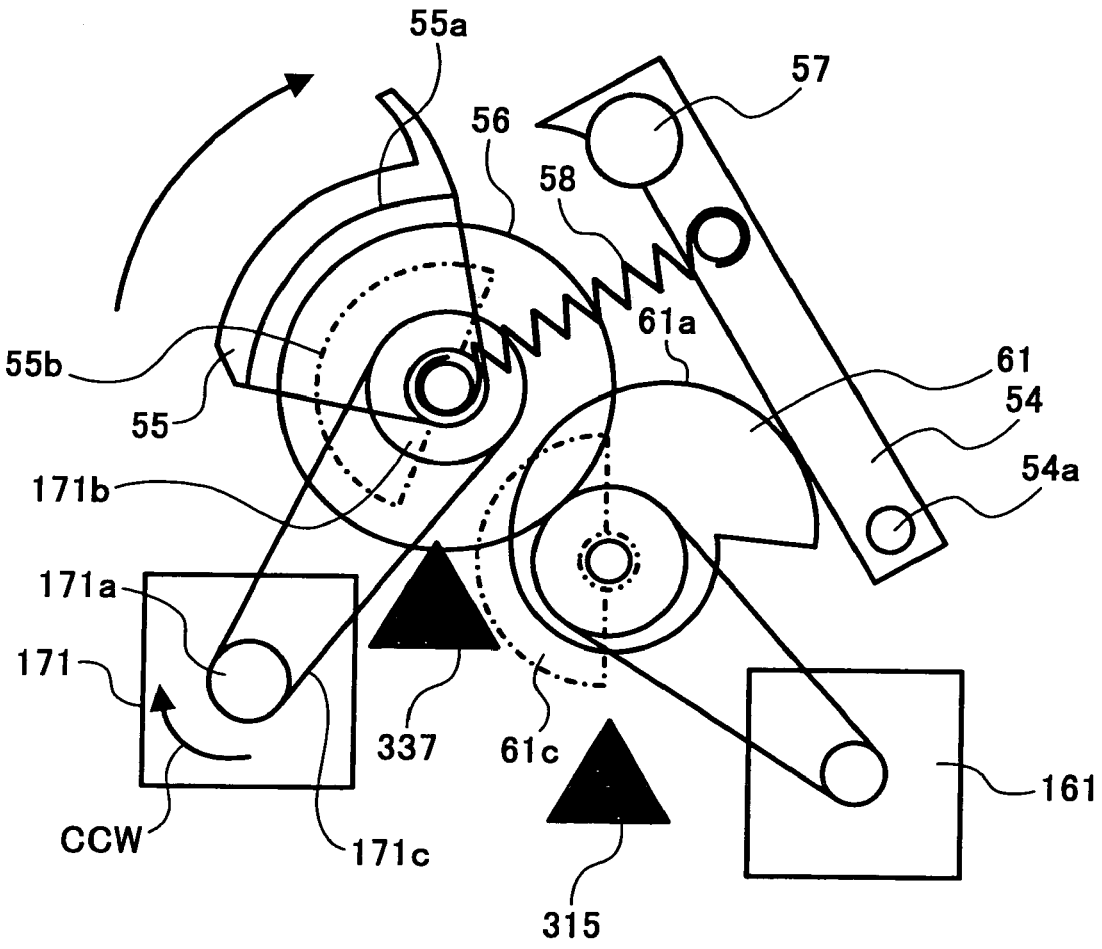

FIG. 33 shows a condition wherein the movable guide motor 171 is rotated to bring the movable guide 55 to the position for conveying a sheet stack toward the fold tray G. At this instant, the guide plate 54 is still held in its home position.

Figure 34:
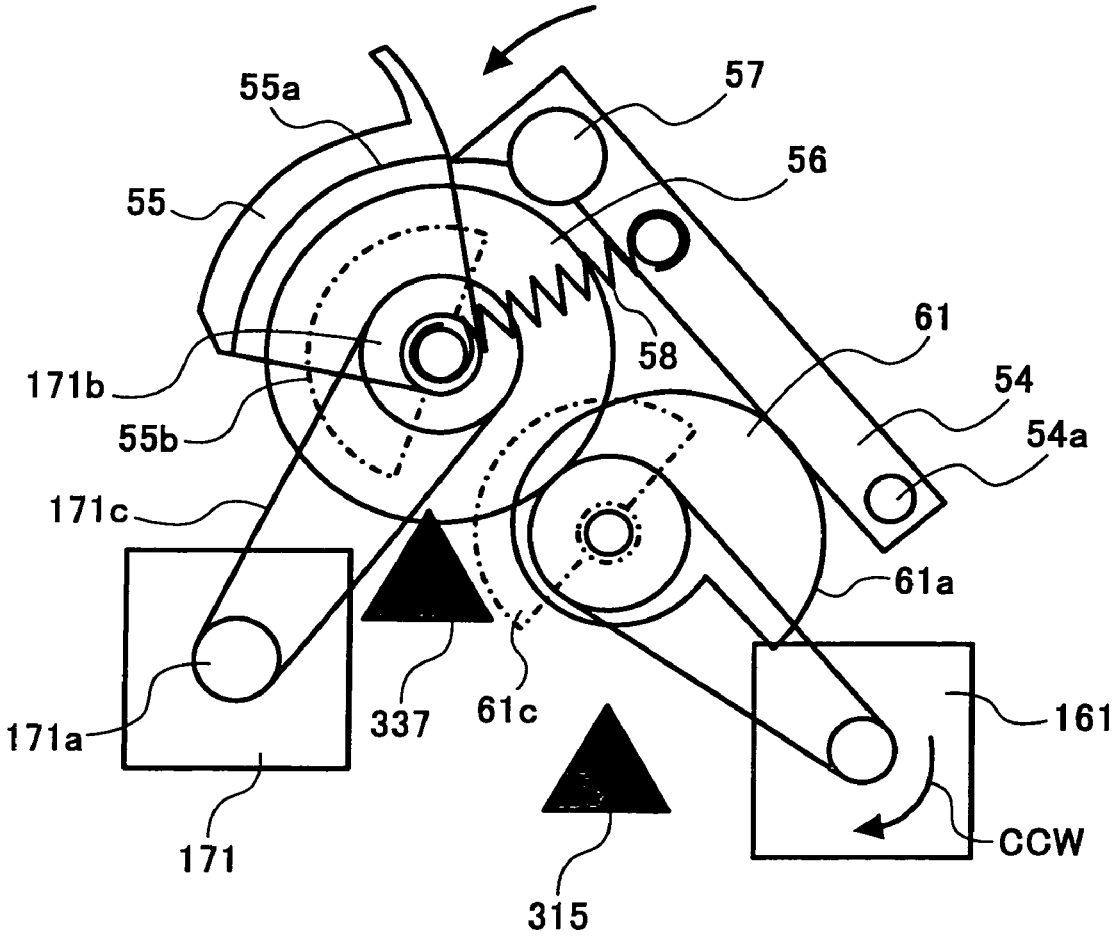

FIG. 34 shows a condition wherein the steer motor 161 is rotated from its home position by a preselected number of drive pulses so as to rotate the cam 61 by a preselected amount. As shown, the guide plate 54 is angularly moved counterclockwise, as seen in FIG. 34, to a position where the press roller 57 adjoins the discharge roller 56 at a preselected distance. In this condition, a sheet stack is conveyed to the gap between the movable guide 55 and the discharge roller 56 via the gap between the press roller 57 and the discharge roller 56. More specifically, a path for conveying a sheet stack discharged from the staple tray F toward the fold tray G is formed between the guide plate. 54 and movable guide 55 and the discharge roller 56.

Figure 35:
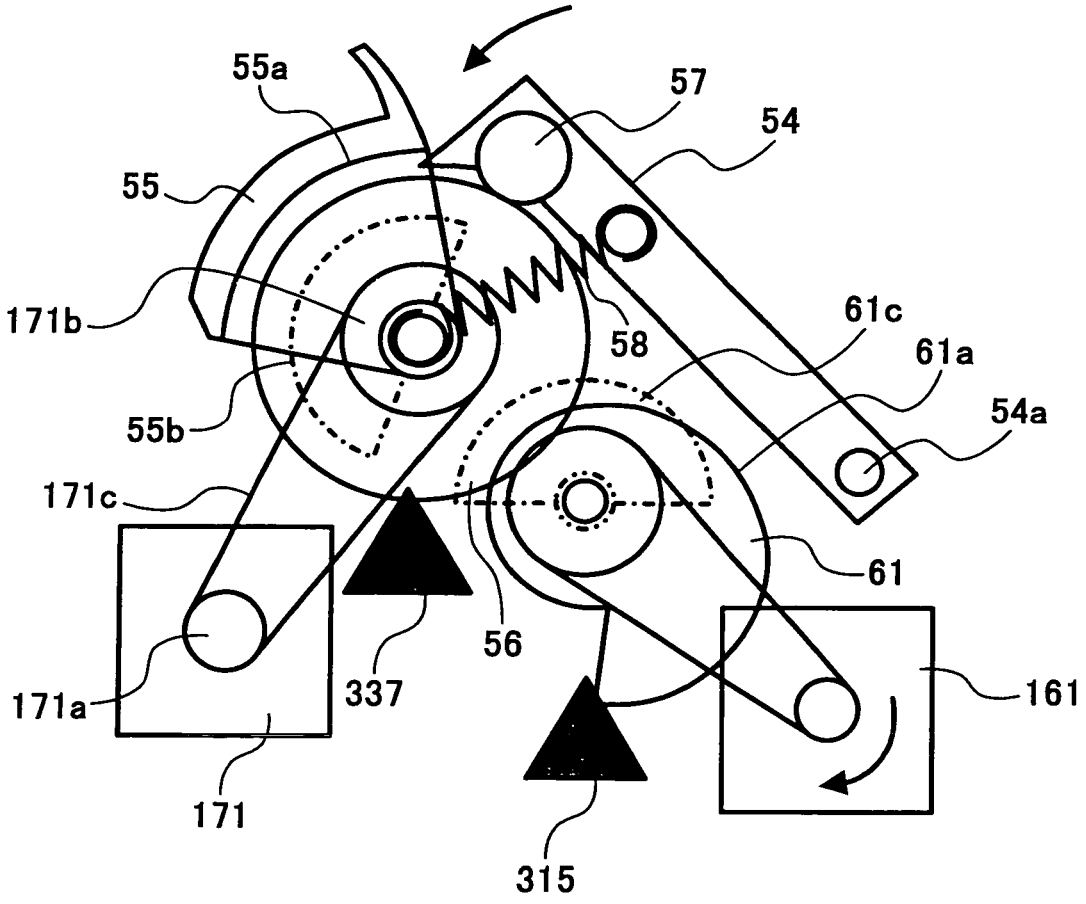
FIG. 35 is a view showing the operation of a mechanism included in the alternative embodiment for moving the fold plate.

FIG. 35 shows a condition wherein the cam 61 is further rotated to further rotate the guide plate 54 counterclockwise, thereby pressing the press roller 57 against the discharge roller 56. The pressure of the press roller 57 to act on the discharge roller 56 is determined by the biasing force of the spring 58.

Figure 32:
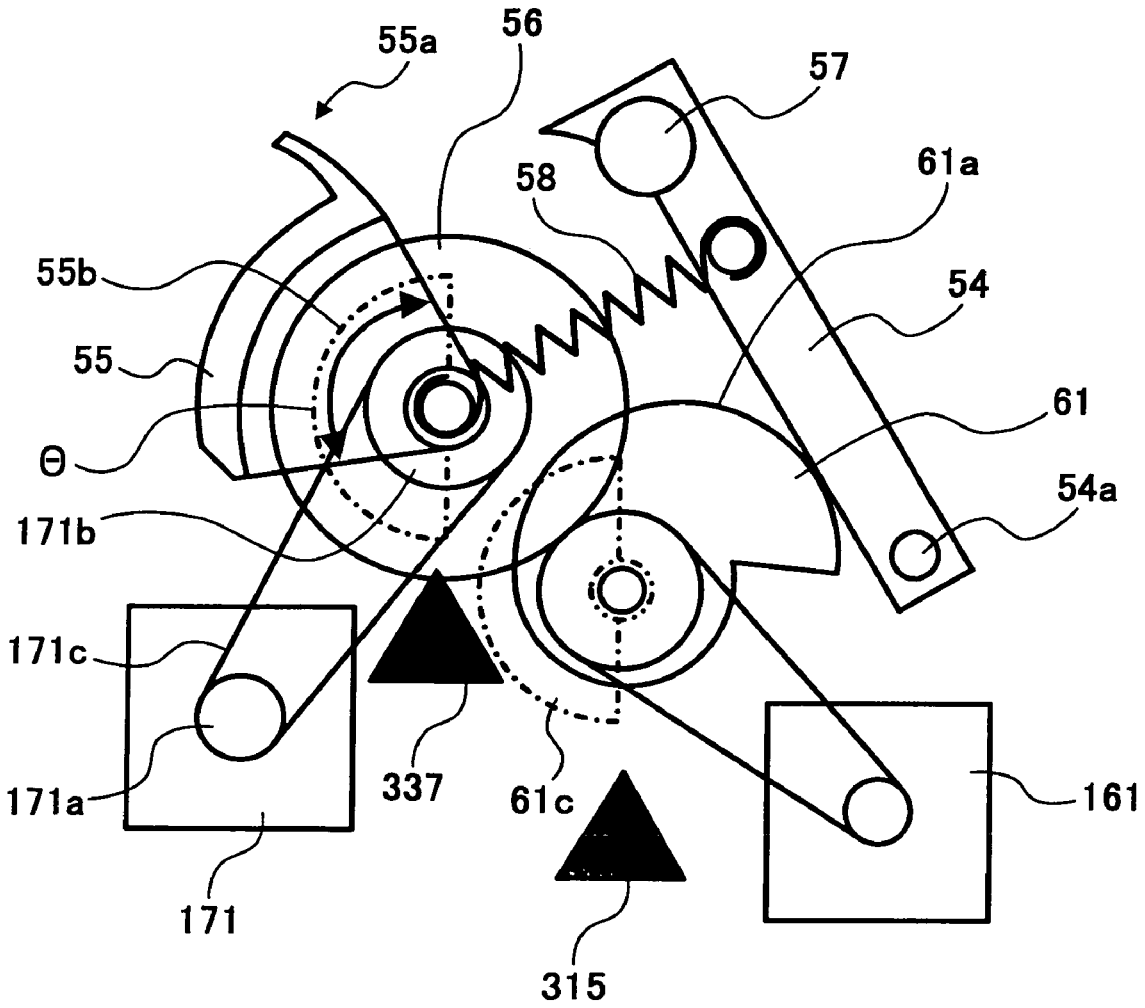
FIGS. 32 through 34 are views demonstrating the consecutive operating conditions of a sheet stack steering mechanism representative of an alternative embodiment of the present invention.

In the condition shown in FIG. 32, a sheet stack positioned and stapled on the staple tray F is introduced into the path C terminating at the shift tray 202. In the conditions shown in FIGS. 34 and 35, the sheet stack can be conveyed to the path extending to the fold tray G. Also, in the condition of FIG. 35 the guide surface 55*a* of the movable guide 55 can block the space in which the guide 55 is movable, allowing the sheet stack to be smoothly delivered to the fold tray G. In this manner, the guide plate and movable guide 55 are sequentially moved in this order while overlapping each other, forming a smooth path for conveyance.

The press roller 57 spaced from the discharge roller 56, as shown in FIG. 34, may be pressed against the sheet stack just after the sheet stack has moved past the press roller 57 by a preselected distance, as will be described specifically later. Such control over the press roller 57 successfully reduces a load to act on the sheet stack and therefore insures sure steering by freeing the leading edge of the sheet stack from disturbance, i.e., by reducing the probability of a jam around the discharge roller 56.

While the illustrative embodiment drives each of the guide plate 54 and movable plate 55 with a particular motor, a cam, link or similar drive transmission mechanism may also be assigned to the movable guide 55 to allow the guides 54 and 55 to share a single motor, if desired.

Figure 22A:
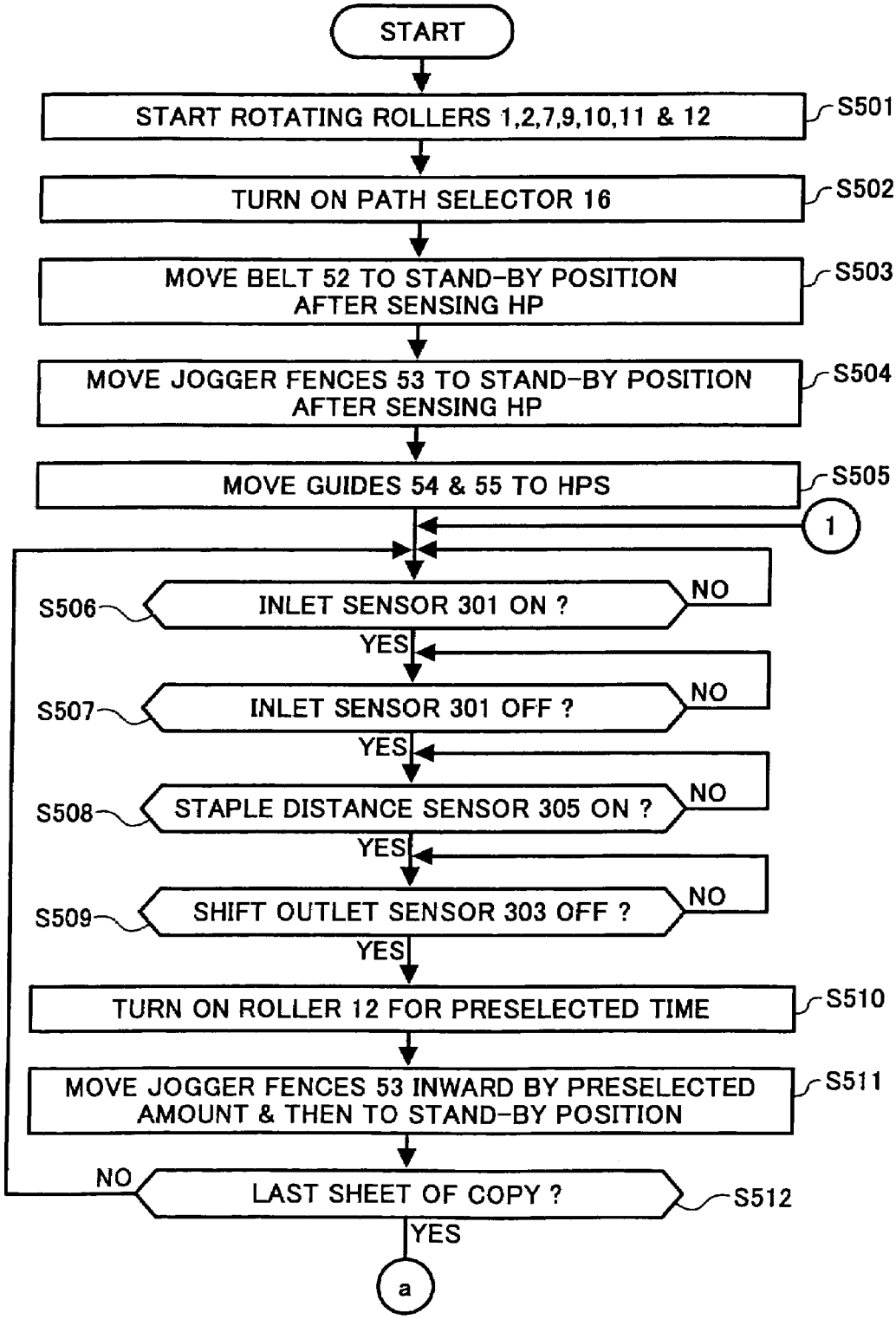
FIGS. 22A through 22C are flowcharts demonstrating a center staple mode and fold mode available with the sheet finisher.
Figure 22B:
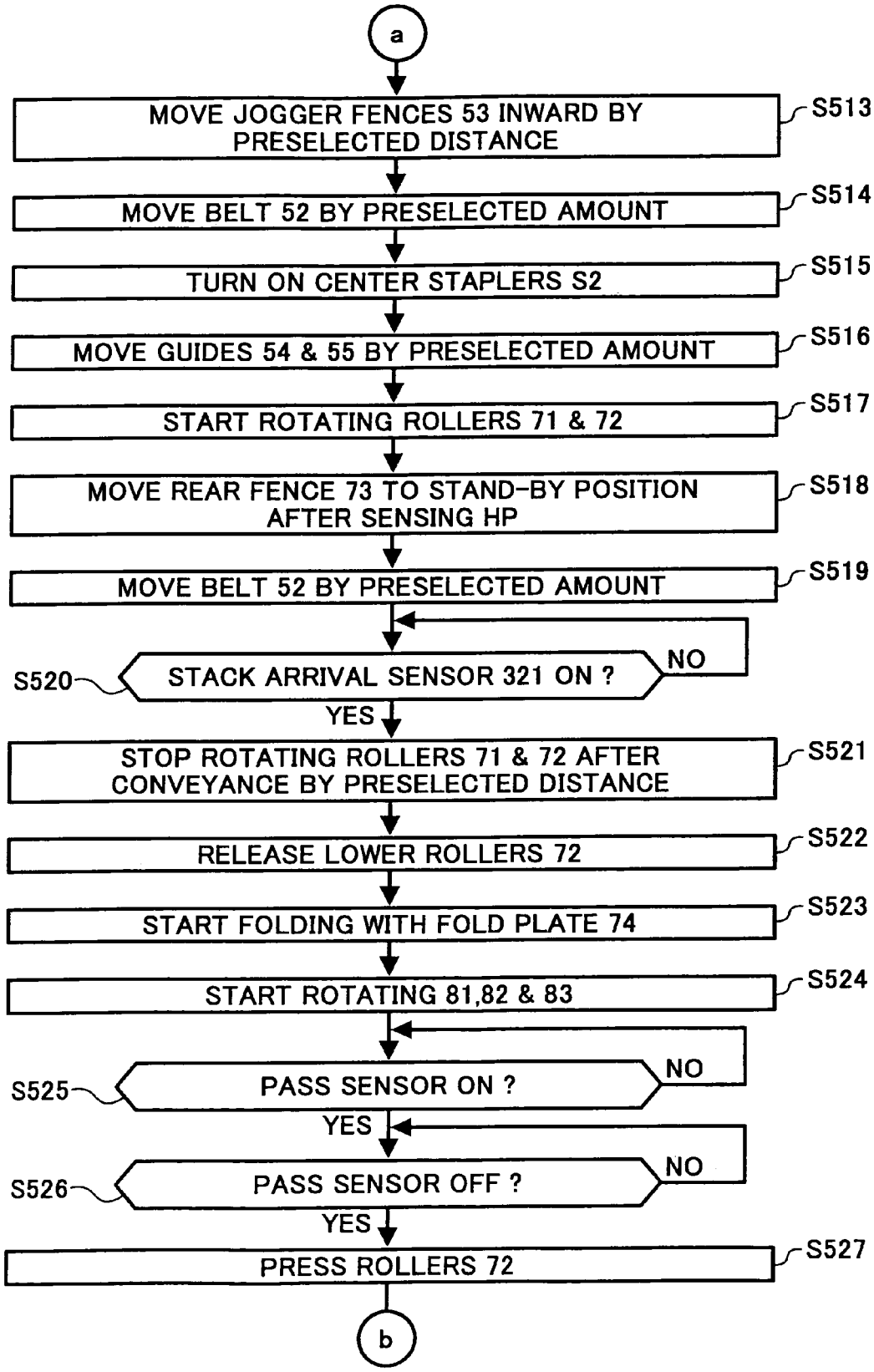
Figure 22C:
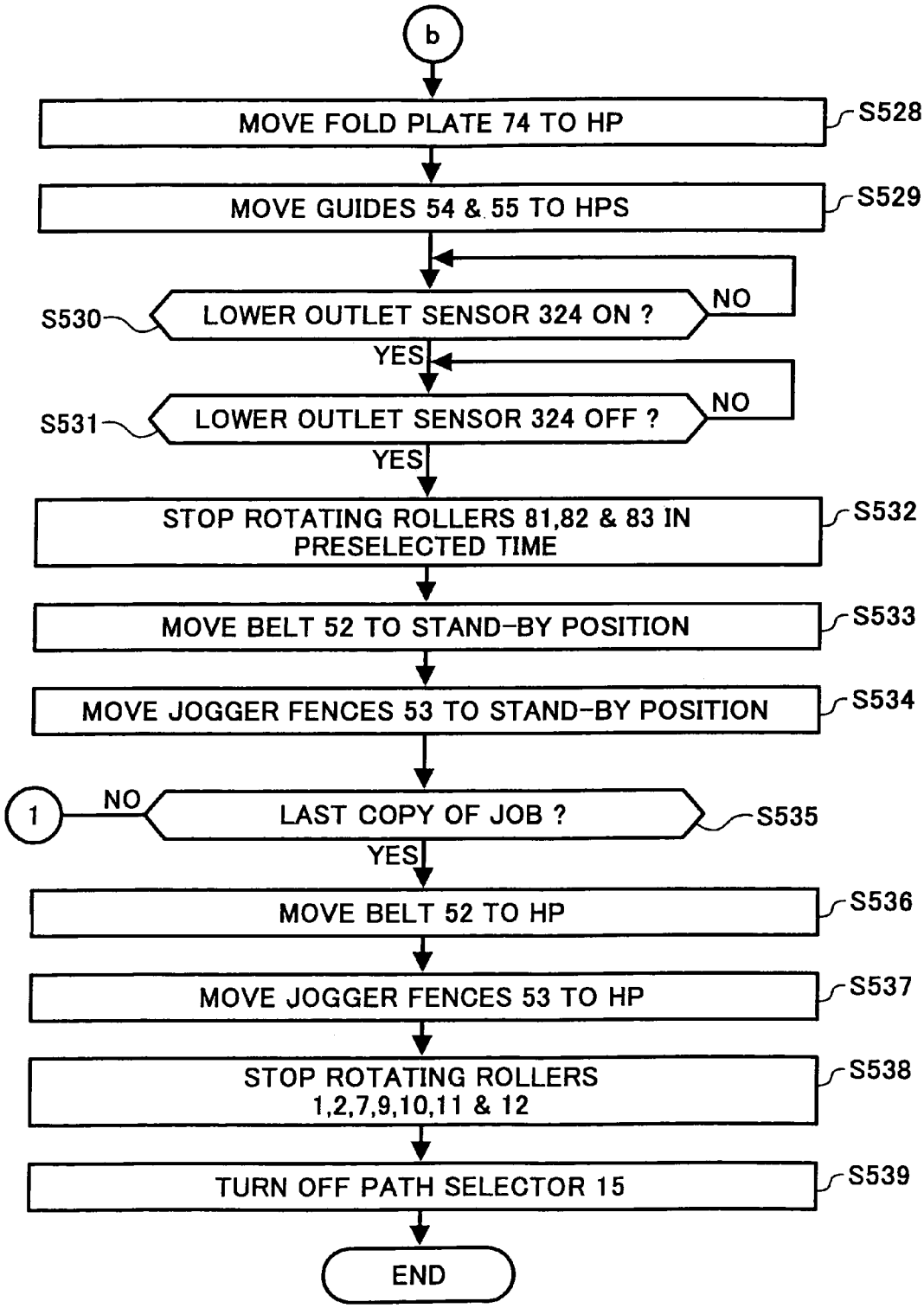
Figure 36:
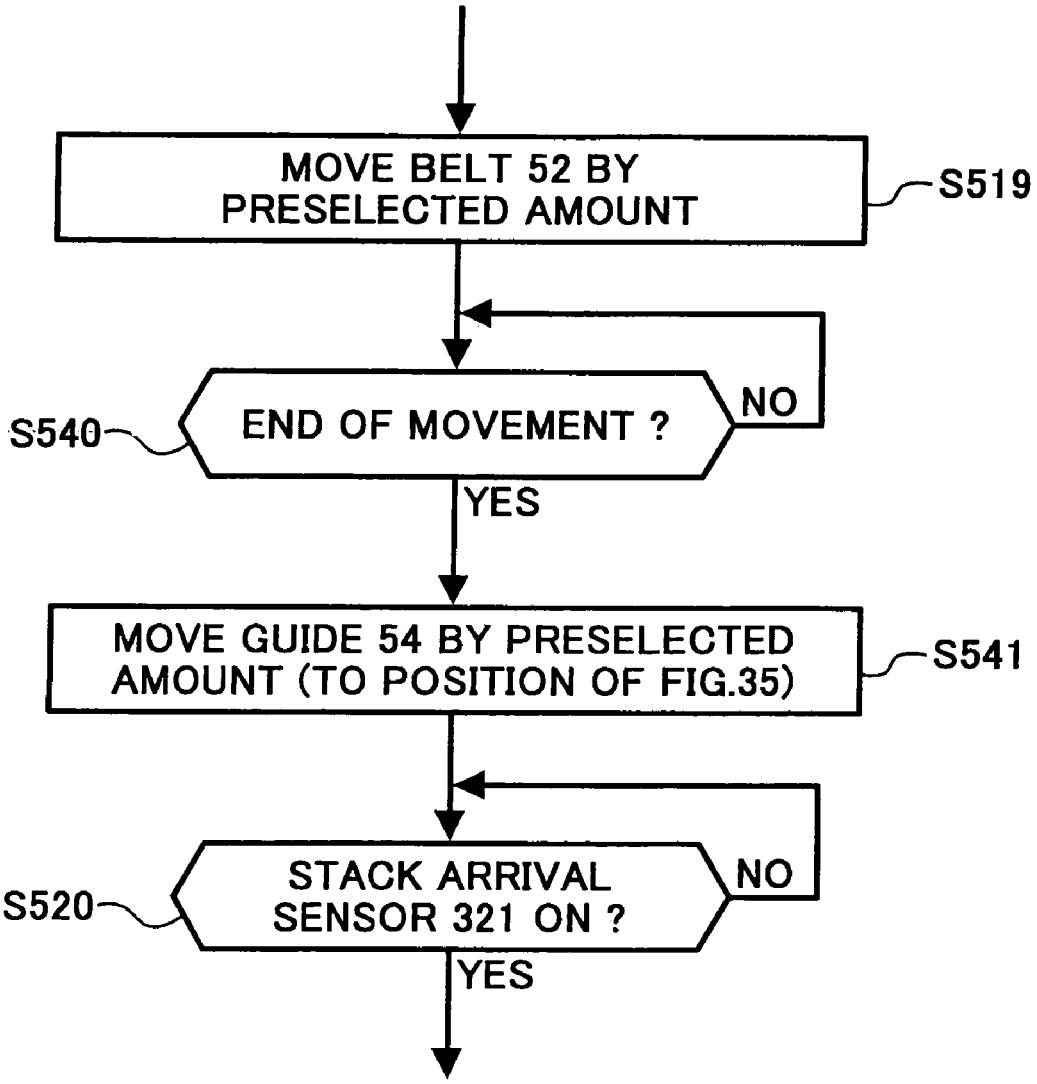
FIG. 36 shows a condition wherein a sheet stack is positioned on the staple tray in the center staple and fold mode in the alternative embodiment.

The center staple mode of the illustrative embodiment differs from the center staple mode of the previous embodiment described with reference to FIGS. 22A through 22C in the following respect. As shown in FIG. 36, in the illustrative embodiment, steps S540 and S541 are additionally provided between the steps S519 and S520. After the belt 52 has been moved by a preselected distance (YES, step S640), the guide plate 54 is moved by a preselected amount to the position shown in FIG. 35 (step S41).

Figure 37:
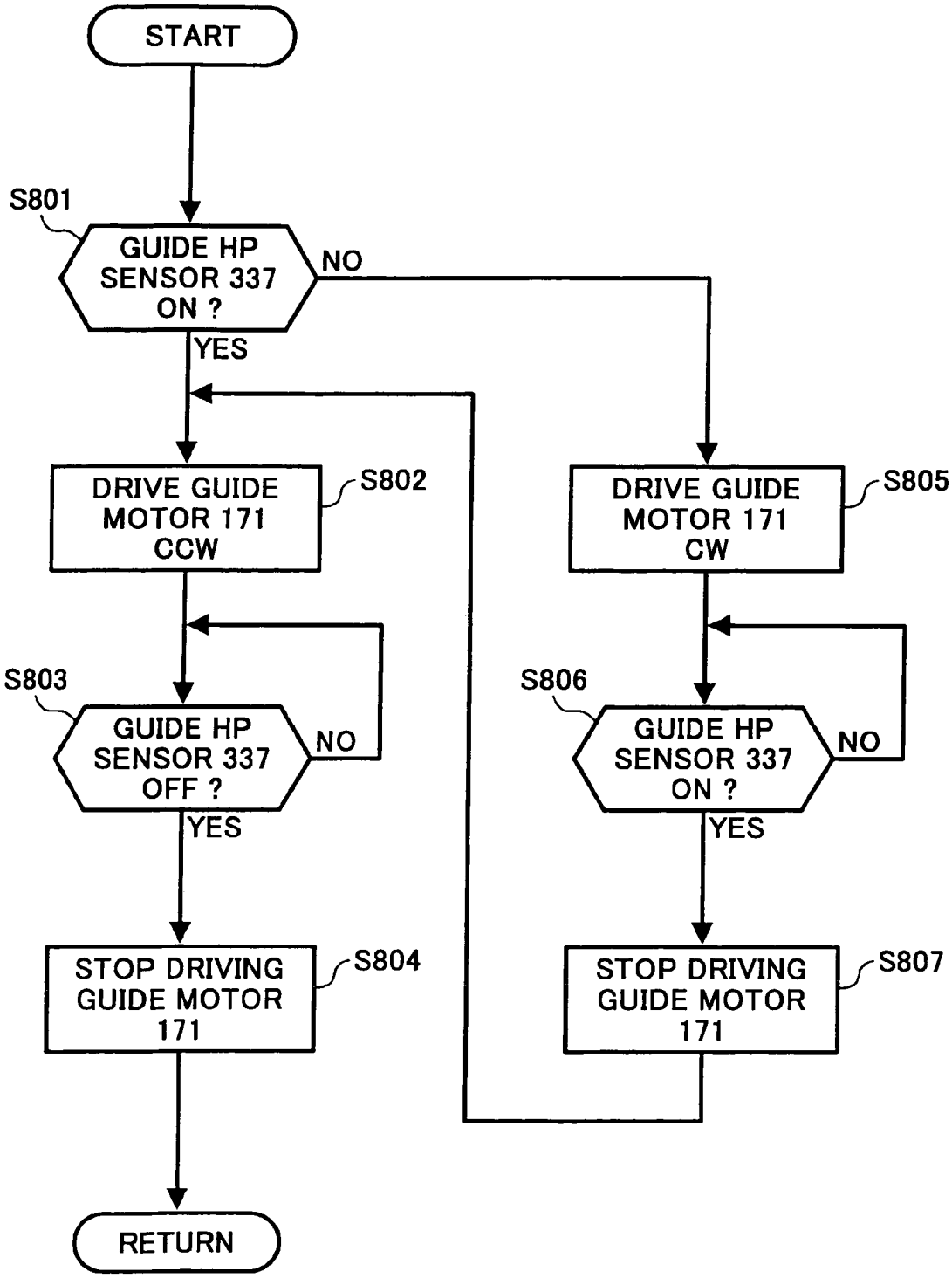
FIG. 37 is a flowchart demonstrating a procedure for initializing a movable guide included in the alternative embodiment.

Control over the steering mechanism and the movement of the belt 52 unique to the illustrative embodiment will be described hereinafter. FIG. 37 demonstrates control to be executed by the CPU. 360 over the steering mechanism and cam 61, guide plate 54 and movable guide 55 in relation to the conditions shown in FIGS. 32 through 35. As shown, the CPU 360 first determines whether or not the movable guide HP sensor 337 responsive to the interrupter portion 55*b* of the movable guide 55 is in an ON state (step S801). If the answer of the step S801 is YES, then the CPU 360 causes the movable guide motor 171 to rotate counterclockwise (corresponding to the arrow in FIG. 33) (step S802). Subsequently, when the movable guide HP sensor 337 turns off (YES, step S803), the CPU 360 stops driving the movable guide motor 171 (step S804). This condition is shown in FIG. 32.

If the answer of the step S801 is NO, meaning that the movable guide HP sensor 337 is in an OFF state, then the CPU 360 rotates the movable guide motor 171 clockwise (opposite to the direction of arrow in FIG. 33) (step S805). As soon as the sensor 337 turns on (YES, step S806), the CPU 360 stops driving the motor 171 (step S807) and then drives it counterclockwise (step S802). This is followed by the steps S803 through S804, so that the movable guide 55 is located at the initial position.

Figure 38:
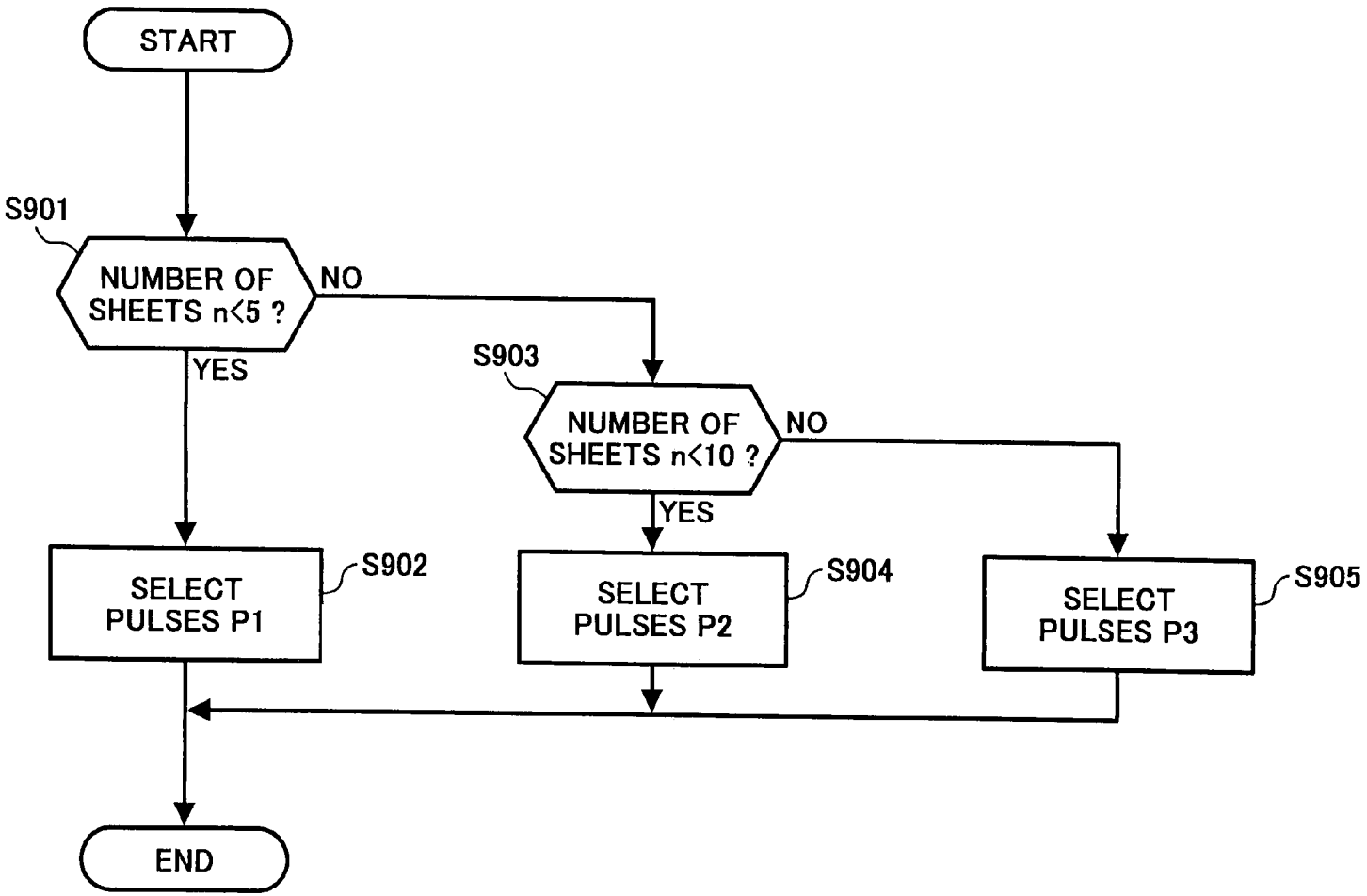
FIG. 38 is a flowchart demonstrating a procedure for determining the number of sheets.

The stapling operation and folding operation effected in the center staple mode available with the illustrative embodiment will be described hereinafter. In this mode, the movable guide 55 is angularly moved to steer a sheet stack to the downstream path while the guide plate 54 is closed by a preselected amount to cause the press roller 57 to adjoin the discharge roller 56 at a small distance, as stated earlier with reference to FIG. 25. In the illustrative embodiment, the small distance is variable stepwise in accordance with the number of sheets and smaller than the thickness of a sheet stack. For example, as shown in FIG. 38, the CPU 360 first determines whether or not the number of sheets n included in a stack is smaller than five (step S901). If the answer of the step S901 is NO, then the CPU 360 determines whether or not the number of sheets n is smaller than 10 (step S403). Motor drive pulses P1, P2 and P3 are set such that the above small distance is zero when the number n is two to four (step S902) or 0.5 mm when the number n is five to nine (step S904) or 1 mm when the number n is ten or above.

Subsequently, a stapled sheet stack starts being moved to the downstream side. As soon as the leading edge of the sheet stack moves away from the nip between the press roller 57 and the discharge roller 55, the CPU 360 further closes the guide plate 54 until the press roller 57 contacts the discharge roller 56. This closing timing is controlled on the basis of the drive pulses of the discharge motor 157 preselected on a sheet size basis, so that the pass distance is identical throughout all the sheet sizes.

For example, assume that the distance by which the belt 52 with the hook 52*a* moves from the HP sensor 311 to the roller pair 56 and 57 is L1, that the preselected pass distance is 5 mm, and that the distance by which the hook 52*a* moves from the HP sensor 311 to the trailing edge of a sheet being stacked is Lh. Then, the operation timing is determined by the distance Ln by which the hook 52*a* has moved from the HP sensor 311 and controlled in terms of the number of pulses. Assuming that the sheet length is Lp, then the distance Ln is produced by:

$$Ln = L1 - Lh - Lp + 5 \text{ mm}$$

Figure 39:
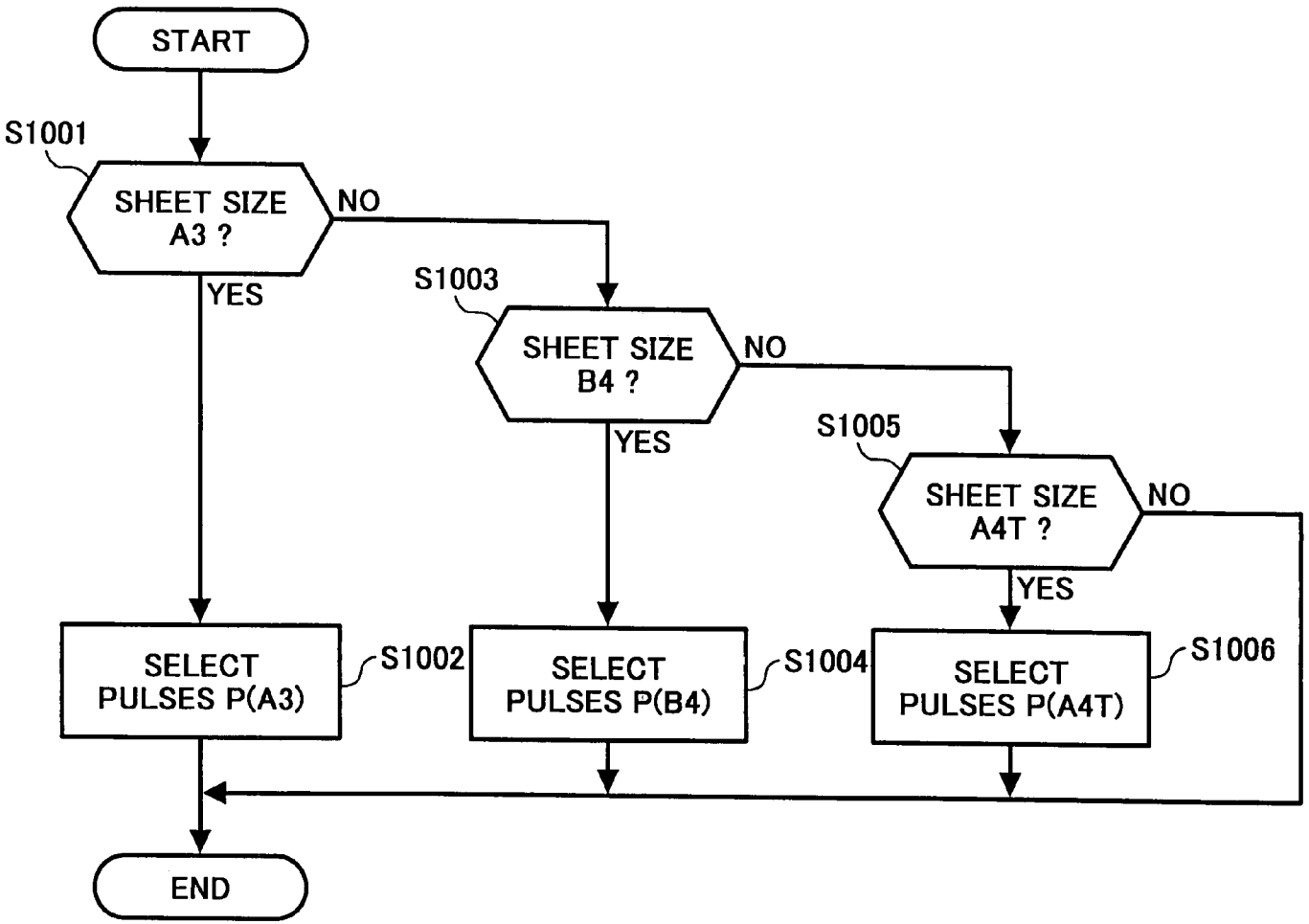
FIG. 39 is a flowchart demonstrating a procedure for determining a sheet size.

A particular number of pulses are assigned to each sheet size. As shown in FIG. 39, size checking steps S1001, S1003 and S1005 and pulse setting steps S1002, S1004 and S1006 are selectively executed in accordance with the sheet size, so that the press roller 57 can press a sheet size at the same timing without regard to the sheet size.

While the illustrative embodiment executes control based on the output of the HP sensor 311, sensing means responsive to the leading edge of a sheet stack may be located in the vicinity of the roller pair 56 and 57. In such a case, the control can be executed without resorting to size information output from the image forming apparatus.

Another alternative embodiment of the present invention will be described hereinafter. This embodiment is also similar to the embodiment described first except for the following.

Figure 40A:
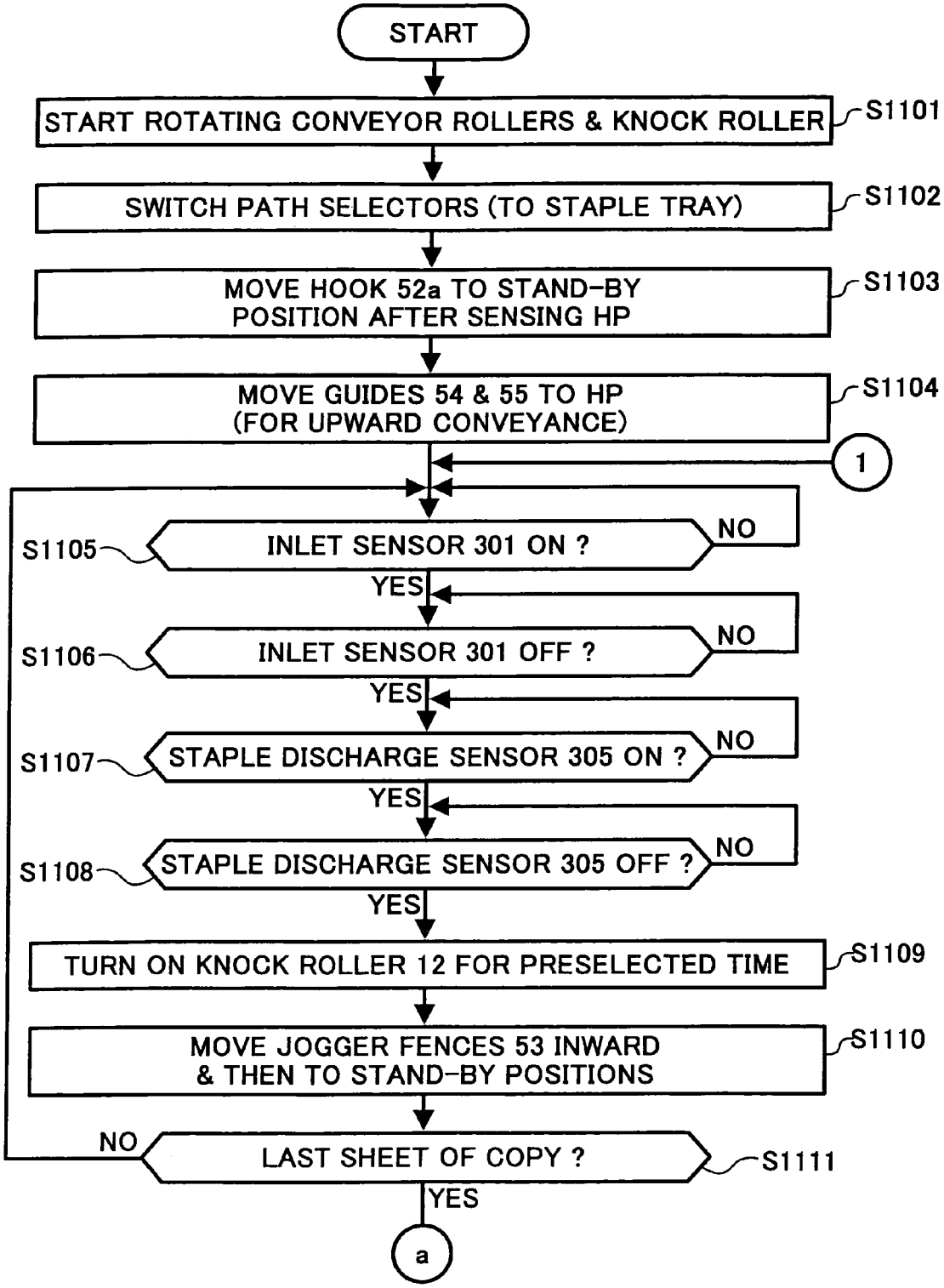
FIGS. 40A through 40C are flowcharts showing the operation of another alternative embodiment of the present invention in the center staple and fold mode.
Figure 40B:
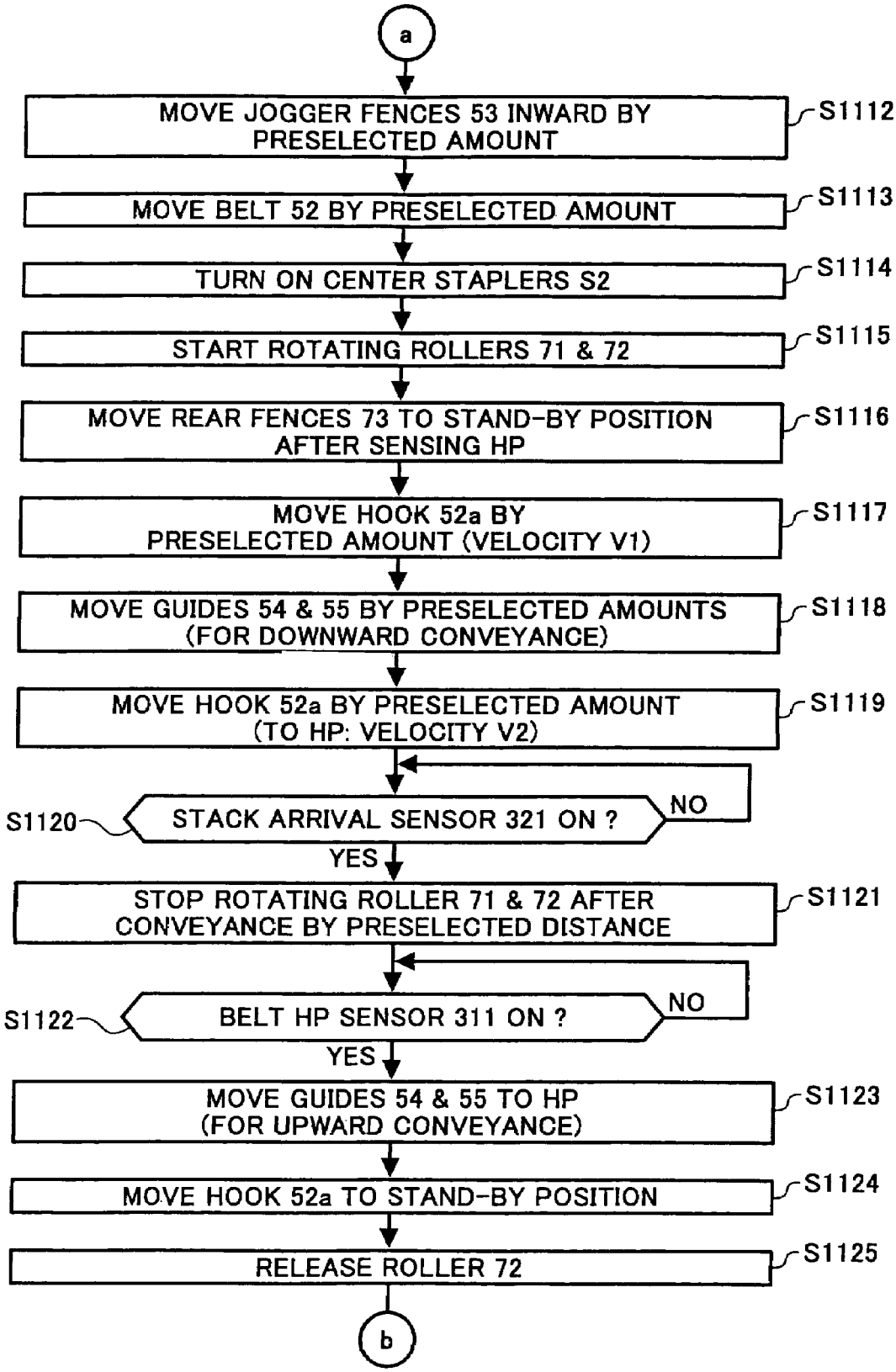
Figure 40C:
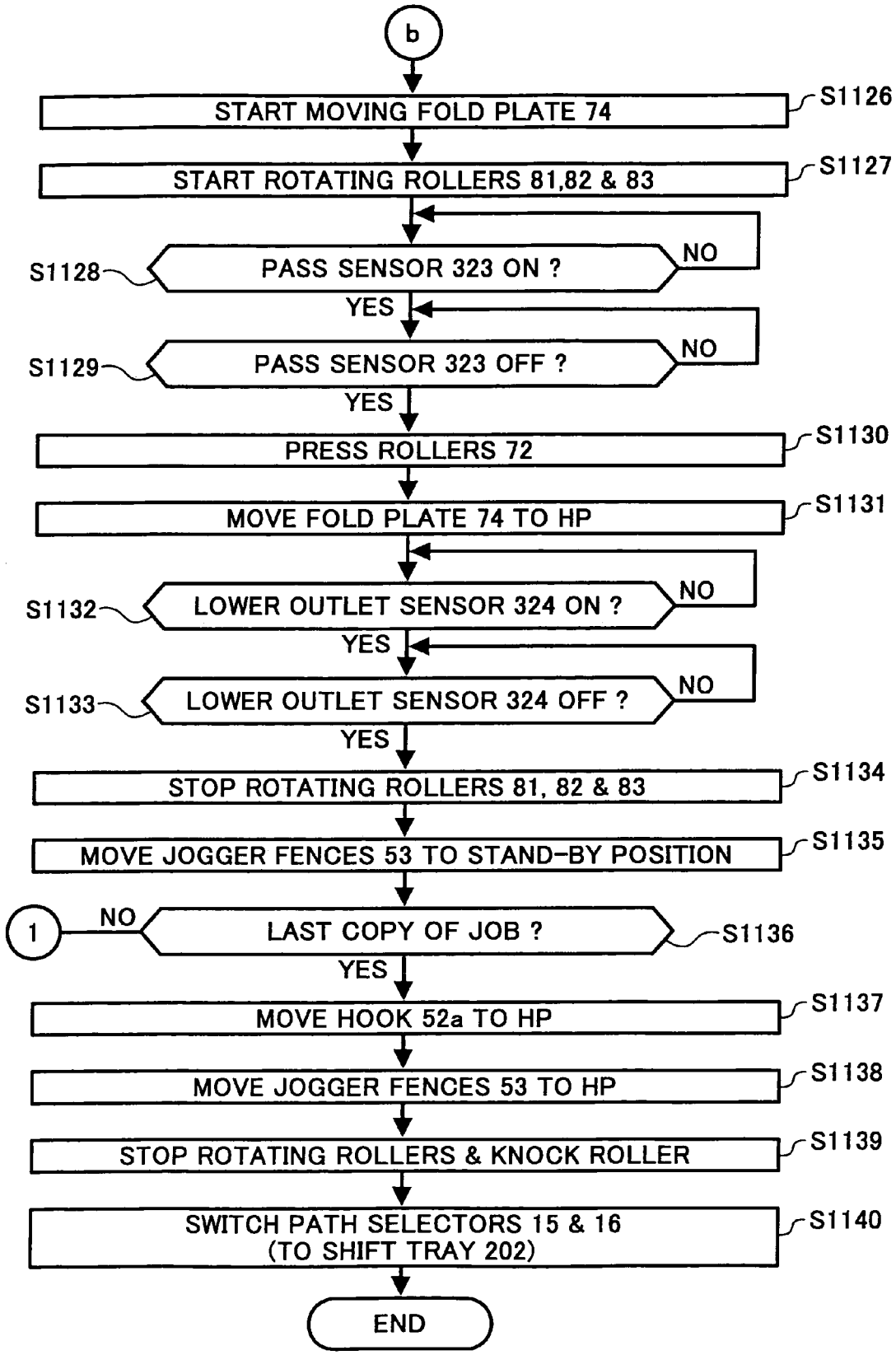

Reference will be made to FIGS. 40A through 40C for describing a center staple and bind mode unique to the illustrative embodiment. As shown, before a sheet is handed over from the image forming apparatus PR to the finisher PD, the CPU 360 causes the inlet roller pair 1 and conveyor roller pair 2 on the path A, conveyor roller pairs 7, 9 and 10 on the path D, staple discharge roller pair 11 and knock roller 12 on the staple tray F to start rotating (step S1101). At the same time, the CPU 360 switches the path selectors 15 and 16 to unblock the path D extending toward the staple tray F (step S1102).

On determining the position of the belt 52 in response to the output of the belt HP sensor 311, the CPU 360 moves the belt 52 to the stand-by position via the discharge motor 157 (step S1103). Also, on determining the positions of the jogger fences 53 in response to the output of the jogger fence HP sensor, the CPU 360 moves the jogger fences 53 to the stand-by positions. Further, the CPU 360 moves the guide plate 54 and movable guide 55 to their home positions where they steer a sheet stack toward the path C (step S1104).

The inlet sensor 301 turns on and then turns off (YES, steps S1105 and S1106), and the staple discharge sensor 305 turns on and then turns off (YES, step S1107 and S1008), meaning that a sheet is present on the staple tray F. Then, the CPU 360 energizes the knock solenoid 170 to cause the knock roller 12 to contact the sheet and force it toward the rear fence 51 for thereby positioning the trailing edge of the sheet (step S1109). Subsequently, the CPU 360 moves the jogger fences 53 inward by a preselected amount via the jogger motor 158 so as to position the sheet in the direction of width and then returns the jogger fences 53 to the stand-by positions (step S1110). The steps S1105 through S1110 are repeated for every sheet.

When the last sheet of a copy arrives at the staple tray F (YES, step S1111), the CPU 360 moves the jogger fences 53 inward by a preselected amount to thereby prevent the edges of the sheets from being shifted (step S1112). This condition is shown in FIG. 23. The CPU 360 then further moves the belt 52 by a preselected amount (step S1113) until the stapling position of the sheet stack coincides with the stapling position of the center staplers S2. Subsequently, the CPU 360 turns on the motor assigned to the center staplers S2 to thereby staple the sheet stack at the center (step S1114). This condition is shown in FIG. 24. The CPU 360 then causes the upper and lower roller pairs 71 and 72 to start rotating (step S1115), checks the home position of the movable rear fence 73, and then moves the rear fence 73 to the home position (step S1116).

Figure 41:
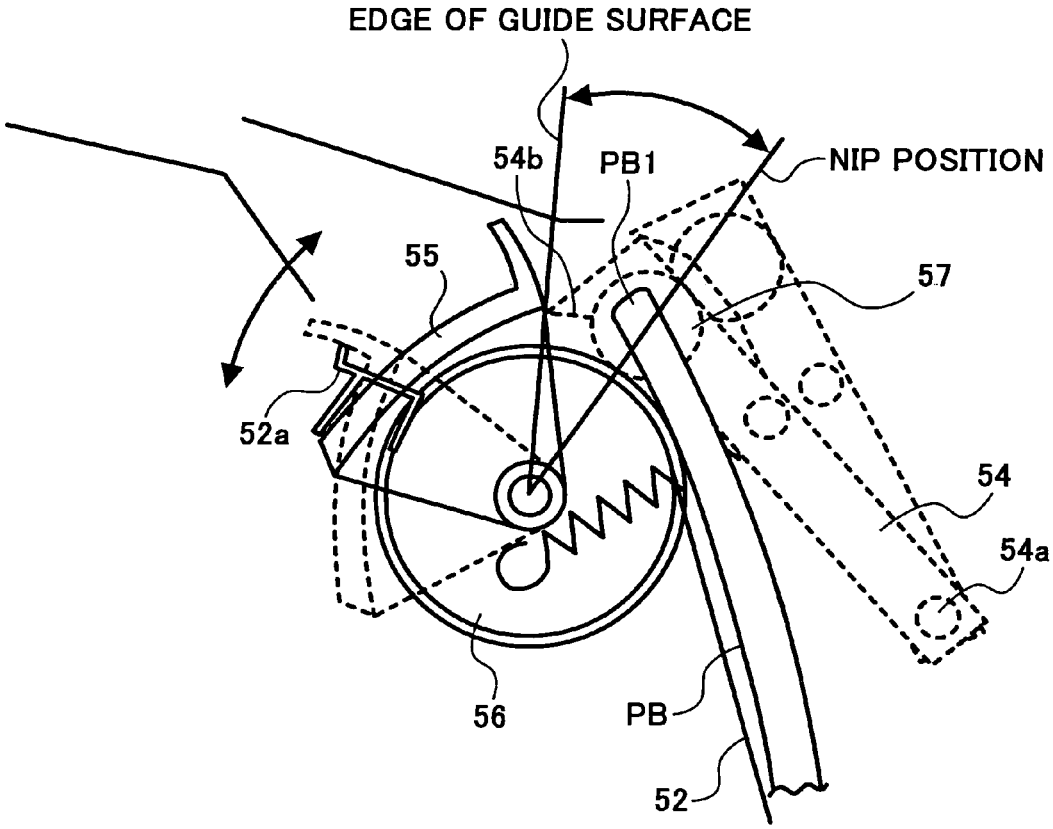
FIG. 41 shows a relation between a guide plate and a movable guide included in the embodiment of FIGS. 40A through 40C and the leading edge of a sheet stack.

As shown in FIG. 41, the hook 52*a* conveys the sheet stack to the downstream side by a preselected size-by-size distance at a preselected velocity V1 until the leading edge PB1 of the stapled sheet stack reaches a position shown in FIG. 41, and then once stops it (step S1117). At this position, the leading edge PB1 has moved away from the nip between the discharge roller 56 and the press roller 57, but is positioned short of the guide surface 54*b* of the guide plate 54. Such a distance of movement is controlled on the basis of the drive pulses input to the discharge motor 157. Subsequently, the CPU 360 causes the guide plate 54 and movable guide 55 to move to the positions for conveying the sheet stack toward the fold tray G, as shown in FIGS. 11 and 12 (step S1116). Thereafter, as shown in FIG. 25, the leading edge PB1 of the sheet stack is nipped by the discharge roller 56 and press roller 57 and again conveyed by the hook 52*a* and discharge roller 56 downward along the path formed by the guide plate 54 and movable guide 55 at a preselected velocity V2 (V1<V2) As a result, the sheet stack is conveyed to the fold tray G.

When the leading edge of the sheet stack arrives at the stack arrival, sensor 321 (YES, step 1120) and is then conveyed by a preselected distance, the CPU 360 causes the upper and lower roller pairs 71 and 72 to stop rotating (step S1121). When the belt HP sensor 311 turns on (YES, step S1122), the CPU 360 causes the guide plate 54 and movable guide 55 to move to their home positions for conveying the sheet stack toward the path C (step S1123). The CPU 360 then causes the belt 52 to move until the hook 52*a* reaches the stand-by position (step S1124). this condition is shown in FIG. 26. Subsequently, the CPU 360 releases the rollers of the lower roller pair 71 from each other (step S1125), as shown in FIG. 27. Thereafter, the CPU 360 causes the fold plate 74 to start folding the sheet stack (step S1126), as shown in FIG. 28, and causes the fold roller pairs 81 and 82 and lower outlet roller pair 83 to start rotating (step S1127).

When the pass sensor 323 turns on (YES, step S1128) and then turns off (YES, step S1129), meaning that the trailing edge of the sheet stack has moved away from the sensor 323, the CPU 360 causes the rollers of the lower roller pair 72 to contact each other (step S1130) and causes the fold plate 72 to move to its home position (step S1131).

Subsequently, when the lower outlet sensor 324 turns on (YES, step S1132) and then turns off (YES, step S1133), meaning that the trailing edge of the sheet stack has moved away from the sensor 324, the CPU 360 causes the fold roller pairs 81 and 82 and lower outlet roller pair 83 to stop rotating (step S1134) and causes the jogger fences 53 to move to the stand-by positions (step S1135). The CPU 360 then determines whether or not the sheet stack is the last copy of a job (step S1136). If the answer of the step S1136 is NO, then the procedure returns to the step S1105. If the answer of the step S1136 is YES, then the CPU 130 causes the hook 52*a* and jogger fences 53 to move to the respective home positions (steps S1137 and S1138), causes the inlet roller pair 1, roller pairs 2, 7, 9 and 11, staple discharge roller pair 11 and knock roller 12 to stop rotating (step S1139), and switches the path selectors 15 and 16 (step S1140) As a result, all the structural parts are returned to their initial positions.

The stapling operation and folding operation to be effected in the fold mode will be described in more detail hereinafter. A sheet conveyed from the path A to the path D via the path selectors 15 and 16 is conveyed to the staple tray F by the staple discharge roller pair 11. After the consecutive sheets have been positioned on the staple tray F in the same manner as in the staple mode (see FIG. 23), the sheet stack is conveyed to the downstream side by the preselected size-by-size distance by the hook 52*a* and then stapled at the center by the center staplers S2. The stapled sheet stack is conveyed by the hook 52*a* at the velocity V1 to the position past of the nip between the discharge roller 56 and the press roller 57, but short of the guide surface of the guide plate 54 by the size-by-size distance, as shown in FIG. 41 and then brought to a stop. This distance is controlled on the basis of the drive pulses input to the discharge motor 157.

Subsequently, as shown in FIG. 25, the leading edge PB1 of the sheet stack is nipped by the discharge roller 56 and press roller 56 and again conveyed by the hook 52*a* and discharge roller 56 to the downstream side at the velocity V2 (V1<V2). The sheet stack is then conveyed to the fold tray G via the path formed by the guide plate 54 and movable guide plate 55.

The discharge roller 56 is mounted on the drive shaft 65 associated with the belt 52 and therefore driven in synchronism with the belt 52. Subsequently, as shown in FIG. 26, the sheet stack is conveyed by the upper and lower roller pairs 71 and 72 to the movable rear fence 73, which is moved from its home position to a position matching with the sheet size beforehand and held in a stop for guiding the lower edge of the sheet stack. At this instant, as soon as the other hook 52' on the belt 52 arrives at a position close to the rear fence 51, the hook 52*a* is brought to a stop while the guides 54 and 55 are returned to the home positions to wait for the next sheet stack.

As shown in FIG. 27, the sheet stack abutted against the movable rear fence 73 is freed from the pressure of the lower roller pair 72. Subsequently, as shown in FIG. 28, the fold plate 74 pushes part of the sheet stack close to a staple toward the nip of the fold roller pair 81 substantially perpendicularly to the sheet stack. The fold roller pair 81, which is caused to rotate beforehand, conveys the sheet stack reached its nip while pressing it. As a result, the sheet stack is folded at its center.

As shown in FIG. 29, the second fold roller pair 82 positioned on the path H makes the fold of the folded sheet stack more sharp. Thereafter, the lower outlet roller pair 83 conveys the sheet stack to the lower tray 203. When the trailing edge of the sheet stack is sensed by the pass sensor 323, the fold plate 74 and movable rear fence 73 are returned to their home positions. At the same time, the lower roller pair 72 is again brought into contact to prepare for the next sheet stack. If the next job is identical in sheet size and number of sheets with the above job, then the movable rear fence 73 may be held at the stand-by position. The movable rear fence 73 is driven by a mechanism made up of the pulleys 73*a* and 73*b* and belt 73*c* passed over the pulleys 73*a* and 73*b* and supporting the rear fence 73.

Figure 42:
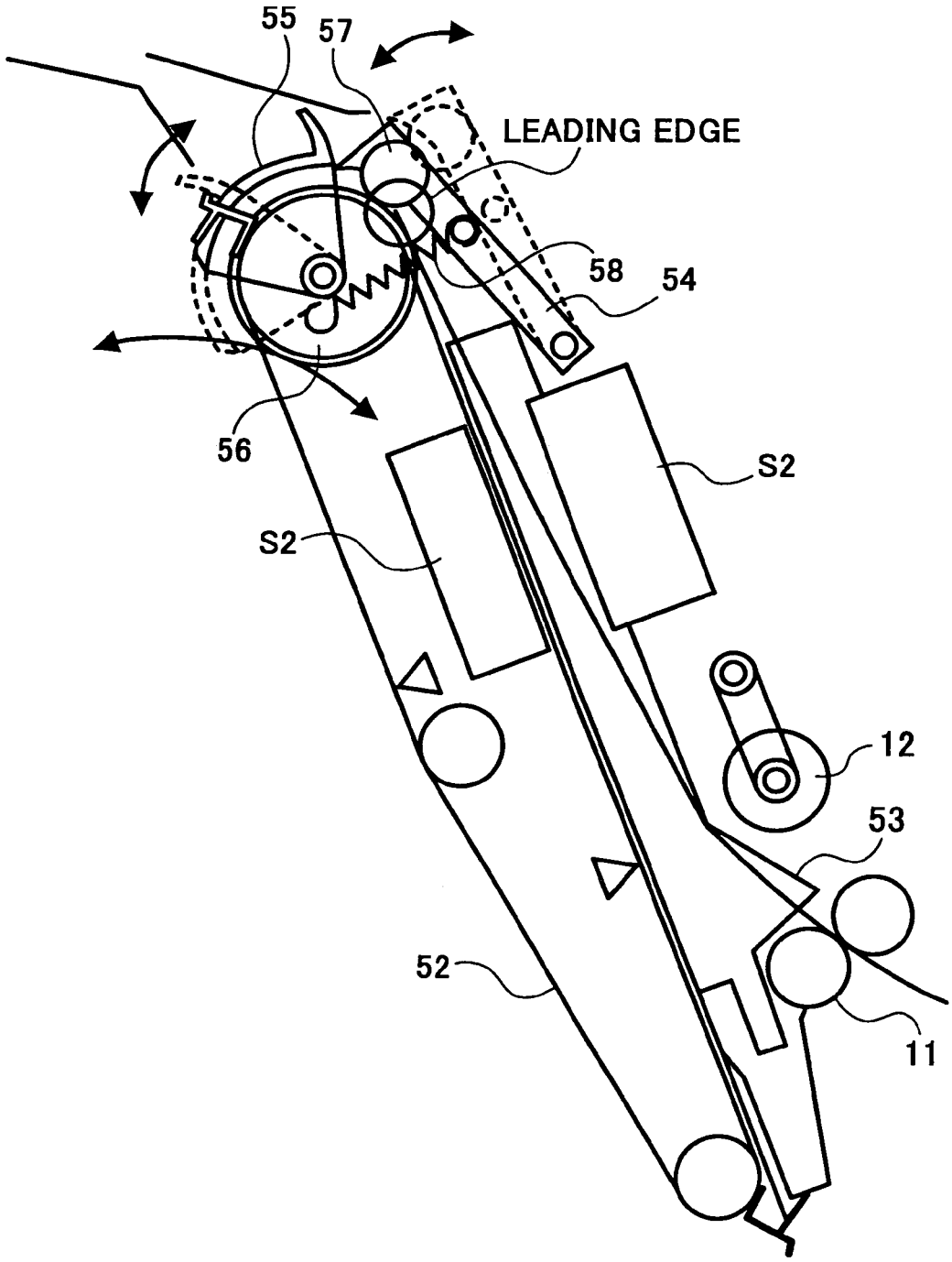
FIG. 42 shows a specific jam occurred at a press roller mounted on the guide plate.

A jam is likely to occur during the center staple mode stated above. FIGS. 42 through 45 show specific jams particular to the center staple mode. FIG. 42 shows a condition wherein when the guide plate 54 and movable guide 55 are held in the positions shown in FIG. 12 for forming the path to the fold tray G, the leading edge of a sheet path abuts against the press roller 57 without entering the nip between the press roller 57 and the discharge roller 56, jamming the path. In this condition, the illustrative embodiment immediately returns the guide plate 54 and movable guide 55 to positions indicated by phantom lines (home positions shown in FIG. 10), thereby forming a space for the removal of the sheet stack.

Figure 43:
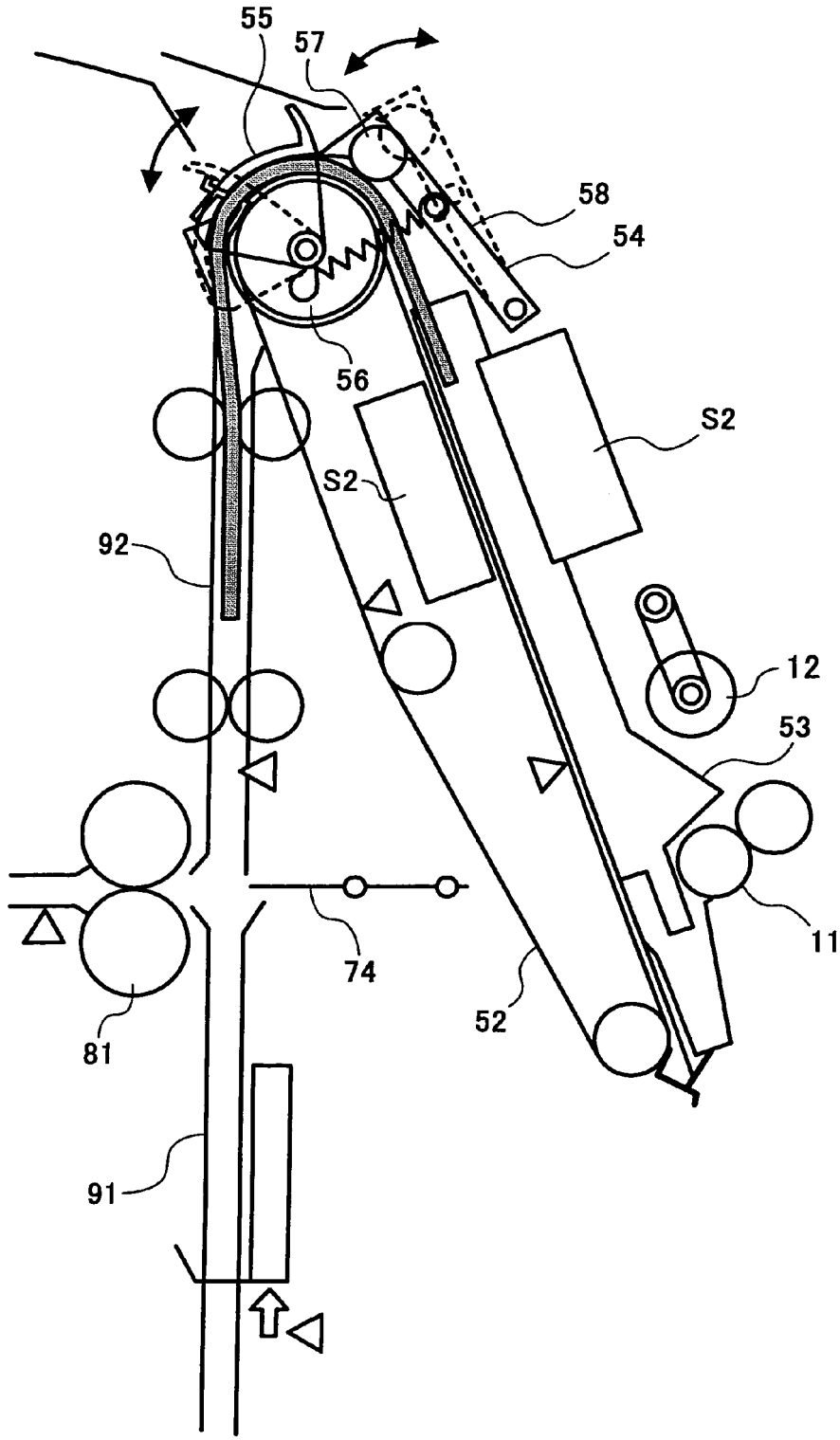
FIG. 43 shows another specific jam occurred on a path formed between the guide plate and movable guide and a discharge roller and extending to the fold tray.

FIG. 43 show the leading edge of a sheet stack PB being conveyed along the path formed by the guide plate 54 and movable guide 55 and the discharge roller 56 has jammed the path. In this condition, too, the illustrative embodiment immediately returns the guide plate 54 and movable guide 55 to positions indicated by phantom lines (corresponding to the home positions shown in FIG. 10), thereby forming a space for the removal of the sheet stack.

Figure 44:
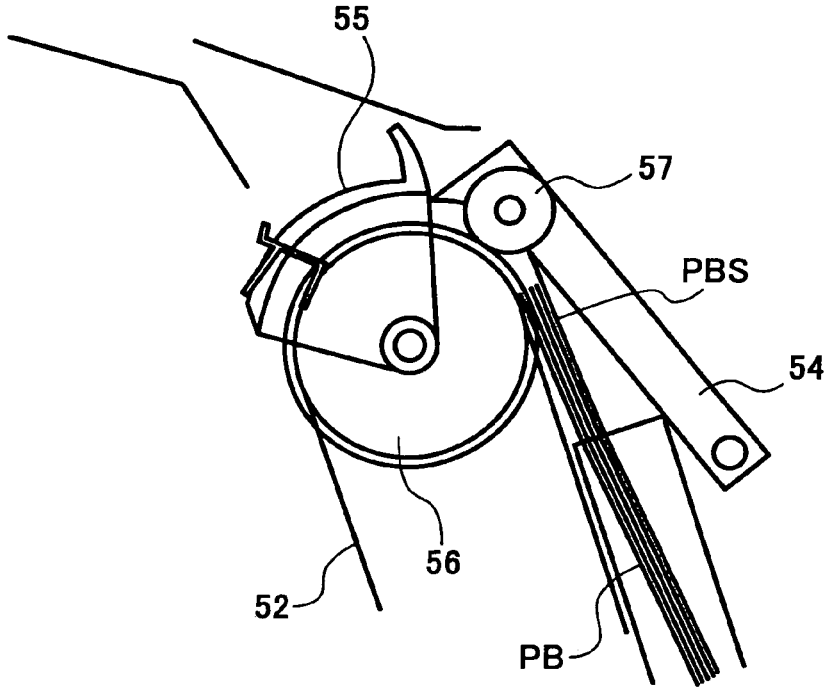
FIG. 44 shows still another specific jam caused by the leading edge of a cover included in a sheet stack and abutting against the press roller.
Figure 45:
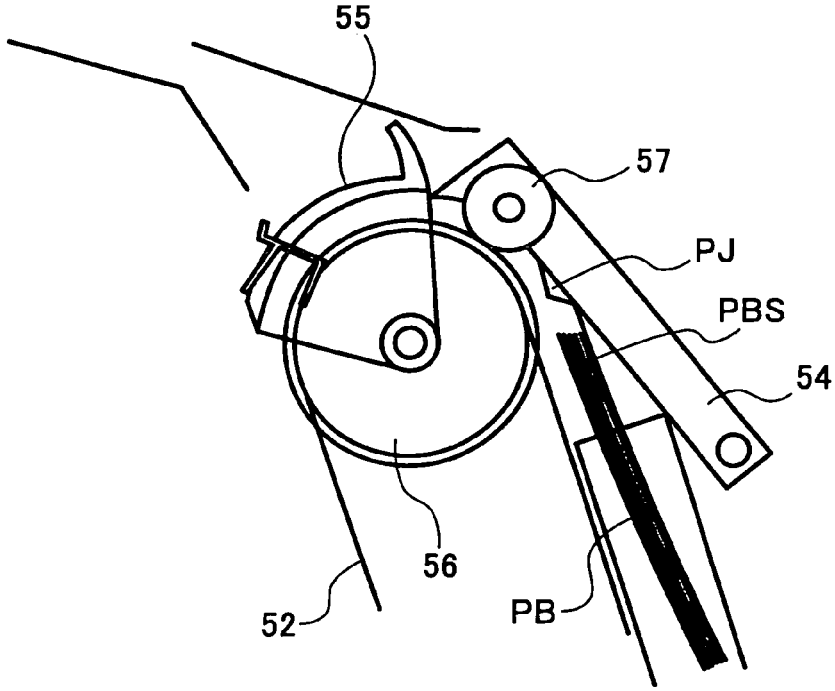
FIG. 45 shows a further specific jam caused by the leading edge of the cover abutting against a rib or similar projection positioned on the guide plate.

Further, the leading edge of a cover PBS on the top of a sheet stack PB is apt to be caught by the press roller, as shown in FIG. 44, or caught by a rib or similar projection PJ positioned on the guide plate 54. In any case, the illustrative embodiment immediately returns the guide plate 54 and movable guide 55 to positions shown in FIG. 10, i.e., returns the cam 61 to the home position. Stated another way, the illustrative embodiment cancels restriction exerted on a sheet stack or a sheet by the guide plate 54, movable guide 55, discharge roller 56 and press roller 57.

Figure 46:
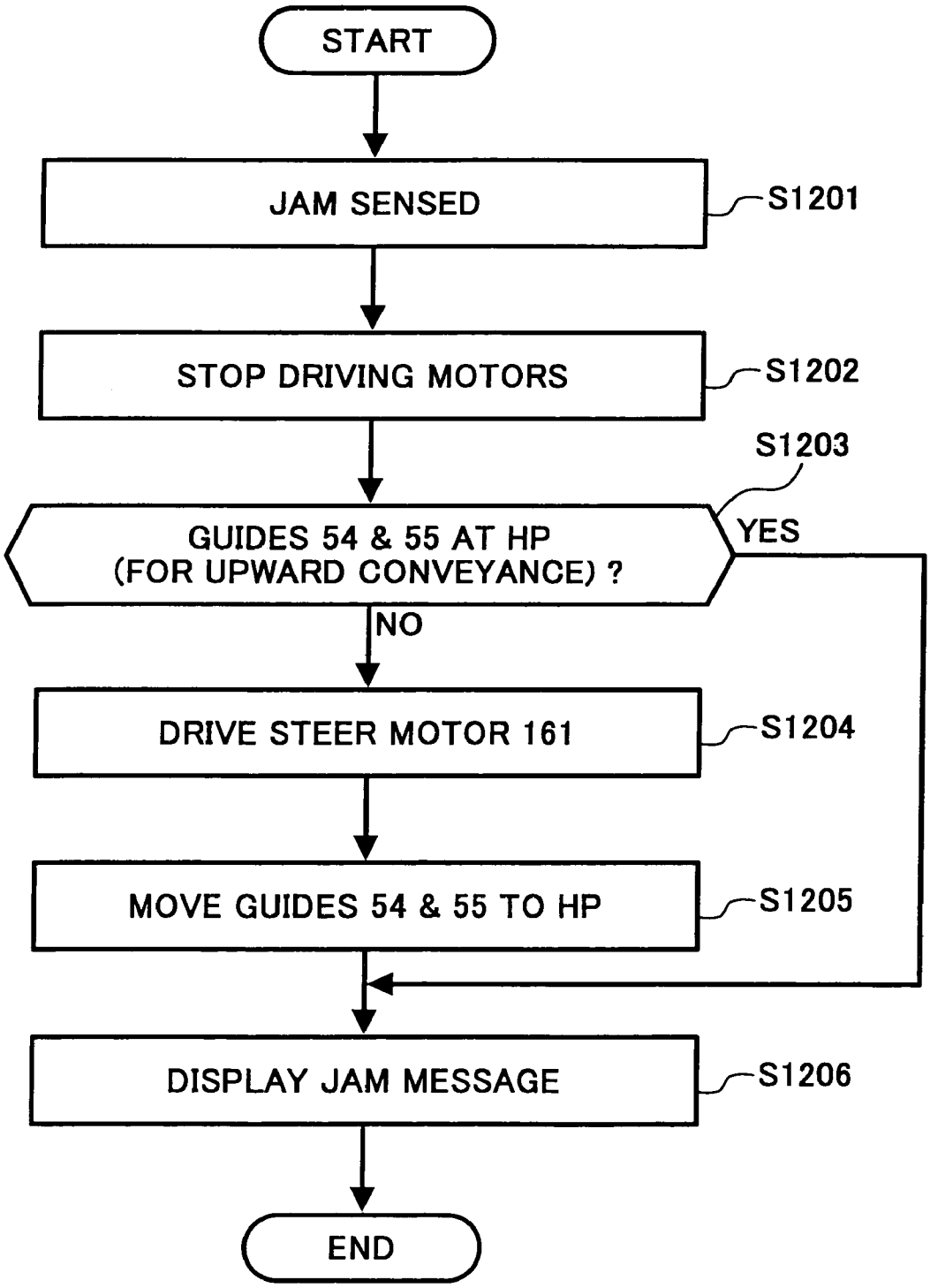
FIG. 46 is, a flowchart demonstrating a procedure for dealing with a jam.

More specifically, as shown in FIG. 46, when any one of the Jams described above occurs (step S1201), the CPU 360 stops driving the motors (step S1202) and then determines whether or not the guide plate 54 and movable guide 55 are held in the home positions where they guide sheets to the path C (step S1203). If the answer of the step S1203 is YES, then the CPU 360 displays a jam message on the operation panel of the image forming apparatus PR (step S1206) and then ends the procedure.

If the answer of the step S1203 is NO, then the CPU 360 turns on the steer motor 161 (step S1204) to return the guide plate 54 and movable guide plate 55 to the home positions (step S1205), displays a jam message (step S1206), and then ends the processing.

When a jam occurs during the fold mode operation, the CPU 360 executes the processing shown in FIG. 46 without regard to the location of the jam for the following reason. When the guide plate 54 and movable guide 55 are so positioned as to form the path extending to the fold tray G, the path extending to the shift tray 202 is closed. If all the mechanisms are caused to stop operating in the event of a jam occurred in such a condition, then it is difficult to remove sheets stacked on the staple tray F, i.e., to remove them from the discharge side of the staple tray F (upper portion in the illustrative embodiment). By executing the procedure shown in FIG. 46, the illustrative embodiment allows the operator to easily remove the jamming sheets via the path extending to the shift tray 202, which is unblocked.

Various modifications will become possible for those skilled in the art after receiving the teachings of the present disclosure without departing from the scope thereof.

What is claimed is:

1. A sheet finisher comprising:

processing means configured to execute preselected processing with either one of a sheet and a sheet stack;

switching means located at a position where a plurality of paths branch away for selectively steering the sheet or the sheet stack processed or not processed by said processing means toward said first path or said second path, the switching means including a second guide member spaced from a surface of a conveyor roller by a gap; and control means for selectively controlling said switching means to a first position assigned to a first path, a second position assigned to a second path, or a third position between said first position and said second position and also assigned to said second path, wherein the gap between the second guide member and the surface of the conveyor roller is greater in the third position than in the second position.

2. The sheet finisher as claimed in claim 1, wherein said switching means comprises:

a first guide member spaced from the surface of the conveyor roller, which conveys the sheet or the sheet stack, by a preselected distance and angularly movable along said surface;

drive means for selectively moving said first guide member to a first position assigned to said first path or a second position assigned to said second path;

the second guide member configured to guide, when said first guide member is located at said second position, the sheet or the sheet stack to the gap, which is between an upstream side of said first guide member in a direction of sheet conveyance and the surface of said conveyor roller, to unblock, when said first guide member is located at said first position, a route contiguous with said first path; and a press roller mounted on said second guide member for pressing the sheet or the sheet stack against said conveyor roller when said second guide member guides said sheet or said sheet stack toward said second path;

wherein said control means moves said press roller away from said conveyor roller by a preselected distance when locating said first guide member at said third position.

3. The sheet finisher as claimed in claim 2, wherein when the sheet stack should be conveyed to said second path, said control means detects a leading edge of the sheet stack at said third position and then locates said first guide member at said second position after said leading edge has moved away from a nip between said press roller and said conveyor roller.

4. The sheet finisher as claimed in claim 3, wherein said control means shifts said first guide member from said third position to said second position at a same timing without regard to a size of the sheet stack.

5. The sheet finisher as claimed in claim 2, wherein said preselected distance is variable in accordance with a number of sheets to be stapled together.

6. The sheet finisher as claimed in claim 5, wherein said preselected distance decreases with a decrease in the number of sheets to be stapled together.

7. The sheet finisher as claimed in claim 1, further comprising:

stacking means for stacking sheets;

stapling means for stapling a sheet stack positioned on said stacking means;

folding means for folding the sheet stack or the sheet with a fold roller;

conveying means for conveying the sheet stack or the sheet positioned on said stacking means to either one of said folding means and an outside of said sheet finisher; and wherein the switching means selectively steers the sheet stack or the sheet toward the first path extending to said folding means or the second path extending to the outside of said sheet finisher;

wherein when a jam occurs in a condition wherein said switching means selects said first path, a restriction of said switching means acting on the sheet stack or the sheet is canceled.

8. The sheet finisher as claimed in claim 7, wherein said conveying means comprises:

a roller for discharging, when said second path is selected, the sheet stack or the sheet to the outside of said sheet finisher;

a belt for raising the sheet stack or the sheet toward said roller; and a guide configured to guide, when said first path is selected, the sheet stack or the sheet toward said fold roller along a circumference of said roller.

9. The sheet finisher as claimed in claim 8, wherein said guide comprises:

a press roller for pressing the sheet stack or the sheet against said roller;

a guide plate for pressing said press roller against said roller when said first path is selected;

a guide member for forming a path between said guide plate and said roller; and a drive mechanism including a motor for driving said guide plate and said guide member.

10. The sheet finisher as claimed in claim 1, further comprising:

stacking means for stacking sheets;

stapling means for stapling a sheet stack positioned on said stacking means;

folding means for folding the sheet stack or the sheet with a fold roller;

conveying means for conveying the sheet stack or the sheet positioned on said stacking means to either one of said folding means and an outside of said sheet finisher; and wherein the switching means selectively steers the sheet stack or the sheet toward the first path extending to said folding means or the second path extending to the outside of said sheet finisher;

wherein when a jam occurs in a condition wherein said switching means selects said first path, a direction of conveyance is switched to said second path.

11. The sheet finisher as claimed in claim 10, wherein said conveying means comprises:

a roller for discharging, when said second path is selected, the sheet stack or the sheet to the outside of said sheet finisher;

a belt for raising the sheet stack or the sheet toward said roller; and a guide configured to guide, when said first path is selected, the sheet stack or the sheet toward said fold roller along a circumference of said roller.

12. The sheet finisher as claimed in claim 11, wherein said guide comprises:

a press roller for pressing the sheet stack or the sheet against said roller;

a guide plate for pressing said press roller against said roller when said first path is selected;

a guide member for forming a path between said guide plate and said roller; and a drive mechanism including a motor for driving said guide plate and said guide member.

13. The sheet finisher as claimed in claim 10, wherein said second path is selected immediately after the jam has occurred, thereby canceling a restriction on said first path.

14. An image forming system comprising:

an image forming apparatus for forming an image on a recording medium; and a sheet finisher as claimed in claim 7.

15. An image forming system comprising:

an image forming apparatus for forming an image on a recording medium; and a sheet finisher as claimed in claim 10.

16. A sheet finisher comprising:

a processor configured to execute preselected processing with either one of a sheet and a sheet stack;

a switch located at a position where a plurality of paths branch away to selectively steer the sheet or the sheet stack processed or not processed by said processor toward said first path or said second path, the switch including a second guide member spaced from a surface of a conveyor roller by a gap; and a control to selectively control said switch to a first position assigned to a first path, a second position assigned to a second path, or a third position between said first position and said second position and also assigned to said second path, wherein the gap between the second guide member and the surface of the conveyor roller is greater in the third position than in the second position.

17. The sheet finisher as claimed in claim 16, wherein said switch comprises:

a first guide member spaced from the surface of the conveyor roller, which conveys the sheet or the sheet stack, by a preselected distance and angularly movable along said surface:

a drive to selectively move said first guide member to a first position assigned to said first path or a second position assigned to said second paths;

the second guide member configured to guide, when said first guide member is located at said second position, the sheet or the sheet stack to the gap, which is between an upstream side of said first guide member in a direction of sheet conveyance and the surface of said conveyor roller to unblock, when said first guide member is located at said first position, a route contiguous with said first path; and a press roller mounted on said second guide member for pressing the sheet or the sheet stack against said conveyor roller when said second guide member guides said sheet or said sheet stack toward said second path;

wherein said control moves said press roller away from said conveyor roller by a preselected distance when locating said first guide member at said third position.

18. The sheet finisher as claimed in claim 17, wherein when the sheet stack should be conveyed to said second path, said control detects a leading edge of the sheet stack at said third position and then locates said first guide member at said second position after said leading edge has moved away from a nip between said press roller and said conveyor roller.

19. The sheet finisher as claimed in claim 18, wherein said control shifts said first guide member from said third position to said second position at a same timing without regard to a size of the sheet stack.

20. The sheet finisher as claimed in claim 17, wherein said preselected distance is variable in accordance with a number of sheets to be stapled together.

21. The sheet finisher as claimed in claim 20, wherein said preselected distance decreases with a decrease in the number of sheets to be stapled together.

22. The sheet finisher as claimed in claim 16, further comprising:

a stacker to stack sheets;

a stapler to staple a sheet stack positioned on said stacker;

a folding unit to fold the sheet stack or the sheet with a fold roller;

a conveyor unit to convey the sheet stack or the sheet positioned on said stacker to either one of said folding unit and an outside of said sheet finisher; and wherein the switch selectively steers the sheet stack or the sheet towards the first path extending to said folding unit or the second path extending to the outside of said sheet finisher;

wherein when a jam occurs in a condition wherein said switch selects said first path, a restriction of said switch acting on the sheet stack or the sheet is canceled.

23. The sheet finisher as claimed in claim 22, wherein said conveying comprises:

a roller for discharging, when said second path is selected, the sheet stack or the sheet to the outside of said sheet finisher;

a belt for raising the sheet stack or the sheet toward said roller; and a guide configured to guide, when said first path is selected, the sheet stack or the sheet toward said fold roller along a circumference of said roller.

24. The sheet finisher as claimed in claim 23, wherein said guide comprises:

a press roller for pressing the sheet stack or the sheet against said roller;

a guide plate for pressing said press roller against said roller when said first path is selected;

a guide member for forming a path between said guide plate and said roller; and a drive mechanism including a motor for driving said guide plate and said guide member.

25. The sheet finisher as claimed in claim 16, further comprising:

a stacker to stack sheets;

a stapler to staple a sheet stack positioned on said stacker;

a folding unit to fold the sheet stack or the sheet with a fold roller;

a conveying unit to convey the sheet stack or the sheet positioned on said stacker to either one of said folding unit and an outside of said sheet finisher; and wherein the switch selectively steers the sheet stack or the sheet toward the first path extending to said folding unit or the second path extending to the outside of said sheet finisher;

wherein when a jam occurs in a condition wherein said switch selects said first path, a direction of conveyance is switched to said second path.

26. The sheet finisher as claimed in claim 25, wherein said conveying unit comprises:

a roller for discharging, when said second path is selected, the sheet stack or the sheet to the outside of said sheet finisher;

a belt for raising the sheet stack or the sheet toward said roller; and a guide configured to guide, when said first path is selected, the sheet stack or the sheet toward said fold roller along a circumference of said roller.

27. The sheet finisher as claimed in claim 26, wherein said guide comprises:

a press roller for pressing the sheet stack or the sheet against said roller:

a guide plate for pressing said press roller against said roller when said first path is selected;

a guide member for forming a path between said guide plate and said roller; and a drive mechanism including a motor for driving said guide plate and said guide member.

28. The sheet finisher as claimed in claim 25, wherein said second path is selected immediately after the jam has occurred, thereby canceling a restriction on said first path.

29. An image forming system comprising:

an image forming apparatus for forming an image on a recording medium; and a sheet finisher as claimed in claim 22.

30. An image forming system comprising:

an image forming apparatus for forming an image on a recording medium; and a sheet finisher as claimed in claim 24.

31. A sheet finisher comprising:

processing means configured to execute preselected processing with either one of a sheet and a sheet stack;

switching means located at a position where a plurality of paths branch away for selectively steering the sheet or the sheet stack processed or not processed by said processing means toward a first path or a second path, the switching means including a guide member and a press roller; and control means for selectively controlling said guide member to be located at a first position when the sheet or sheet stack is guided toward the first path, and controlling said guide member to be located at a second position at which the press roller presses the sheet or sheet stack against a conveyor roller when the sheet or sheet stack is guided toward the second path.

32. A sheet finisher comprising:

a processor configured to execute preselected processing with either one of a sheet and a sheet stack;

a switch located at a position where a plurality of paths branch away to selectively steer the sheet or the sheet stack processed or not processed by said processor toward a first path or a second path, the switch including a guide member and a press roller; and a control to selectively control said guide member to be located at a first position when the sheet or sheet stack is guided toward the first path, and controlling said second guide member to be located at a second position at which the press roller presses the sheet or sheet stack against a conveyor roller when the sheet or sheet stack is guided toward the second path.

* * * * *